US009510682B2

(12) United States Patent
Hasegawa et al.

(10) Patent No.: US 9,510,682 B2
(45) Date of Patent: Dec. 6, 2016

(54) NESTABLE CHAIR

(71) Applicant: ITOKI CORPORATION, Osaka-shi, Osaka (JP)

(72) Inventors: Masashi Hasegawa, Osaka (JP); Yoshinori Kurata, Osaka (JP)

(73) Assignee: ITOKI CORPORATION, Osaka-shi, Osaka (JP)

( * ) Notice: Subject to any disclaimer, the term of this patent is extended or adjusted under 35 U.S.C. 154(b) by 0 days.

(21) Appl. No.: 14/554,328

(22) Filed: Nov. 26, 2014

(65) Prior Publication Data

US 2015/0076876 A1 Mar. 19, 2015

Related U.S. Application Data

(63) Continuation of application No. PCT/JP2013/065017, filed on May 30, 2013.

(30) Foreign Application Priority Data

May 31, 2012 (JP) ..... 2012-124958
Nov. 14, 2012 (JP) ..... 2012-250412

(51) Int. Cl.
*A47C 3/04* (2006.01)
*A47C 7/00* (2006.01)
(Continued)

(52) U.S. Cl.
CPC ..... *A47C 3/045* (2013.01); *A47C 1/03255* (2013.01); *A47C 1/03272* (2013.01);
(Continued)

(58) Field of Classification Search
CPC ..... A47C 3/045; A47C 7/004; A47C 3/20; A47C 7/46; A47C 3/18; A47C 7/02; A47C 3/30; A47C 1/03272; A47C 1/03294; A47C 1/03255
See application file for complete search history.

(56) References Cited

U.S. PATENT DOCUMENTS 6,030,037 A 2/2000 Ritch et al.
6,142,566 A 11/2000 Ritch et al.
(Continued)

FOREIGN PATENT DOCUMENTS

JP 3730119 B 12/2005
JP 2008-113937 A 5/2008
(Continued)

OTHER PUBLICATIONS

English Translation of International Preliminary Report on Patentability for PCT/JP2013/065017 dated Dec. 2, 2014 (7 pages).*

*Primary Examiner* — Rodney Mintz
(74) *Attorney, Agent, or Firm* — Drinker Biddle & Reath LLP

(57) ABSTRACT

A chair includes a support device that is capable of fitting support devices of another chair, a backrest that is attached to the support device or an intermediate support member provided for the support device so that the backrest is capable of being tilted rearwards, and a seat that is capable of being raised from an unfolded posture to a raised posture overlapping with a front side surface of the backrest, a plurality of chairs being capable of being fitted with each other back and forth by raising the seats thereof. The seat is attached to the support device, the backrest or the intermediate support member so that the seat is capable of being raised and rotated and so that the seat is capable of taking at least one movement of forward movement, retreat movement and tilting at the unfolded posture.

12 Claims, 40 Drawing Sheets

(51) Int. Cl.

| | |
|---|---|
| ***A47C 7/02*** | (2006.01) |
| ***A47C 3/18*** | (2006.01) |
| ***A47C 3/30*** | (2006.01) |
| ***A47C 3/20*** | (2006.01) |
| ***A47C 7/46*** | (2006.01) |
| ***A47C 1/032*** | (2006.01) |

(52) U.S. Cl.

CPC ..... *A47C 1/03294* (2013.01); *A47C 3/18* (2013.01); *A47C 3/20* (2013.01); *A47C 3/30* (2013.01); *A47C 7/004* (2013.01); *A47C 7/02* (2013.01); *A47C 7/46* (2013.01)

(56) References Cited

U.S. PATENT DOCUMENTS

| | | | | |
|---|---|---|---|---|
| 6,286,901 | B1 * | 9/2001 | Ritch ..... | A47C 3/04 297/239 |
| 7,325,873 | B2 | 2/2008 | Stewart et al. | |
| 8,540,315 | B2 * | 9/2013 | Piretti ..... | A47C 3/045 297/239 |
| 2011/0175412 | A1 * | 7/2011 | Piretti ..... | A47C 3/045 297/239 |

FOREIGN PATENT DOCUMENTS

| | | | | |
|---|---|---|---|---|
| JP | 4306922 | B | | 8/2009 |
| JP | 2010-051612 | A | | 3/2010 |
| JP | 2011-161123 | A | | 8/2011 |
| JP | 2013248148 | A | * | 12/2013 |
| JP | 2014004320 | A | * | 1/2014 |
| JP | 2014004321 | A | * | 1/2014 |
| WO | WO-2012/060462 | A1 | | 5/2012 |

* cited by examiner 3
12
9a
16
11
2
15
35
14
24
9
8
4

12
9a
11
16
2
20
15
18
25
14
24
9
8
4

FIG. 3A
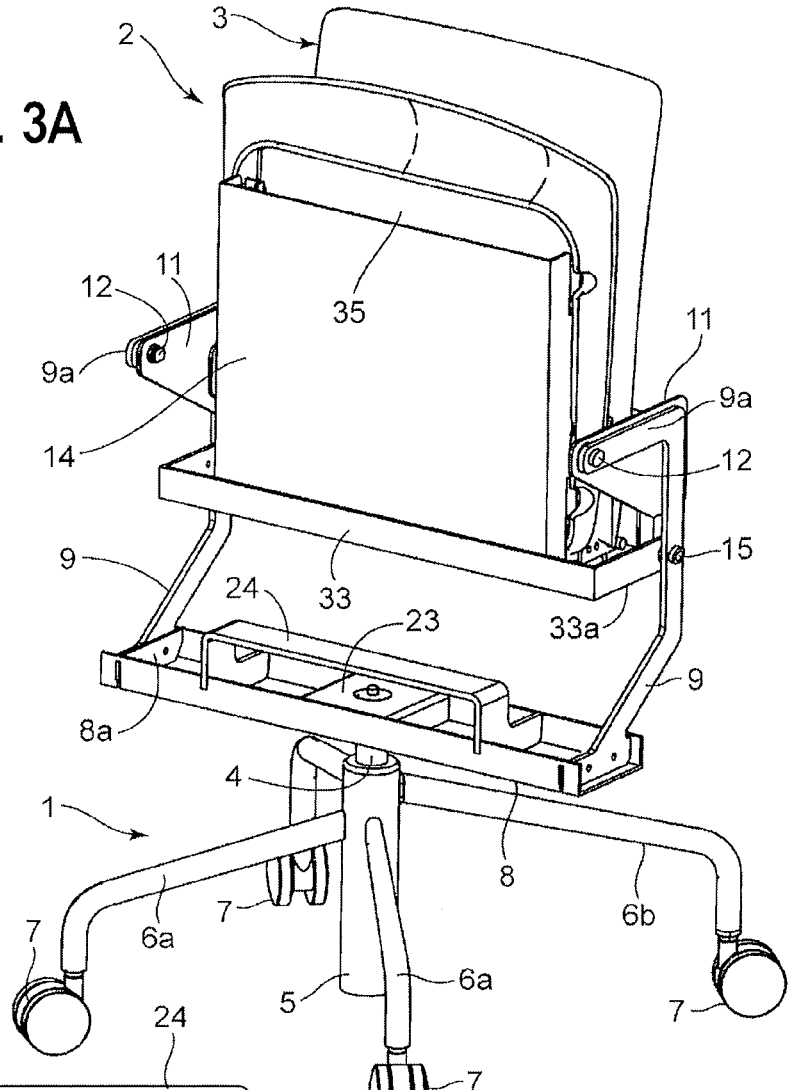
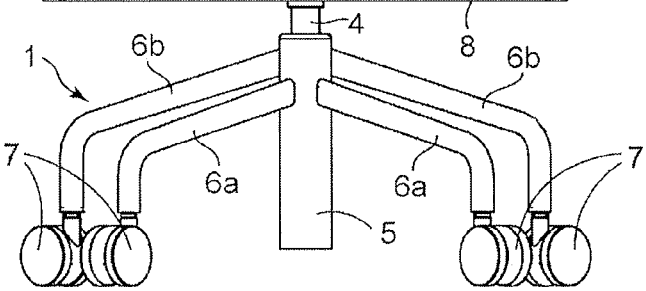
FIG. 3B

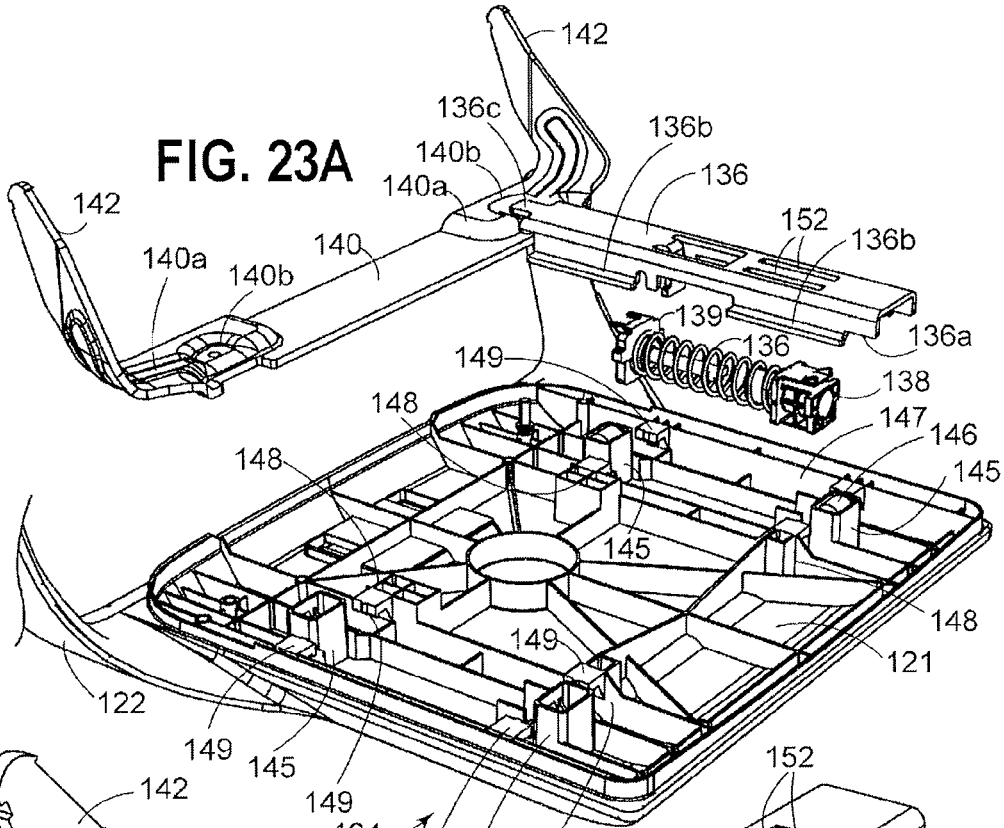
FIG. 23A
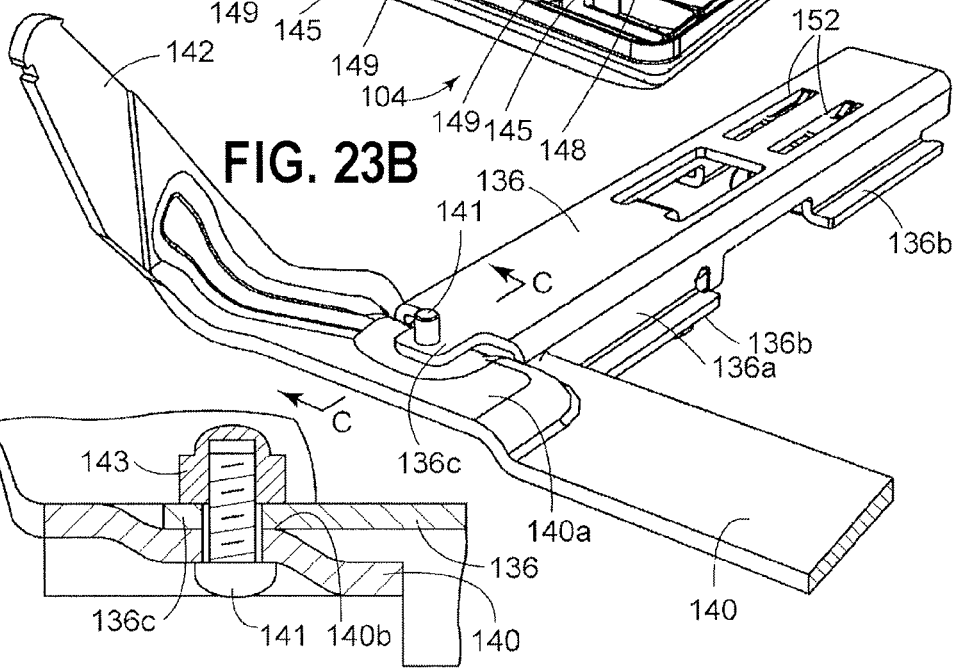
FIG. 23B
FIG. 23C

FIG. 25A
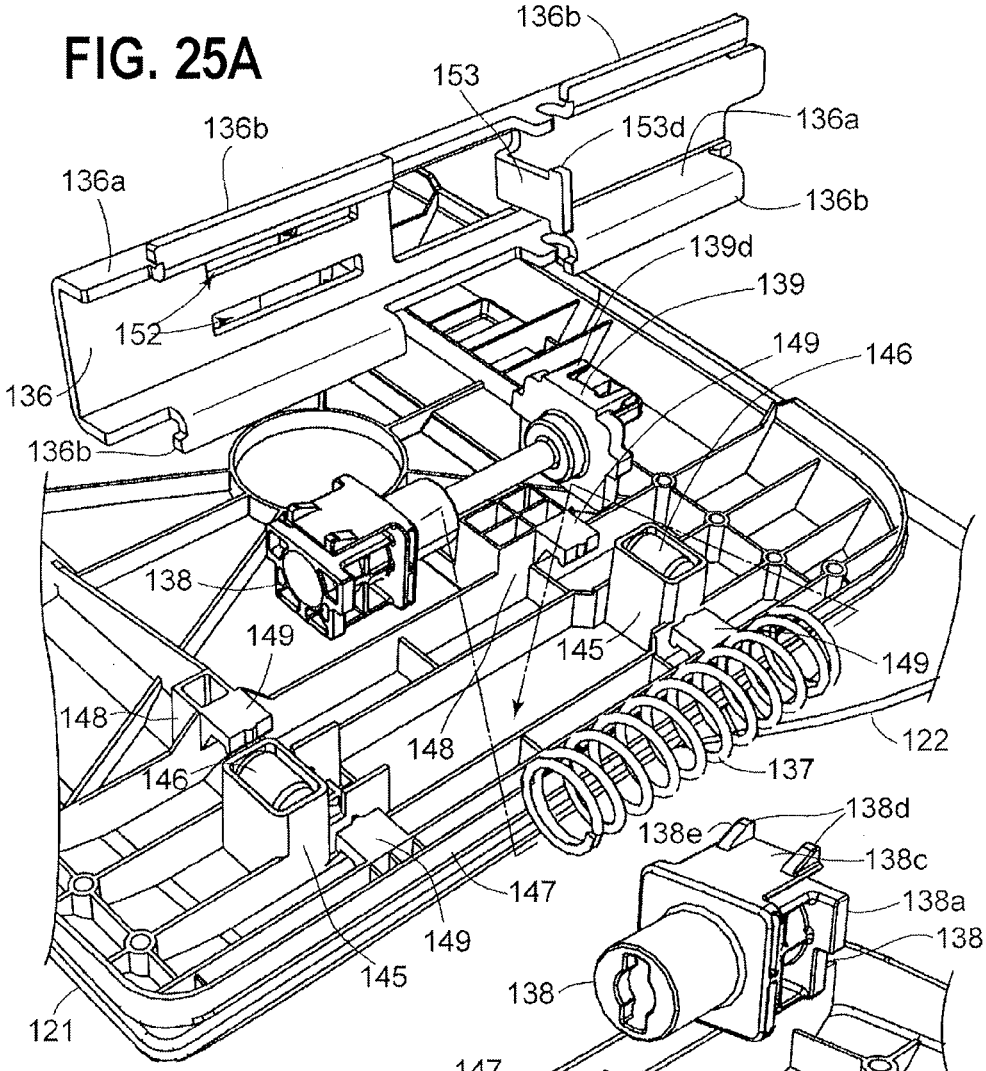
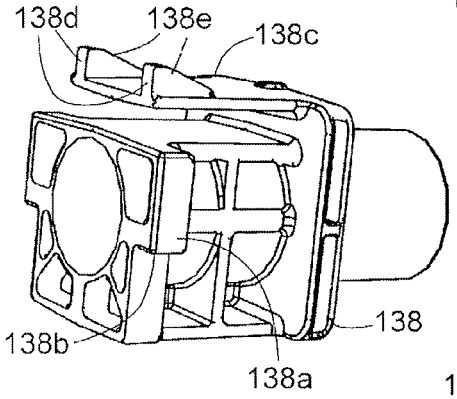
FIG. 25C
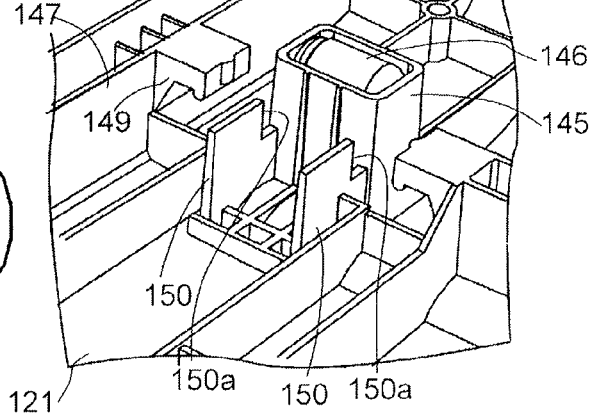
FIG. 25B 103
143b
143
129
131
130
143a
149a
144
169
132
129
143c
142
143b
144
143d 143c
143c
143d
129
143
171
170
102
142
119
106
122
143a
144
143c
143d
144a
176
143
142a
177
104
142

FIG. 34A
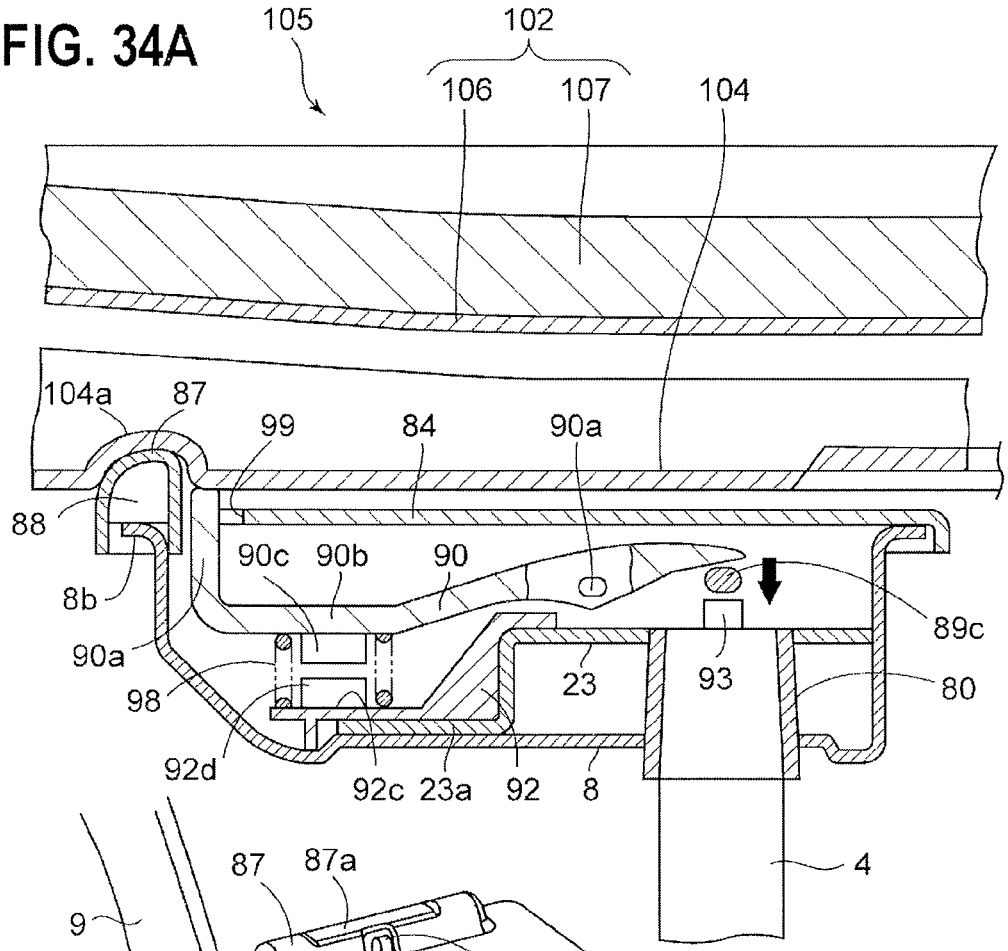
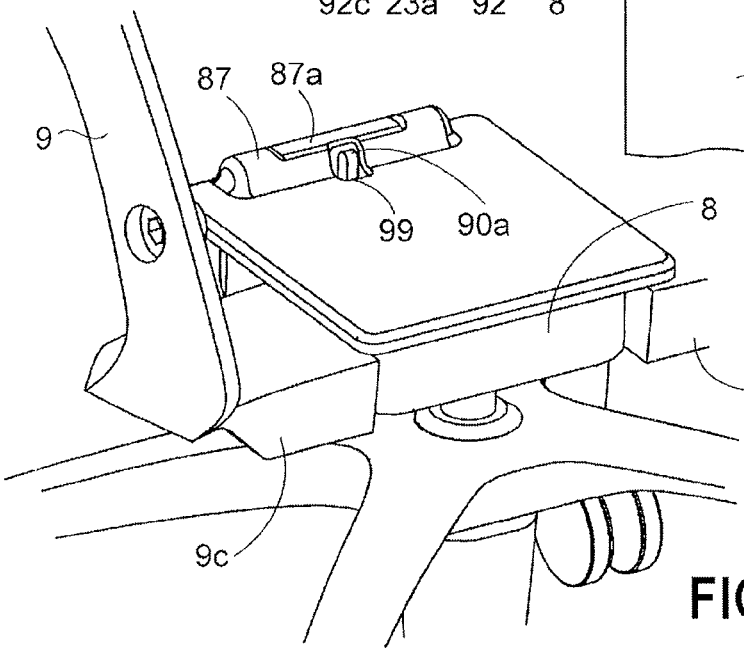
FIG. 34B

FIG. 35A
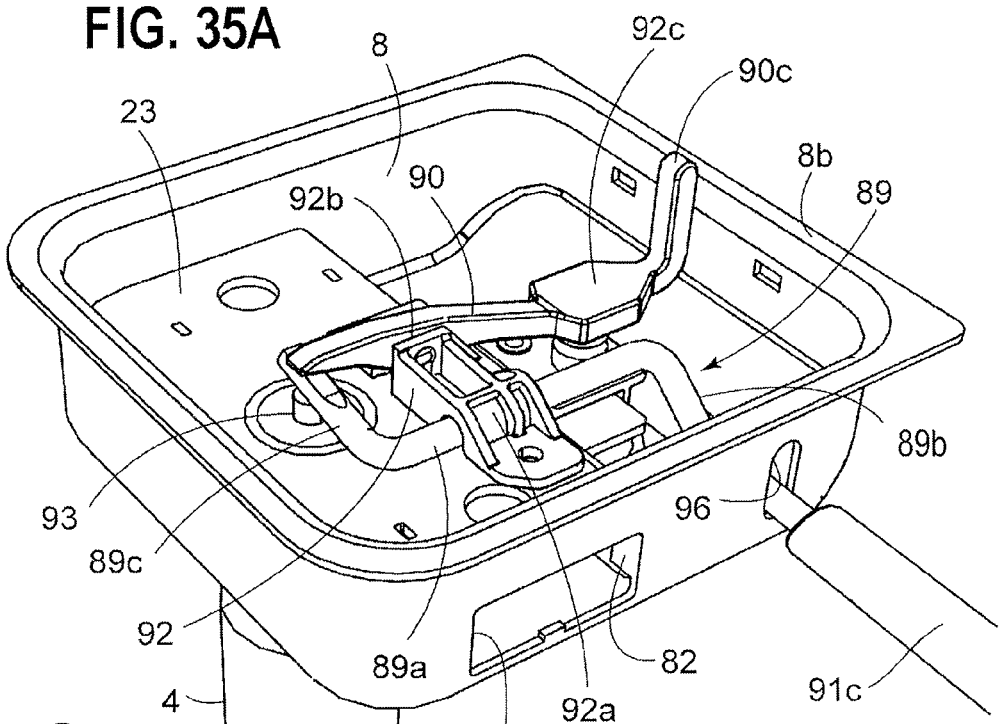
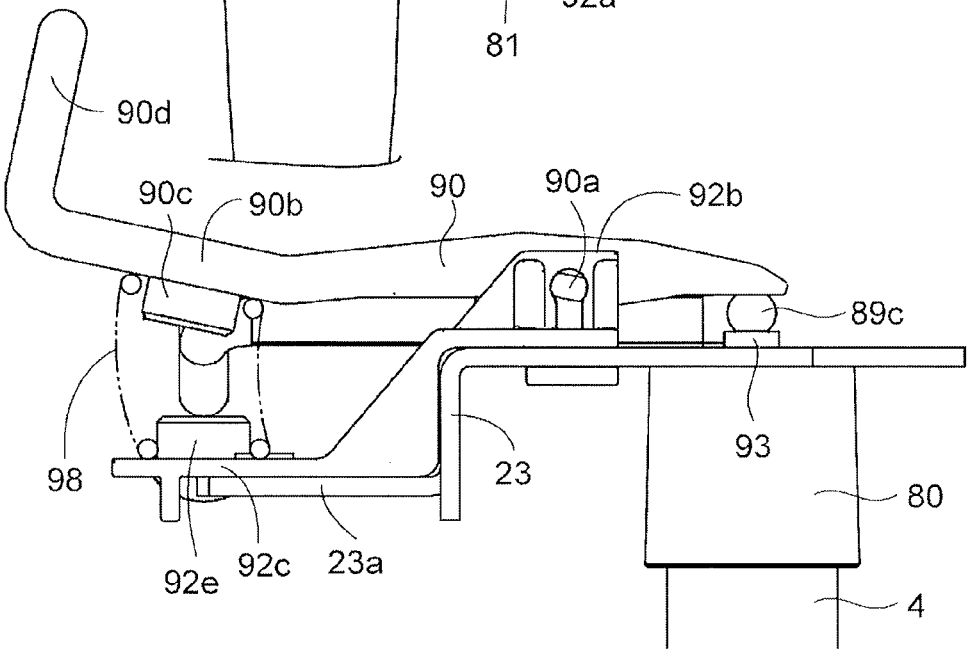
FIG. 35B

FIG. 37A
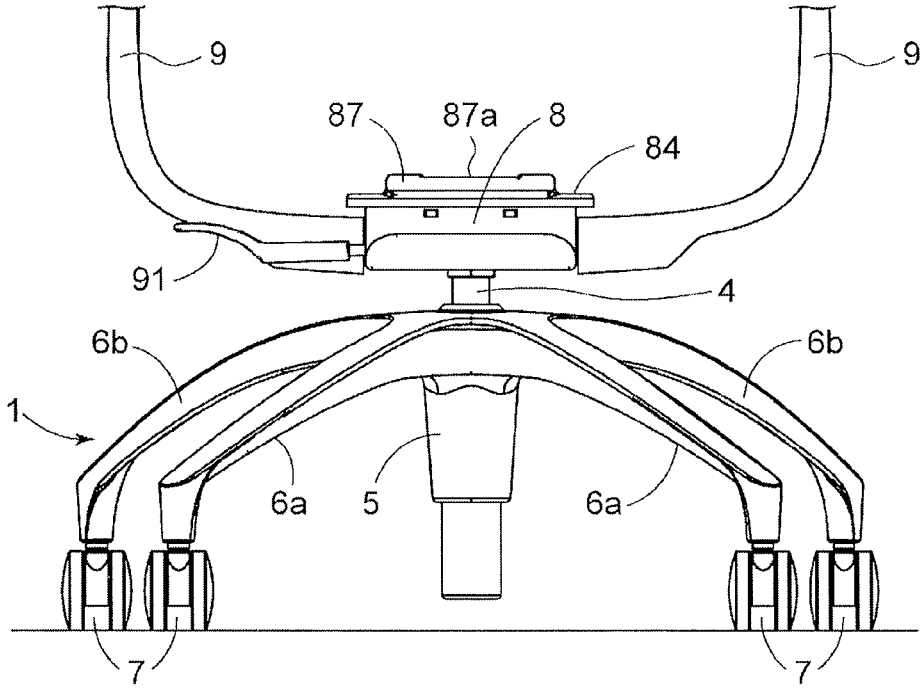
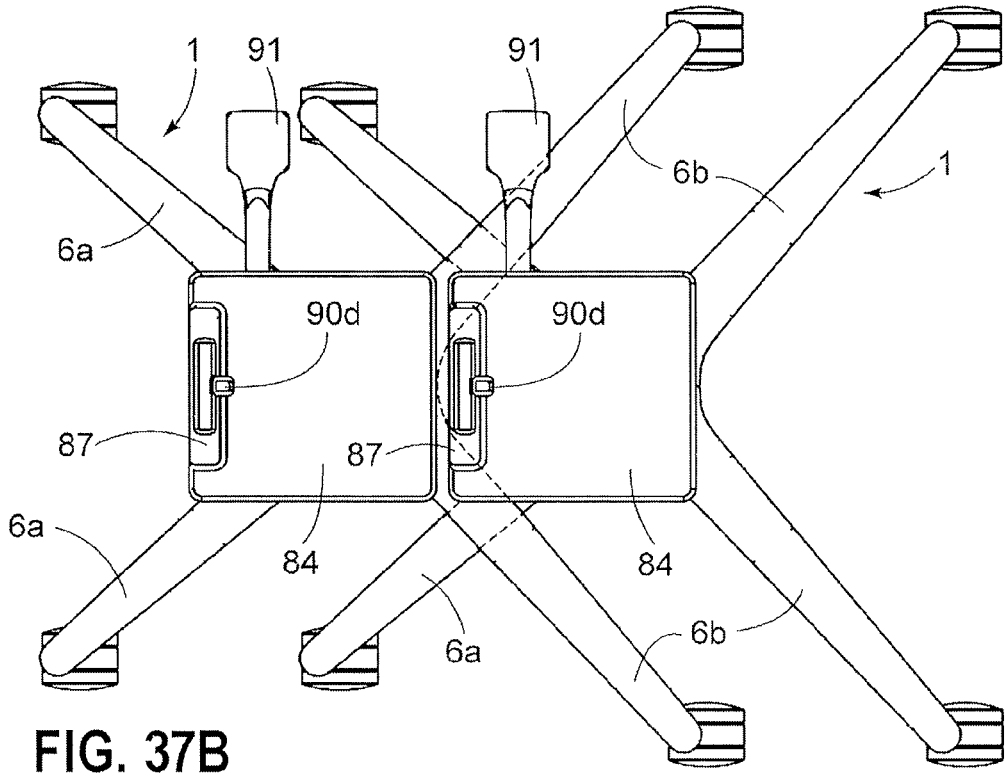
FIG. 37B

NESTABLE CHAIR

CROSS REFERENCE TO RELATED APPLICATIONS

This application is a continuation of PCT application No. PCT/JP2013/065017, which was filed on May 30, 2013 based on Japanese Patent Application Nos. 2012-124958 filed on May 31, 2012 and 2012-250412 filed on Nov. 14, 2012, the contents of which are incorporated herein by reference.

BACKGROUND

1. Technical Field

The present invention relates to a nestable chair.

2. Related Art

In order to save a storage space when a chair is not in use, an operation of fitting (nesting) chairs each other in a front-rear direction (a horizontal direction) has been widely performed. As a nestable chair, a type referred to as a pipe chair in which a body frame is configured by a metallic pipe has been used in many cases. Also, a chair (a swivel chair) in which an extendable gas cylinder is used for a leg and which is made to be nestable has been suggested. An example thereof is disclosed in Patent Documents 1 and 2.

Specifically, according to Patent Document 1, legs are configured as four front and rear branched legs, a height of the two front branched legs is set to be lower than a height of the two rear branched legs and an extended angle of the two front branched legs is set to be less than an extended angle of the two rear branched legs, so that support devices arranged at the front and the rear can be fitted with each other.

A backrest is attached to a fixed base oblong in a left-right direction and provided on an upper end of a leg column (the gas cylinder) through left and right back frames, and a resistance against the rocking of the backrest is provided by a torsion bar embedded in the fixed base. A lower surface of a seat is formed at a substantial center part in the front-rear direction with bearing brackets protruding downwardly and configured to be rotatably fitted to spindle parts provided for the fixed base, so that the seat is permitted to be raised and rotated. Therefore, a raising and rotating center of the seat and a tilting center (a rotating center) of the backrest are concentric.

According to Patent Document 1, since the intermediate part of the seat in the front-rear direction is coupled to the fixed base, a lower half part of the seat is positioned below a lower end of the back and the fixed base at a raised state. Also, an empty space for permitting a rear half part of the seat to be rotated downwardly is provided at the rear of the fixed base.

While the seat can be horizontally rotated relative to the support device, the support device has directionality upon the nesting. Thus, Patent Document 1 discloses that when the seat is raised, the support device is positioned at a nestable posture. Also, when the seat is raised, a locked state of the gas cylinder is released, so that the seat is raised to the highest position. Thereby, it is possible to secure the deepest fitting and to align the heights of the respective chairs at the nesting state to thus have a favorable appearance.

According to Patent Document 2, a seat has a circular shape, as seen from above, is provided with an armrest and backrest part extending half around a rear side of the seat, as seen from above, and is coupled at an intermediate part thereof in the front-rear direction to a fixed base through a link. When the armrest and backrest part is tilted forwards, the seat is rotated to a back inclined posture.

CITATION LIST

Patent Literature

[Patent Document 1] Japanese Patent No. 3,730,119B
[Patent Document 2] Japanese Patent No. 4,306,922B

SUMMARY

As already described, the chair nesting is to save the storage space when the chair is not in use. In the related art, a simple structure such as the pipe chair has been used in many cases. However, when the structure is simple, it cannot be said that a sitting comfort is good when sitting on the chair for a long time. A factor highly influencing the sitting comfort is the rocking of the back. For the pipe chair, a slight rocking characteristic is provided for the back by using a bending deformation of the frame material. However, even though the bending deformation of the frame material is used, a rocking angle is extremely small. Therefore, it can be said that the measure of the related art rarely contributes to the improvements on the sitting comfort when sitting on the chair for a long time.

In this regard, when the configuration of Patent Document 1 is adopted, the backrest largely rocks, like the general swivel chair, which contributes the improvements on the sitting comfort. However, it cannot be said that the improvements on the sitting comfort/amenity are sufficient. That is, there is still room for improvement.

In other words, when sitting on the pipe chair for a long time, the sitting comfort is not good. The main reason is that even if a user moves the body, the backrest and the seat do not follow the movement and the movement of the body is thus constrained by the chair. In this respect, since the general rocking swivel chair is configured so that as the backrest rocks, the seat is also moved in conjunction with the rearward tilting of the back, the following capabilities of the back and seat to the movement of the user are high, so that it is difficult for the user to be fatigued even though the user uses the chair continuously for a long time. However, according to Patent Document 1, the backrest simply rocks and the position and posture of the seat are not changed even if the backrest rocks. Therefore, it is not possible to secure the sitting comfort of the general rocking swivel chair. That is, there is still room for improvement.

It is therefore an object of the present invention to improve a sitting comfort of a nestable rocking chair. Also, the present invention discloses a number of improved configurations, which can be considered as independent inventions, and another object of the present invention is to provide a chair having the improved configurations.

The present invention includes a first invention. The first invention includes a support device capable of fitting a plurality of the support devices each other in a front-rear direction; a backrest attached to the support device or an intermediate support member provided for the support device so that the backrest can be tilted rearwards, and a seat capable of being raised from an unfolded posture at which a person can sits thereon to a raised posture overlapping with a front side surface of the backrest, a plurality of chairs being capable of being fitted with each other back and forth by raising the seats, wherein the seat is attached to the support device, the backrest or the intermediate support member so that the seat can be raised and rotated and so that the seat can take at least one movement of forward movement, retreat movement and tilting at the unfolded posture.

The first invention can be developed in a variety of forms. The examples thereof are specified as second to tenth inventions. Regarding the first invention, according to the second invention, a posture change of the seat between the unfolded posture and the raised posture is permitted as a rear end portion of the seat is rotated about one rotating point positioned in the vicinity of the rear end portion, the support device or a fixed base functioning as the intermediate support member provided for the support device is provided with a seat support part configured to support a part of the seat of the unfolded posture in front of the rotating point, and when the seat is raised and rotated to the raised posture from the unfolded posture, the seat support part is exposed.

In the fourth invention, the first invention is applied to a so-called swivel chair. In the fourth invention, the support device has a structure where a plurality of branched legs radially extends from a leg column consisting of a gas cylinder, the fixed base is attached to an upper end of the leg column and a tip of each branched leg is provided with a caster, and a group of the branched legs is asymmetrically configured in the front-rear direction, as seen from above and the side, so that a plurality of the groups is permitted to fit with each other back and forth.

The fifth invention is a developed example of the third invention. In the fifth invention, the fixed base is provided with support frames protruding upwardly beyond the seat at both left and right sides of the seat, as the intermediate support member, and the backrest and the seat are attached to the support frames directly or via other members.

The sixth invention is a developed example of the fourth or fifth invention. In the sixth invention, the fixed base is provided with a manual lifting operation device enabling a sitting person to release a locked state of the gas cylinder and an automatic raising means for releasing the locked state of the gas cylinder by a spring force, and the automatic raising means and the seat are configured to interlock with each other so that the locked state of the gas cylinder is released at the unfolded state of the seat and the gas cylinder is locked at the raised state of the seat.

The seventh invention is a developed example of the first or second invention. In the seventh invention, the support device is a fixed type of which a height cannot be adjusted, the fixed type support device is provided with support frames positioned at left and right outer sides of the seat and protruding upwardly beyond the seat, as the intermediate support member, and the backrest and the seat are attached to the support frames directly or via other members.

The eighth invention is also a developed example of the first or second invention. In the eighth invention, the backrest and the seat are configured to directly interlock with each other or to interlock with each other via an interlocking means so that when the backrest is tilted rearwards, the seat takes at least one movement of the forward movement, the retreat movement and the tilting, and a spring means for returning the backrest and the seat to original states when a body pressure of a sitting person applied to the backrest is released is provided.

The ninth invention is an implemented example of the eighth invention. In the ninth invention, the seat is mounted to be movable back and forth to a movable base member, which is attached to the support device, the intermediate support member or the backrest so that it can be raised and rotated, and when the backrest is tilted rearwards, the seat is moved forwards.

The tenth invention is a developed example of the eighth invention. In the tenth invention, the seat is coupled to the support device, the intermediate support member or the backrest so that the seat can be raised and rotated and so that the seat is retreated or moved forwards in conjunction with rearward tilting of the backrest, and a part of the seat in front of the raising and rotating point is supported with being slidably movable to the support device or fixed base provided for the support device.

The eleventh invention is a developed example of the first or second invention. In the eleventh invention, the seat is mounted to be movable back and forth to a movable base member, which is attached to the support device, the intermediate support member or the backrest so that it can be raised and rotated, and forward movement of the seat relative to the movable base is supported by a spring means, so that when a sitting person leans on the backrest, the seat is moved forwards against the spring means by a pushing action of the person.

The twelfth invention includes a support device capable of fitting a plurality of the support devices each other in a front-rear direction; a backrest attached to the support device or an intermediate support member provided for the support device, and a seat capable of being raised from an unfolded posture at which a person can sits thereon to a raised posture overlapping with a front side surface of the backrest, a plurality of chairs being capable of being fitted with each other back and forth by raising the seats, wherein the seat is attached to the support device, the backrest or the intermediate support member so that the seat can be raised and rotated and so that the seat is moved forwards at the unfolded posture by a pushing action of a person.

According to the present invention, the seat can be moved in conjunction with or without the rearward tilting of the backrest. Therefore, when a user of the chair tilts rearwards an upper half body or the seat is moved forward, retreated or tilted, it is possible to keep the body at a relaxed state during the rocking. Thereby, it is possible to provide the nestable chair capable of accomplishing a high sitting comfort, which has not been provided in the related art.

According to Patent Document 1, for example, the seat is rotated about an intermediate position in the front-rear direction. Therefore, a space for arranging the raised seat should be empty at the rear of the fixed base. In this case, a design is highly restricted. For example, shapes or arrangements of the fixed base and backrest should be designed not to collide with the raised seat.

In contrast, when the rotating point of the seat is positioned at the rear of the seat, like the second invention, the seat is simply rotated within an area above the fixed based. Therefore, it is not necessary to secure a space for permitting the seat to rise and rotate at the rear of the fixed base. As a result, it is possible to increase the degree of design freedom of the fixed base. Also, since the raised seat is positioned in front of the backrest, the shape or height of the backrest is not restricted by the seat, so that the degree of design freedom of the backrest is also improved. Therefore, according to the second invention, it is possible to provide the chair increasing the degree of design freedom and having the excellent sitting comfort.

When the rotating point of the seat is located at the rear end portion of the seat and at the position higher than the seat surface, like the third invention, it is possible to position the rear end of the seat at the rear side as much as possible at the unfolded posture and at the front of the backrest at the raised state of the seat. Therefore, it is possible to provide the chair configured to raise the seat and to secure a wide sitting area, so that it is possible to secure the high sitting comfort.

The support device can be adopted in a variety of forms. However, the fourth invention including the leg column consisting of the gas cylinder is user-friendly because it is possible to adjust a height of the seat surface in conformity to the physique or preference of the user. Also, since the fourth invention has the common design to the swivel chair of the related art, it can be widely accepted without a sense of discomfort. Further, since the caster is provided, the usability is excellent and moving operations for storage and takeoff are easy.

In the support device having the gas cylinder, the fixed base is normally fixed to the upper end of the gas cylinder, and the backrest and the seat are attached to the upward-facing support frames provided for the fixed base. In this case, the support frames may be disposed at the rear of the seat. However, when the support frames are disposed at both left and right sides of the seat, like the fifth invention, it is possible to stably support the backrest and seat without configuring the support frames to have an excessively strong structure.

According to Patent Document 1, when the seat is rotated to the raised posture, the gas cylinder is extended to the maximum height. However, the locked state of the gas cylinder is released by pushing a lever with a cam. Therefore, the seat is raised at the end of the raising and rotation of the seat. Also, the resistance against the raising and rotation of the seat is generated by pushing a lock release nozzle of the gas cylinder with the lever. Therefore, the user who is rotating the seat may be mistaken that the seat has been completely rotated and thus stop the rotating operation in front of the original raised posture.

In contrast, according to the sixth invention, when the seat is raised, the locked state of the gas cylinder is released by the spring force. Therefore, the lock release of the gas cylinder does not act as the resistance against the raising of the seat. For this reason, it is possible to implement the secure raising operation of the seat without causing the user to be misunderstood.

The present invention can also be applied to a chair having a fixed support device, like the seventh invention. For this reason, it is possible to provide a pleasant sitting comfort for a chair having a simple structure, such as a so-called pipe chair.

Like the eighth invention, when the seat is enabled to move in conjunction with the rearward tilting of the backrest, the body is securely moved in conformity to the leaning on the backrest. Therefore, it is possible to improve the comfort during the rocking. In particular, when the seat is enabled to move forwards by the rearward tilting of the backrest, like the ninth invention, the body can be conveniently stretched during the rocking. Therefore, it is possible to secure the relaxation.

On the other hand, also in the tenth invention, the seat is enabled to retreat or move forwards in conjunction with the rearward tilting of the backrest. In this invention, since the seat is simply slid with being put on the fixed base, it is possible to simplify the structure.

In the eleventh invention, the seat is not moved in conjunction with the rearward tilting of the backrest but is moved forwards by the pushing operation of the sitting person. In this invention, the interlocking means is not required, so that it is possible to simplify the structure, thereby saving the cost.

In the twelfth invention, since the seat is moved forwards by the pushing operation of the sitting person's body, the body can be stretched to improve the sitting comfort. Also, since a rocking function may not be provided, it is possible to simplify the structure, thereby saving the cost.

BRIEF DESCRIPTION OF THE DRAWINGS

FIG. 3A is a perspective view at a raised state of a seat, and FIG. 3B is a front view of a support device.

FIGS. 11A to 11C are schematic views illustrating a second illustrative embodiment, in which FIG. 11A is a side view at a neutral state, FIG. 11B is a side view at a rocking state and FIG. 11C is a side view at a raised state of the seat.

FIG. 12A to 12C are schematic views illustrating a third illustrative embodiment, in which FIG. 12A is a side view at a neutral state, FIG. 12B is a side view at a rocking state and FIG. 12C is a side view at a raised state of the seat.

FIGS. 13A to 13C are schematic views illustrating a fourth illustrative embodiment, in which FIG. 13A is a side view at a neutral state, FIG. 13B is a side view at a rocking state and FIG. 13C is a side view at a raised state of the seat.

FIGS. 15A and 15B are schematic views illustrating a seventh illustrative embodiment, in which FIG. 15A is a side view and FIG. 15B is a partial front view.

FIGS. 19A to 19C are perspective views of a chair according to a twelfth illustrative embodiment, in which FIG. 19A is an overall perspective view at an unfolded state of the seat, FIG. 19B is an overall perspective view at a raised state of the seat, and FIG. 19C is a partial exploded perspective view of a backrest.

FIG. 23A is a partial exploded perspective view of a seat part, FIG. 23B illustrates a relation between a slider and a support stay, and FIG. 23C is a sectional view taken along a line C-C of FIG. 23B.

FIG. 25A is an exploded perspective view illustrating a relation among a movable base, the slider and a spring unit, FIG. 25B is an exploded perspective view of a rear spring bearing and the movable base, and FIG. 25C is a perspective view of the rear spring bearing.

FIG. 34A is a longitudinal side view of main parts, and FIG. 34B is a perspective view of a fixed base, as seen from above.

FIG. 35A is a perspective view illustrating an inside of the fixed base, and FIG. 35B is a partial side view illustrating a lock-released state.

FIG. 37A is a front view of a support device, and FIG. 37B is a plan view of the support device at a nesting state.

Figures 1A, 1B:
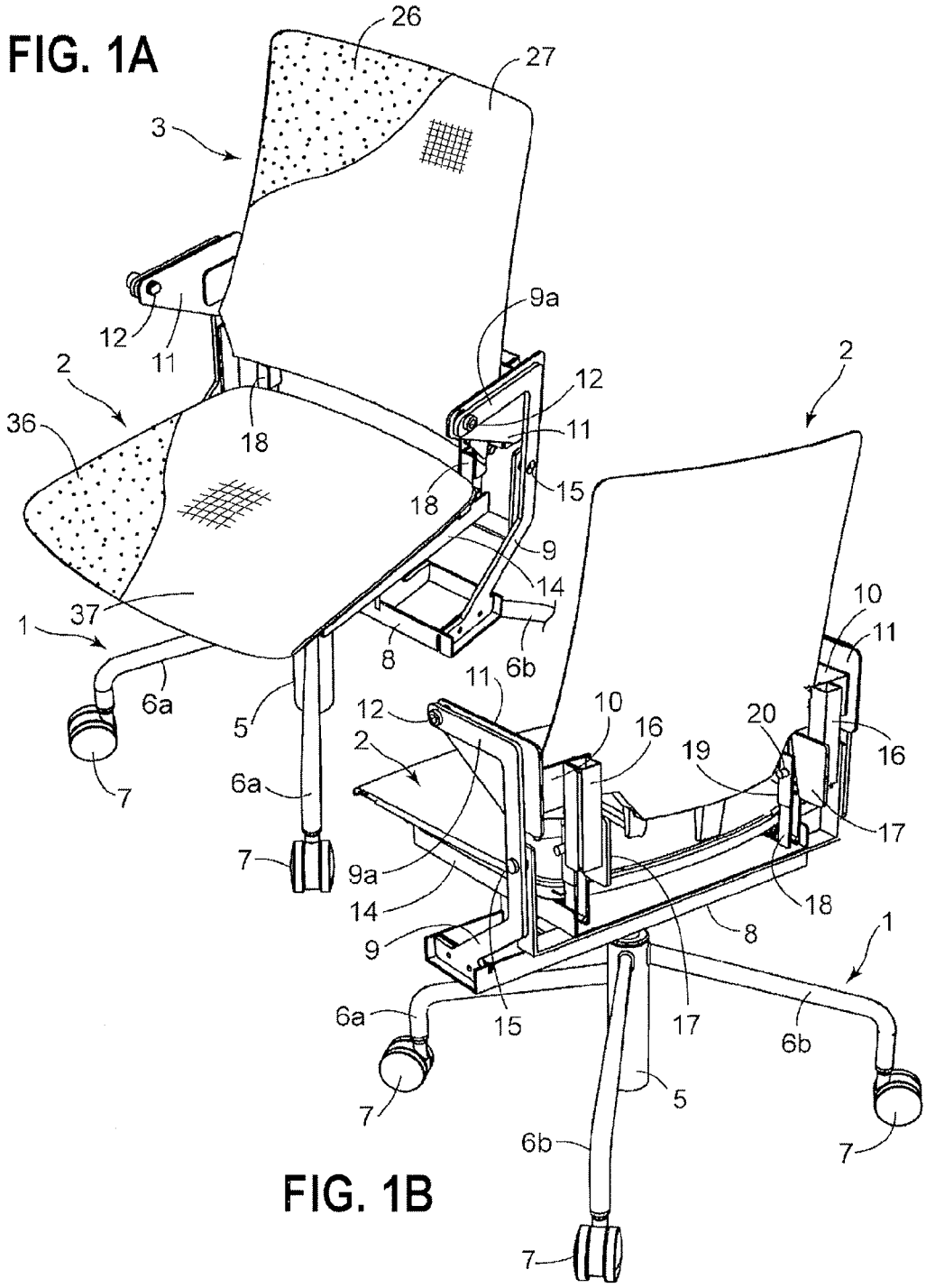
FIGS. 1A and 1B are perspective views of a chair according to a first illustrative embodiment.

DETAILED DESCRIPTION OF ILLUSTRATIVE EMBODIMENTS (1) Outline of First Illustrative Embodiment Hereinafter, illustrative embodiments of the present invention will be described with reference to the drawings. First, an outline of a first illustrative embodiment is described with reference to FIGS. 1 to 5. In below descriptions, the terminologies 'front and rear' and 'left and right' are used to specify the directions, and are based on a state as seen from a person typically sitting on a chair.

The chair has, as main elements, a support device 1, a seat 2 and a backrest 3. The support device 1 has a leg column 4 composed of a gas cylinder, a central cylinder 5 configured to surround the leg column 4 and branched legs 6*a*, 6*b* provided two by two at front and rear parts and fixed to the central cylinder 5 by a welding and the like. Casters 7 are attached to tips of the respective branched legs 6*a*, 6*b*.

The branched legs 6*a*, 6*b* extend radially from the central cylinder 5 and are inclined downwardly from the central cylinder 5, and the tips thereof are upright bent. As can be clearly shown in FIG. 3B, a height of the two front branched legs 6*a* is set to be lower than a height of the two rear branched legs 6*b* and an extended angle of the two front branched legs 6*a* is set to be less than an extended angle of the two rear branched legs 6*b*, so that the support devices 1 arranged at the front and the rear are permitted to be fitted with each other.

A fixed base 8 having a box shape, which is a part of an intermediate support member, is oblong in the left-right direction and opens upwardly, is attached to an upper end of the leg column 4. Support frames 9, which configure the intermediate support member like the fixed base 8 and protrude upwardly beyond the seat 2, are fixed to both left and right end portions of the fixed base 8. Therefore, in this illustrative embodiment, the intermediate support member is configured by the fixed base 8 and the support frames 9.

In the meantime, the gas cylinder configuring the leg column 4 is composed of inner and outer cylinders slidably fitted. Since both cylinders are fitted to be relatively rotatable, the fixed base 8 is also rotatably supported by the support device 1. Therefore, when the chair is in use, relative postures of the fixed base 8 and the support device 1, as seen from above, are not constant. However, it is necessary to keep the relative postures constant upon the nesting. The postures are kept by a posture keeping means mounted to the gas cylinder. When the gas cylinder is extended to a maximum length, assumed postures of the inner and outer cylinders are kept constant by a guide means of a cam type, for example. This is also the same for other swivel chairs of a thirteenth illustrative embodiment and the like.

Figure 5:
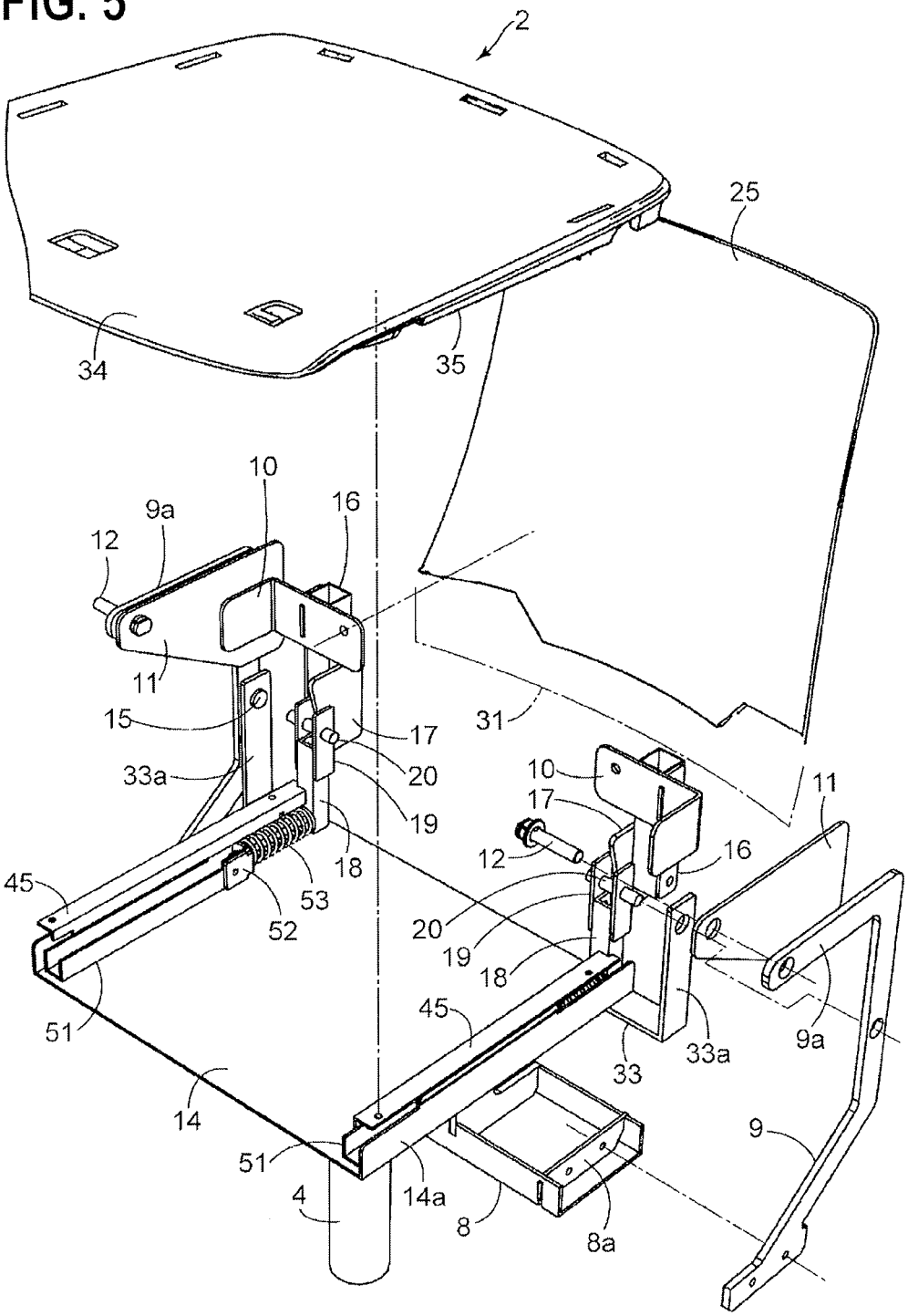
FIG. 5 is an overall exploded perspective view of the chair.

As shown in FIG. 5, first brackets 10 having an L shape, as seen from above, are fixed to both left and right side parts of a lower part of the backrest 3, second brackets 11 having a substantial triangular shape, as seen from a side, are fixed to outer surfaces of the first brackets 10, and front ends of the second brackets 11 are coupled to upper ends of the support frames 9 by first spindles 12. Therefore, the backrest 3 can be tilted rearwards about the first spindles 12.

As shown in FIG. 3, a movable base 14 is coupled to rear portions of the left and right support frames 9 lower than the first spindles 12 by second spindles 15 so that it can be raised and rotated, and the seat 2 is mounted to the movable base 14 to be movable back and forth.

Figures 2A, 2B:
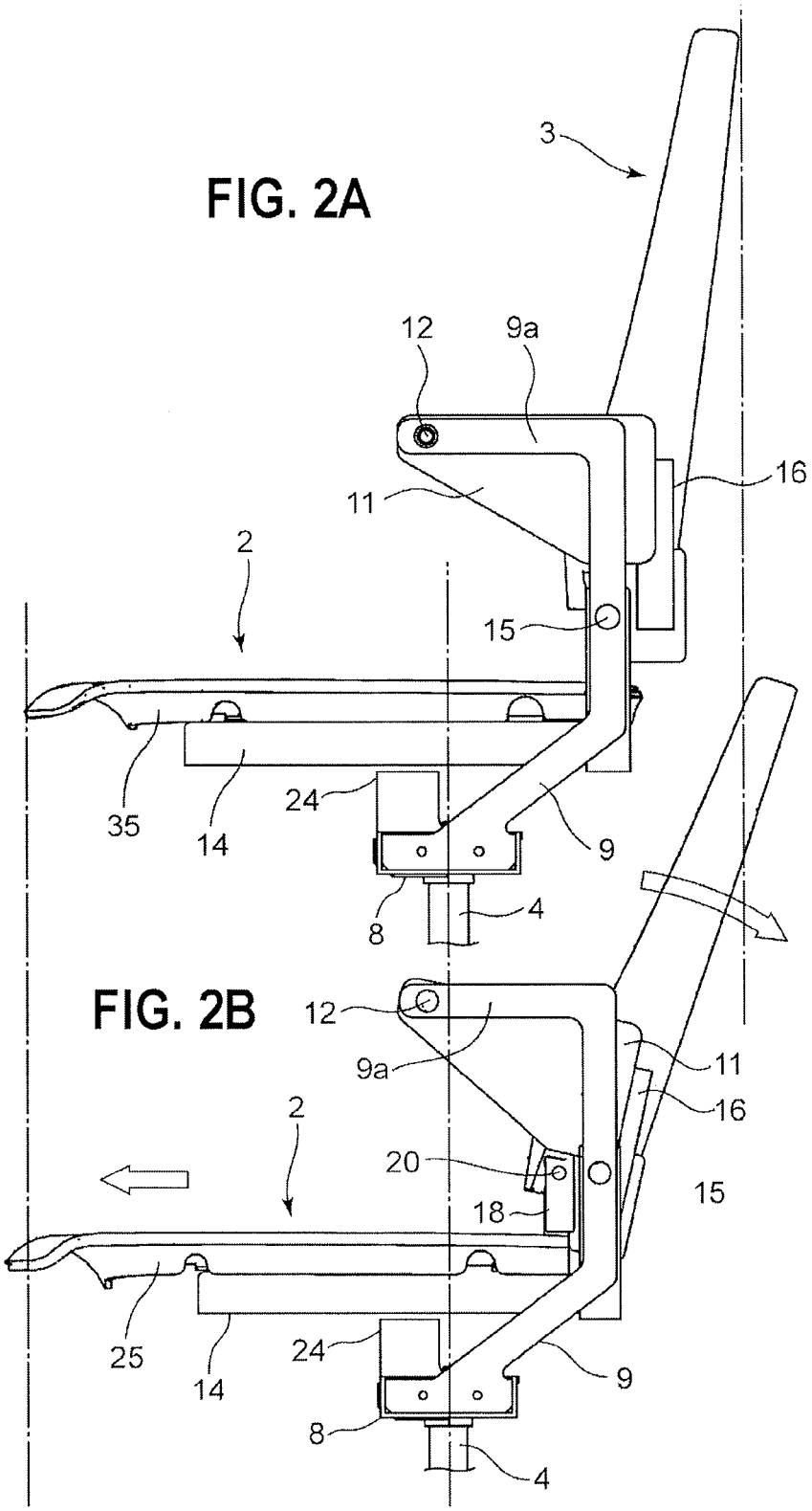
FIG. 2A is a side view at a neutral state.
FIG. 2B is a side view at a rocking state.

For example, as can be understood from FIG. 1A, vertically long main driving arms 16 are fixed to rear surfaces of the first brackets, pushing plates 17 are fixed to lower ends of the main driving arms 16, upward-facing driven arms 18 are respectively fixed to rear portions of the seat 2 positioned in front of the main driving arms 16, left and right auxiliary plates 19 are fixed to upper ends of the driven arms 18 and the pushing plates 17 are set to collide with driven pins 20 inserted into the left and right auxiliary plates 19 from the rear. Therefore, as shown in FIG. 2, when the backrest 3 is tilted rearwards, the pushing plates 17 are moved forwards, so that the seat 2 is correspondingly moved forwards. Although described in detail later, the seat 2 is urged in a retreat direction by a spring provided for the movable base 14, and the spring serves as a resistance against the rocking.

Figure 4:
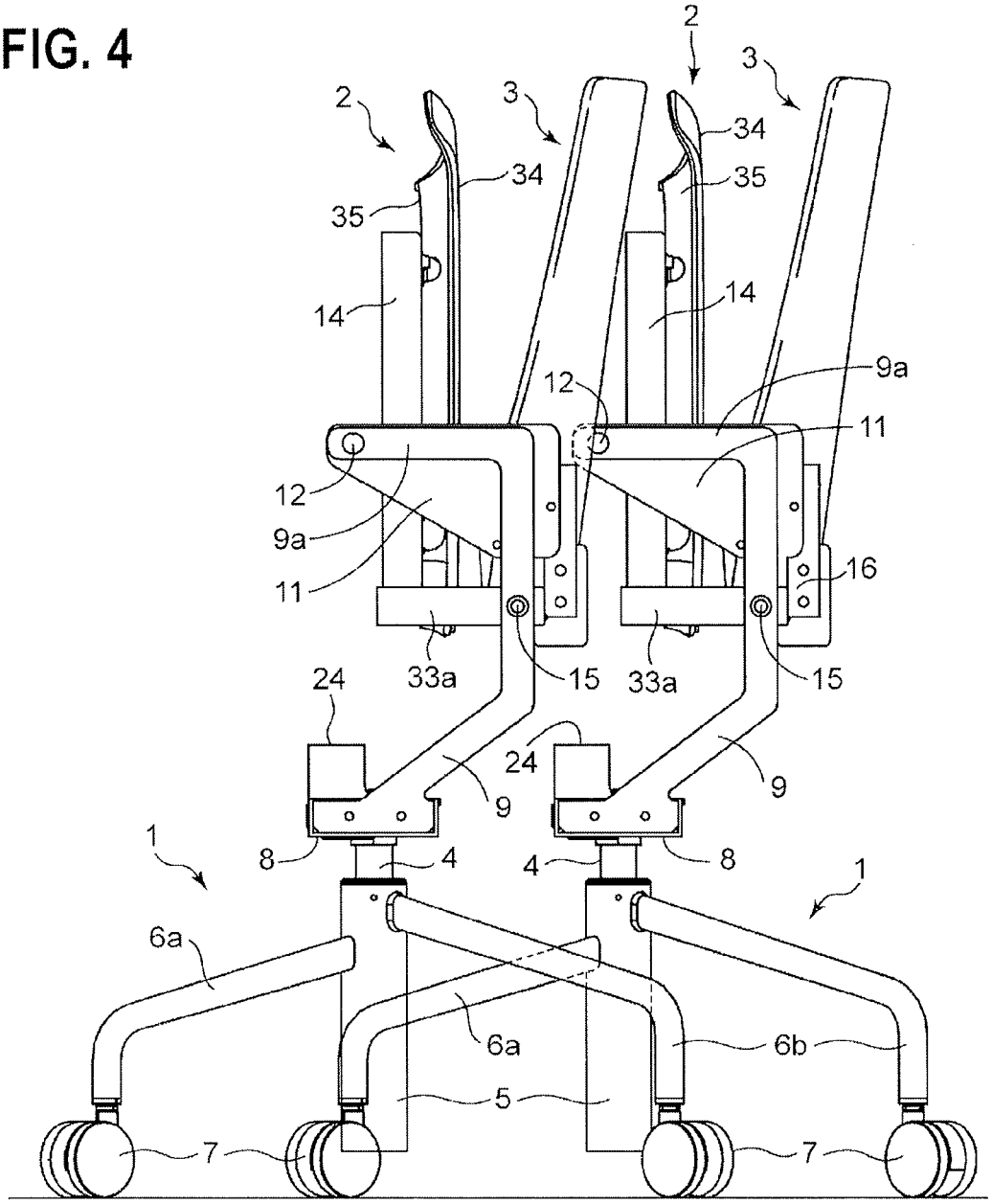
FIG. 4 is a side view at a nesting state.

As can be seen from the above descriptions, according to this illustrative embodiment, when the chair is in use, the seat is moved forwards in conjunction with the rearward tilting of the backrest 3. When the chair is not in use, as shown in FIG. 3A or 4, the seat 2 is raised and rotated to nest the chairs with the support devices 1 being fitted with each other in the front-rear direction. In this illustrative embodiment, the main driving arms 16, the pushing plates 17, the driven arms 18, the auxiliary plates 19 and the driven pins 20 configure an interlocking means.

(2) Fixed Base/Backrest and Attachment Structure Thereof

Subsequently, the respective parts are described in detail with reference to the above drawings and FIG. 6 and thereafter. First, the structure of the fixed base 8, the backrest 3 and an attachment structure thereof are described. For example, as shown in FIG. 3, the fixed base 8 has an upwardly opening box shape, a center bracket 23 is fixed to an intermediate part thereof in the left-right direction, and an upper end of the leg column 4 is fitted from below into a bush (not shown) fixed to a bottom plate and the center bracket 23 by a welding.

A support bracket 24 configured to cover the center bracket 24 and oblong in the left-right direction is fixed to the fixed base 8, and the movable base 14 is stably supported by the support bracket 24. Therefore, in this illustrative embodiment, the support bracket 24 serves as a support part. A space is opened between the center bracket 23 and the support bracket 24, and a gas cylinder operation member is disposed in the space. The gas cylinder operation member is configured to be operated by a wire inserted into a tube. Although not shown, the seat is provided with a lifting lever for pulling the wire.

Left and right side plates 8*a* configuring the fixed base 8 are positioned with deviating inwardly from left and right end faces of the fixed base, and the support frames 9 are fixed to the left and right side plates 8*a* by screws or welding. The support frames 9 are formed to tilt rearwards from the fixed base 8 and then to stand upright and are provided at upper ends thereof with forward-facing protrusions 9*a*. The second brackets 11 fixed to the backrest 3 are coupled to front end portions of the forward-facing protrusions 9*a*. Also, the movable base 14 is coupled to the upright parts of the support frames 9.

In this illustrative embodiment, the fixed base 8 has a left-to-right length slightly longer than a left-to-right width of the seat 2. However, the support frames 9 may be provided with inward-facing parts having a left-to-right width corresponding to about ¼ of the left-to-right lateral width of the seat 2 and configured to be attached to the fixed base 8 below the seat 2. Also, the fixed base 8 may be configured by an aluminum die casting or resin molding and components equivalent to the support frames 9 may be formed integrally with the fixed base 8.

Figures 6A, 6B:
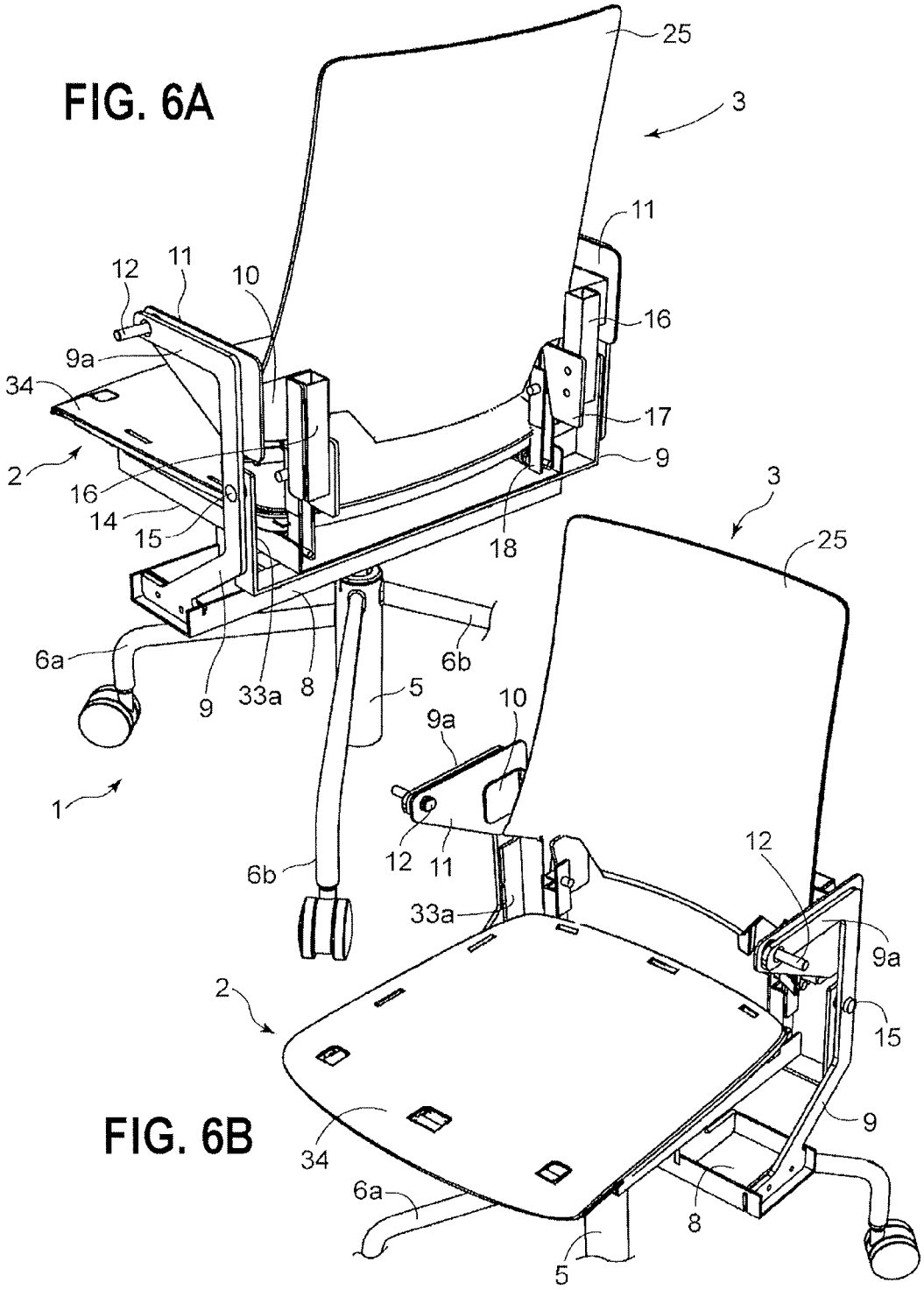
FIGS. 6A and 6B are overall perspective views at a state where a cushion is omitted.
Figure 7:
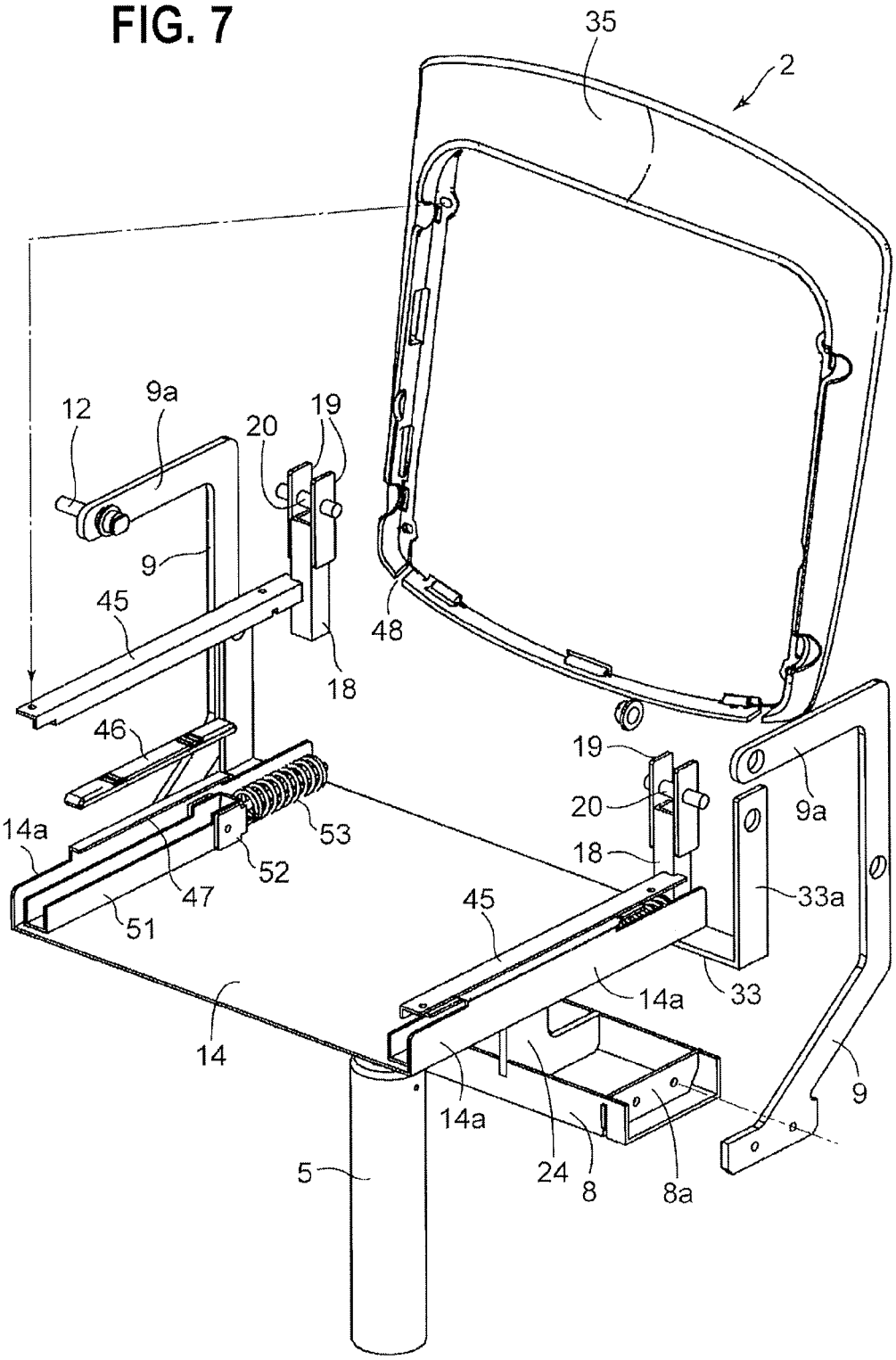
FIG. 7 is a partial exploded perspective view illustrating a seat support mechanism.

As shown in FIGS. 5 and 6, the backrest 3 has a back plate (an inner shell) 25 made of resin and a cushion 26 (refer to FIG. 1A) is put on front and rear surfaces of the back plate 21, which is then covered by a surface material 27 (refer to FIG. 1A) such as cloth. Although it is not necessary to particularly mention, the cushion 26 may be disposed on only the front surface of the back plate 25.

For example, as shown in FIG. 5, the back plate 25 is arranged to overlap with front surfaces of inward-facing pieces of the first brackets 10 and the back plate 25 is fixed to the first brackets 11 by screws (not shown).

Also, components equivalent to the first brackets 10 and the second brackets 11 may be formed integrally with the back plate 25. The main driving arm 16 is fixed to a rear surface of the first bracket 11 by a screw or welding. However, components equivalent to the main driving arm 16 and the pushing plate 16 may be formed integrally with the back plate 25.

(3) Seat and Attachment Structure Thereof

Subsequently, the seat 2 and the attachment structure thereof are described in detail. As shown in FIG. 5, the movable base 14 is provided with left and right side plates 14*a* and has an upwardly opening channel shape. A third bracket 33 having left and right upright parts 33*a* is fixed to a rear-lower surface of the movable base by a screw or welding, and the upright parts 33*a* are rotatably coupled to vertically intermediate parts of the support frames 9 by the second spindles 15 oblong in the left-right direction. In the meantime, the movable base 14 may be a resin or aluminum-molded component and the upright parts 33*a* may be formed integrally with the movable base 14.

Figure 8A:
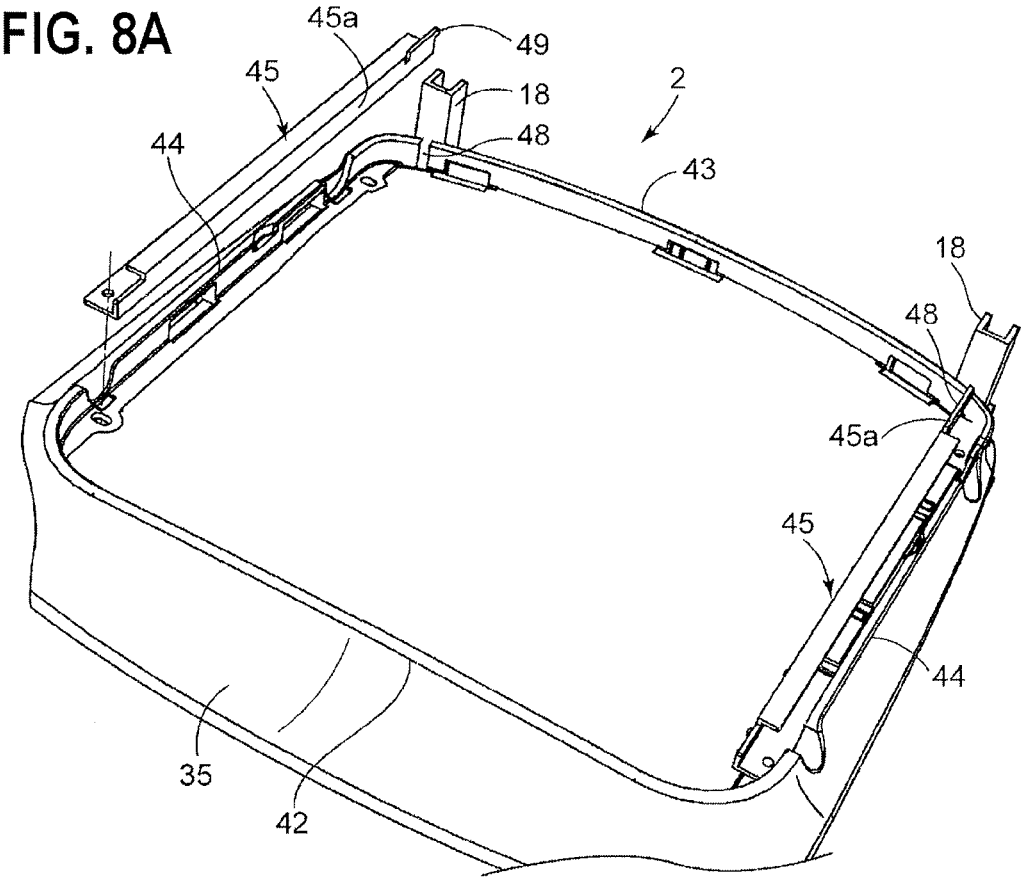
FIG. 8A is a perspective view at an overturned state of the seat.
Figure 8B:
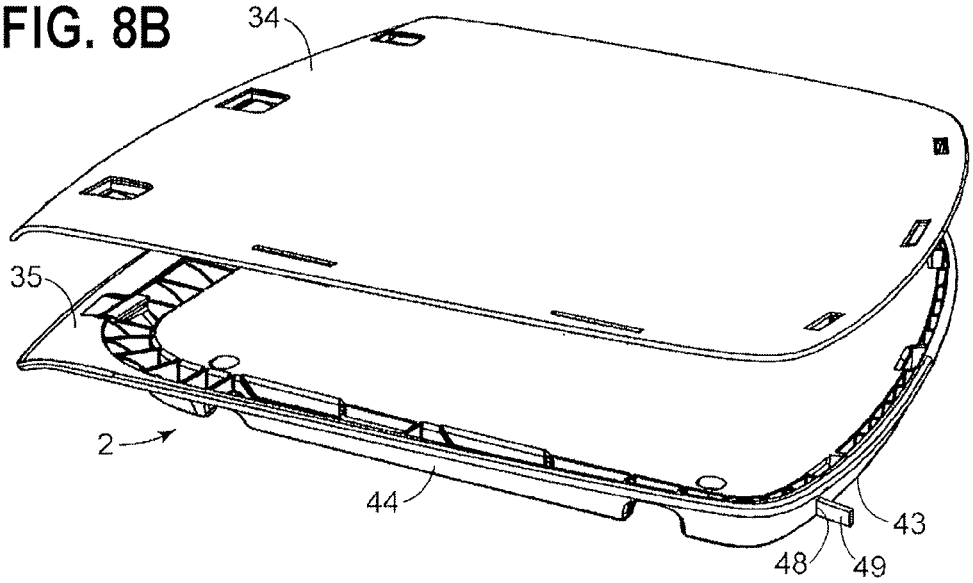
FIG. 8B is an exploded perspective view of the seat.

As shown in FIG. 8B, the seat 2 has an upper seat plate 34 and a lower seat plate 35 made of resin and having periphery edges arranged to overlap, and a cushion 36 (refer to FIG. 1A) is stretched thereon, which is then covered by a surface material 37 such as cloth. The upper seat plate 34 and the lower seat plate 35 are held so that they cannot be separated from each other.

As shown in FIG. 8A, movable rails 45 long in the front-rear direction are disposed at inner sides of side walls 40 on a lower surface of the lower seat plate 34 (35). The movable rails 45 are fixed at a plurality of places such as front and rear end portions thereof to the lower seat plate 35 by screws (not shown).

Figure 10A:
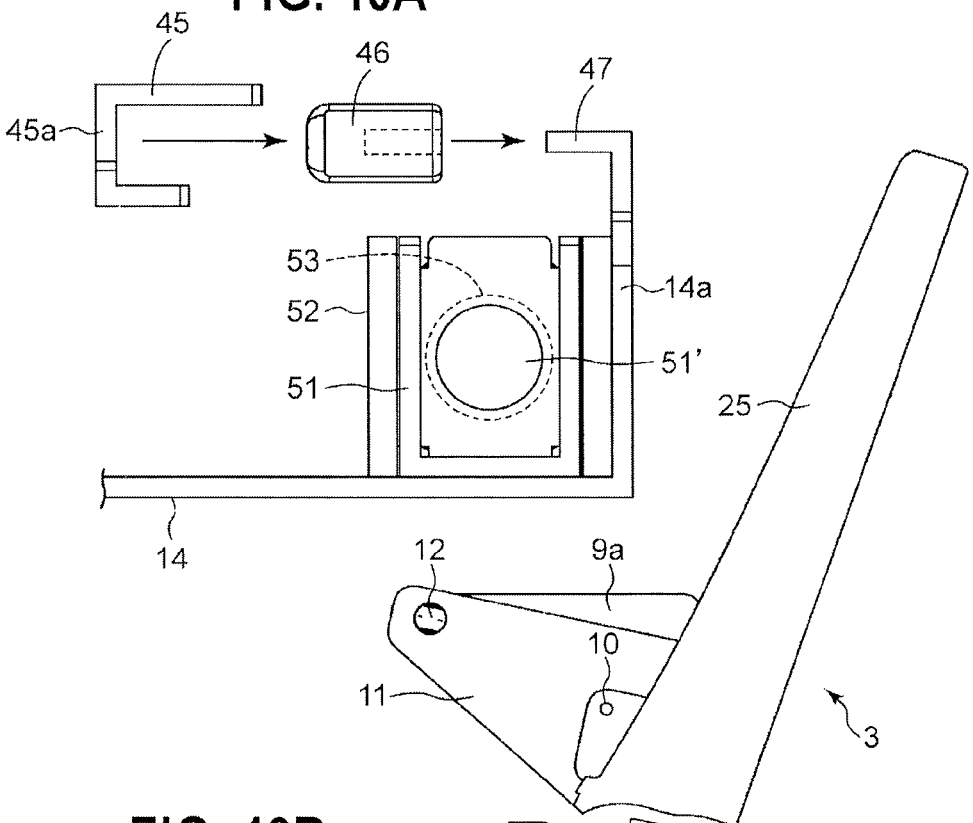
FIG. 10A is a partial exploded front view illustrating a seat guide mechanism.

As shown in FIG. 10A, the movable rail 145 (45) has an outwardly opening channel shape, as seen from the front, and a slider 46 made of resin is disposed therein. The slider 46 opens outwardly in the left-right direction, as seen from the front. As shown in FIG. 10A, the left or right side plate 14*a* of the movable base 14 is provided at an upper end thereof with an inward-facing collar part 47, and the slider 46 is fitted with the collar part 47.

As shown in FIG. 8, a rear end portion of a substantially upright substrate 45*a* configuring the movable rail 45 protrudes towards the rear of the lower seat plate 35. For this reason, a rear wall 43 of the lower seat plate 35 is formed with a notch 48 to which the rear end portion of the substrate 45*a* is fitted. As shown in FIGS. 5 and 9B, the square-section cylindrical driven arm 18 is fixed to a rear end of the movable rail 45 by the welding. In order to precisely position the movable rail and the driven arm each other, the movable rail 45 is provided with a projection 49 and the driven arm 18 is formed with an engaging hole 50, so that both are fitted.

In the meantime, the driven arm 18 and the auxiliary plate 19 may be formed integrally with the movable rail 45. The driven pin 20 or a component having the same function may be formed integrally with the driven arm 18. Also, an element having the same function as the movable rail 45 may be formed integrally with the lower seat plate 35 and the driven arm 18 may be fixed to the lower seat plate 35 by a screw.

Figure 9A:
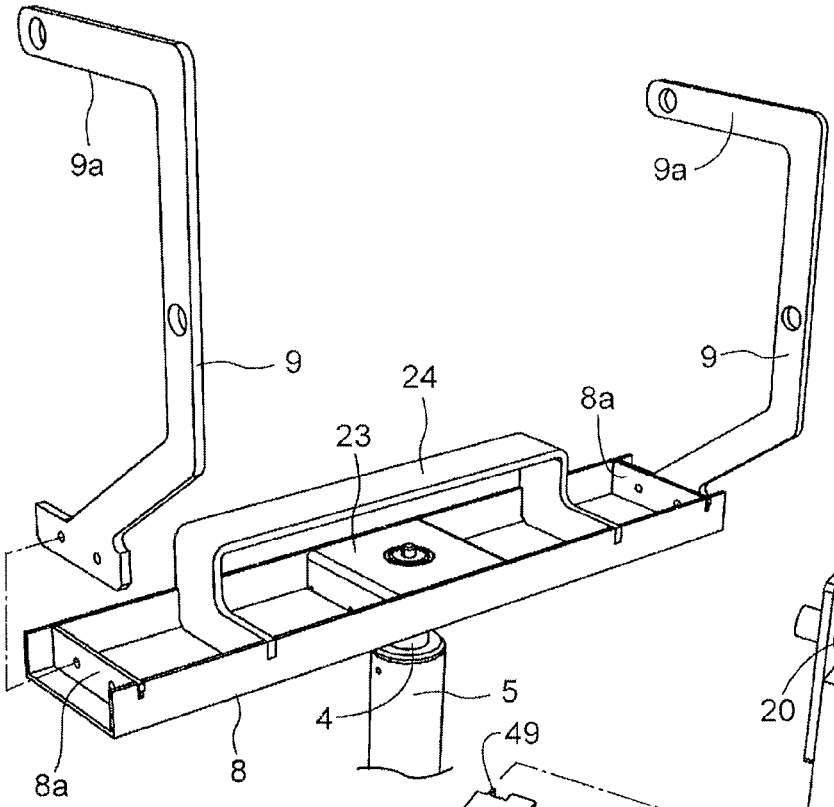
FIGS. 9A and 9B are perspective views.
Figure 9B:
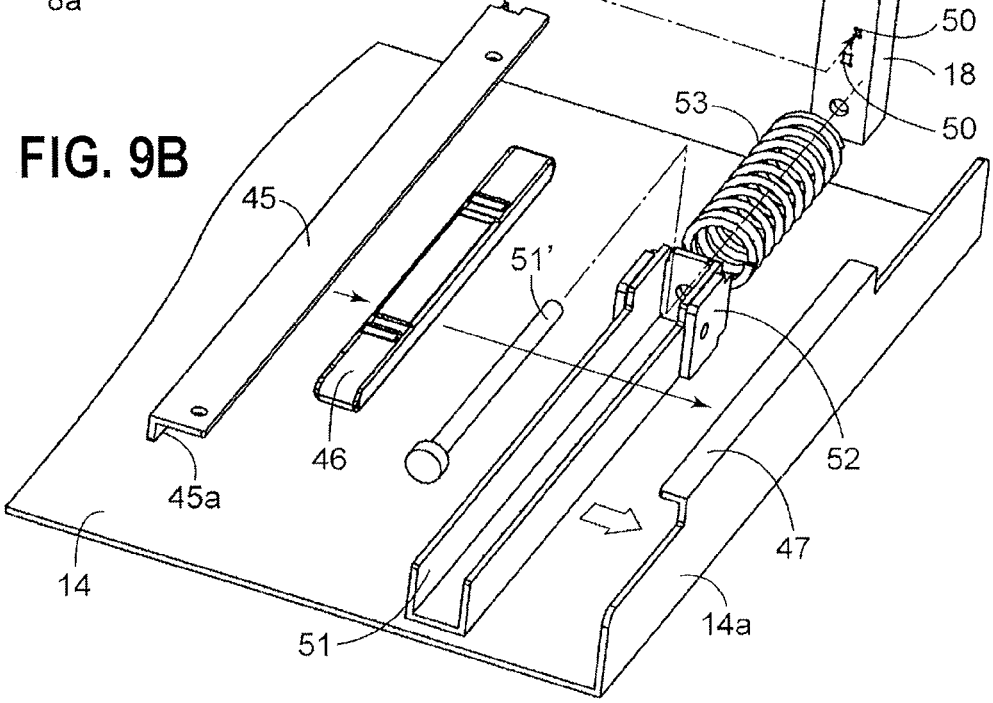

As shown in FIG. 9, a spring support member 51, which has an upwardly opening channel shape long in the front-rear direction, is fixed to a part on the upper surface of the movable base 14 adjacent to the left or right side plate 14*a* of the movable base 14 by a screw or welding, a U-shaped spring bearing 52, which opens forwards as seen from the front, is fixed to a rear end portion of the spring support member 51, and a compression coil spring 53, which is an example of a spring means, is interposed between a front surface of the spring bearing 52 and the driven arm 18.

Figure 10B:
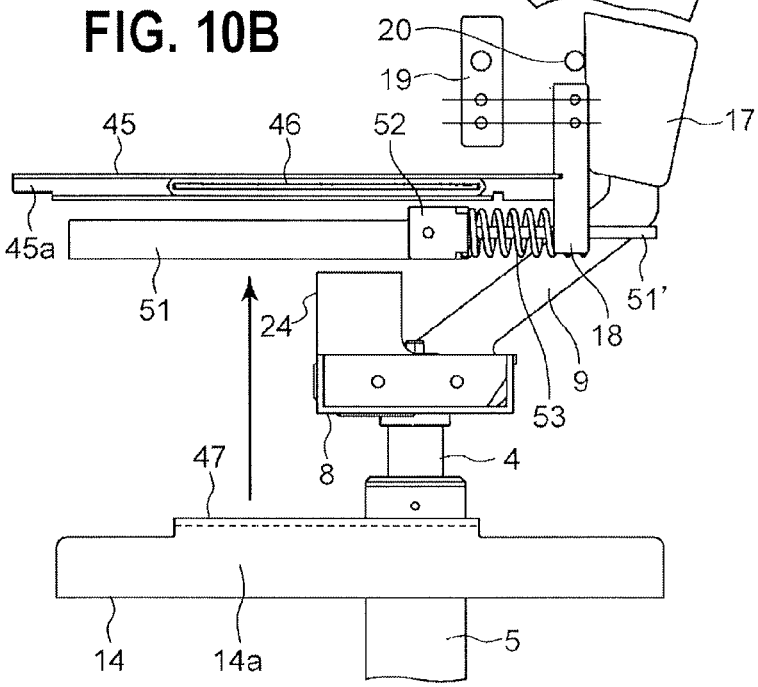
FIG. 10B is a partially cutaway/exploded side view at a rocking state.

Therefore, as shown in FIG. 10B, when the backrest 3 is tilted rearwards, the driven arms 18 are pushed through the driven pins 20, so that the seat 2 is moved forwards against the elasticity of the compression coil springs 53. A rod 51' is inserted into the spring bearing 52 from the front and a tip portion of the rod 51' is inserted and fixed to the driven arm 18. By the rod 51', the retreat position of the seat 2 is restrained.

In the meantime, an inner plate of the spring support member 51 may be configured so that a side wall 44 of the lower seat plate 35 is put thereon. Also, as previously described, the movable base 14 may be formed by the aluminum or resin molding. However, in this case, it is preferable to integrally form an element equivalent to the spring support member 51 with the movable base 14. A front or rear position of the spring support member 51 may be adjusted by operating a lever or handle.

(4) Summary

As described above, when a user sitting on the chair leans on the backrest 3, the seat 2 is moved forwards, so that a body of the user of the chair tends to stretch at a rocking state. For this reason, it is possible to provide the chair that can be nested by raising the seat 2 and has the high relax effect and the excellent sitting comfort.

In many cases, the nestable chairs are used in a conference hall, a workshop hall and the like. In the hall, the chairs are arranged to narrow the front-rear intervals as much as possible. Like this illustrative embodiment, when the rotating point of the backrest 3 is located at a position higher than the seat surface and in front of the rear end of the seat 2, it is possible to secure the large rocking angle while suppressing the rearward moving amount of the upper end of the backrest 3. Therefore, even when the chairs are arranged to narrow the front-rear intervals, it is possible to prevent a rear person from feeling uncomfortable during the rocking. This is a merit of this illustrative embodiment.

That is, when the rotating point of the backrest 3 is located at a position (preferably, a position higher than a waist of the sitting person) higher than the seat surface, the lower end of the backrest 3 is moved forwards by the rearward tilting. Therefore, as compared to a configuration where the backrest is tilted rearwards while retreating as a whole, a retreating amount of the upper end of the backrest 3 is reduced even though the rearward tilting angle is the same. For this reason, it is possible to prevent a head or shoulders of the person from highly retreating rearwards (bending rearwards) during the rocking. Thereby, while it is possible to secure a pleasant and comfortable state without making a rear person unpleasant, it is possible to narrow the front-rear intervals of the chairs as much as possible, thereby effectively using the space.

Also, if the rotating point of the backrest 3 is lower than the seat surface, a load of the upper half body of the sitting person is applied to the backrest 3 upon the rocking, as the moment. Therefore, in order to provide an appropriate resistance against the rocking, it is necessary to adjust the solidity of the spring, in accordance with the weight of the user. However, when the rotating point of the backrest is set to be higher than the seat surface, like this illustrative embodiment, a pressing force of the entire upper half body of the user is not applied to the backrest as the moment and the backrest is simply rotated by a pressing force of only an upper part of the upper half body with the upper half body of the user being supported in the vicinity of the rotating point. For this reason, even when the weights of the users are different, the force of tilting rearwards the backrest is little different. Therefore, even though a hardness adjusting means of the compression coil spring 53 for rocking is not provided, it is possible to provide the substantially same rocking resistance for the users having the different weights (i.e., this is a state where the resistance of the compression coil spring 53 is automatically responded in accordance with the weight of the user).

Also, when the seat is coupled to the support frames at the position higher than the seat surface, like this illustrative embodiment, it is possible to match the raising height position of the seat in conformity to the height of the backrest even though the backrest is a backrest of a high back specification, which contributes to the improvement on a sense of beauty at the nesting state.

When the tilting point of the backrest is set to be higher than the seat surface, the lower end portion of the backrest 3 tends to move forwards during the rocking, so that the waist (or hips) of the sitting person may be pushed from the rear. However, when the interlocking means is provided, like this illustrative embodiment, the lower half body of the user is moved forwards during the rocking, so that it is possible to keep the appropriate relax state. Thereby, it is possible to provide the nestable rocking chair of which sitting comfort is improved.

Also, according to this illustrative embodiment, it is possible to implement the forward moving of the seat 2 while securing the nesting function, in addition to the movable base 14, which is also one of the merits. Further, when the upright parts 33*a* protruding upwardly from the rear end of the movable base 14 are coupled to the support frames 9, the seat 2 can be raised and rotated to the rearward tilting posture while the rear end is positioned at the inner side as much as possible at the unfolded state. Therefore, it is possible to secure the stability of the seat 2 at the raised state while securing the high support stability of the body by the seat 2. This is also one of the merits accomplished by the illustrative embodiment.

Although not shown, the forward-facing protrusion 9*a* of the support frame 9 may be provided with an armrest. Also, as previously described, it is preferable to provide a posture correction device configured to change a relative posture between the fixed base 8 and the support device 1 to a nestable state when the seat 2 is raised and a height adjusting device configured to release a locked state of the leg column 4 and to uplift the fixed base 8 to the highest position.

(5) Second to Eleventh Illustrative Embodiments

Figures 11A, 11B, 11C:
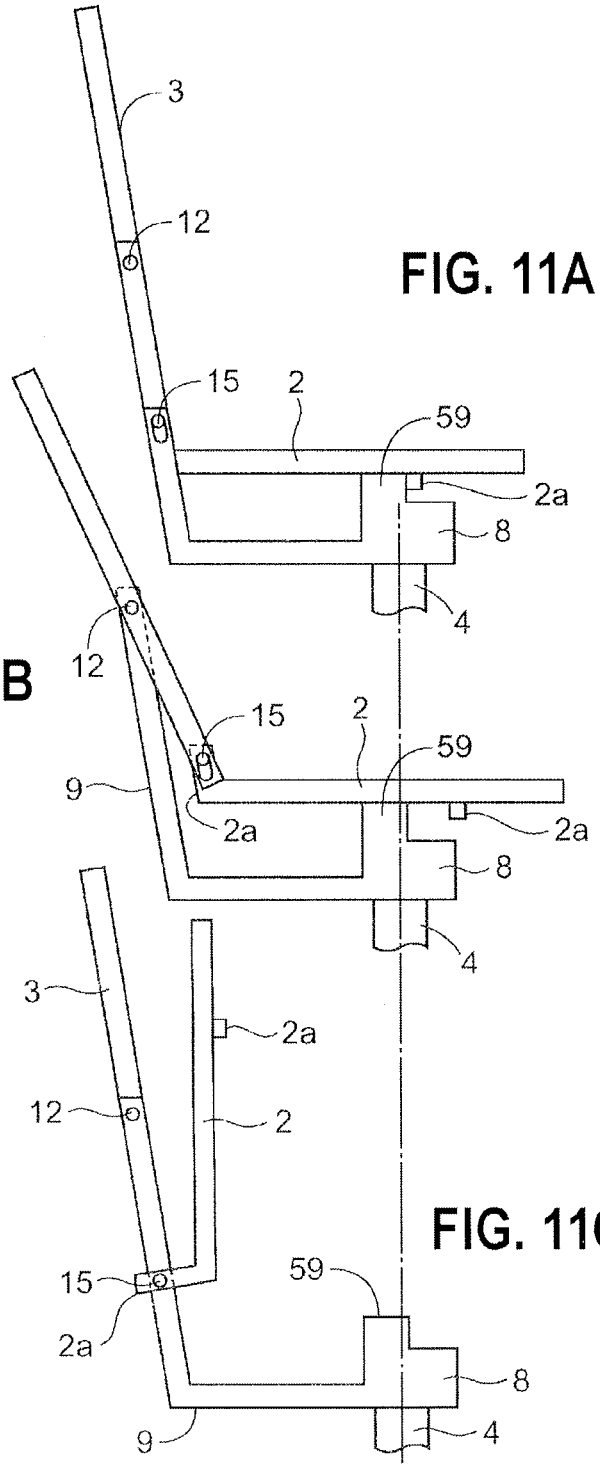

In the below, the other illustrative embodiments are described. First, a second illustrative embodiment shown in FIG. 11 is described. In the second illustrative embodiment, a vertically central part of the backrest 3 is coupled to the upper end portions of the support frames 9 by the first spindles 12, and the lower end portion of the backrest 3 and upright parts 2*a* provided at the rear end of the seat 2 are coupled by the second spindles 15. The unfolded seat 2 is put on an upward-facing support part 59 provided for the fixed base 8 so that it can be slid back and forth.

Figures 12A, 12B, 12C:
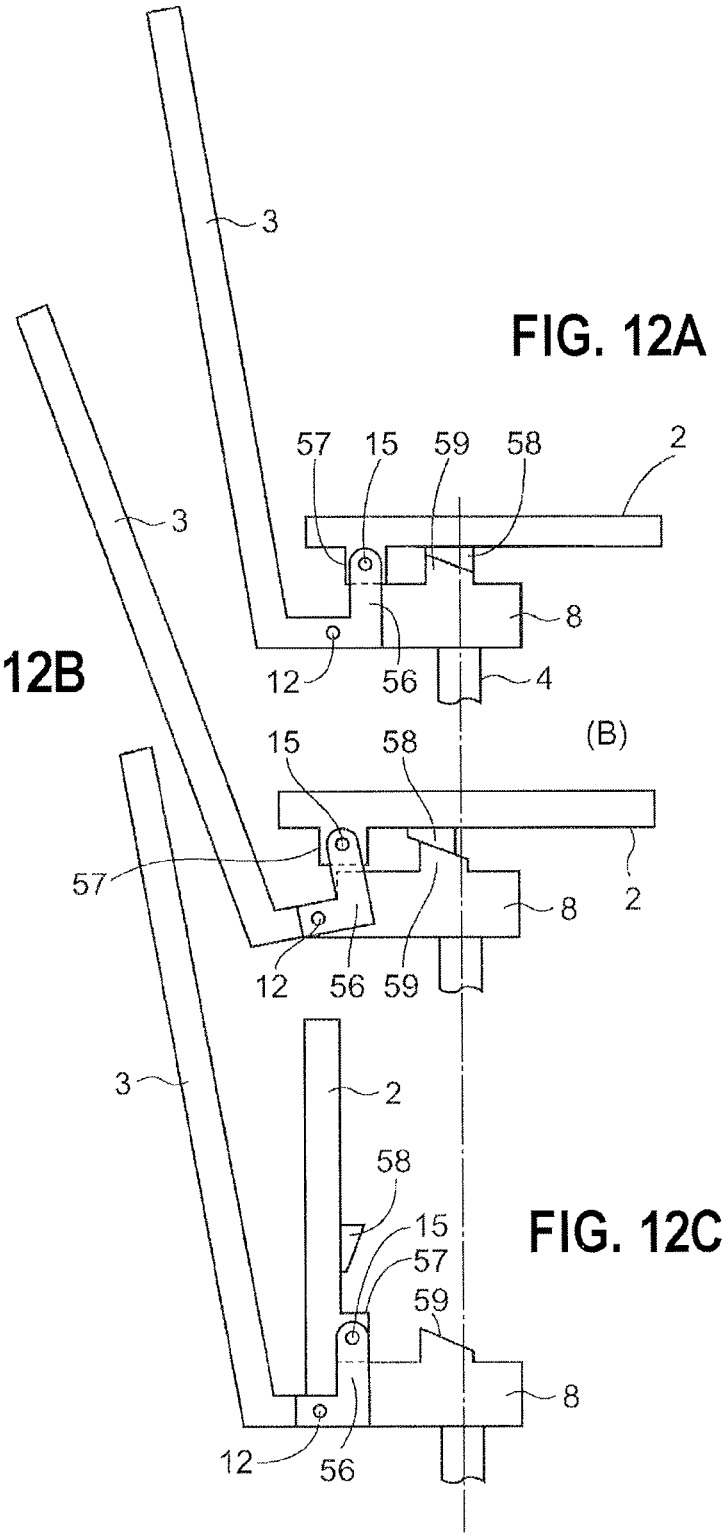
Figure 16:
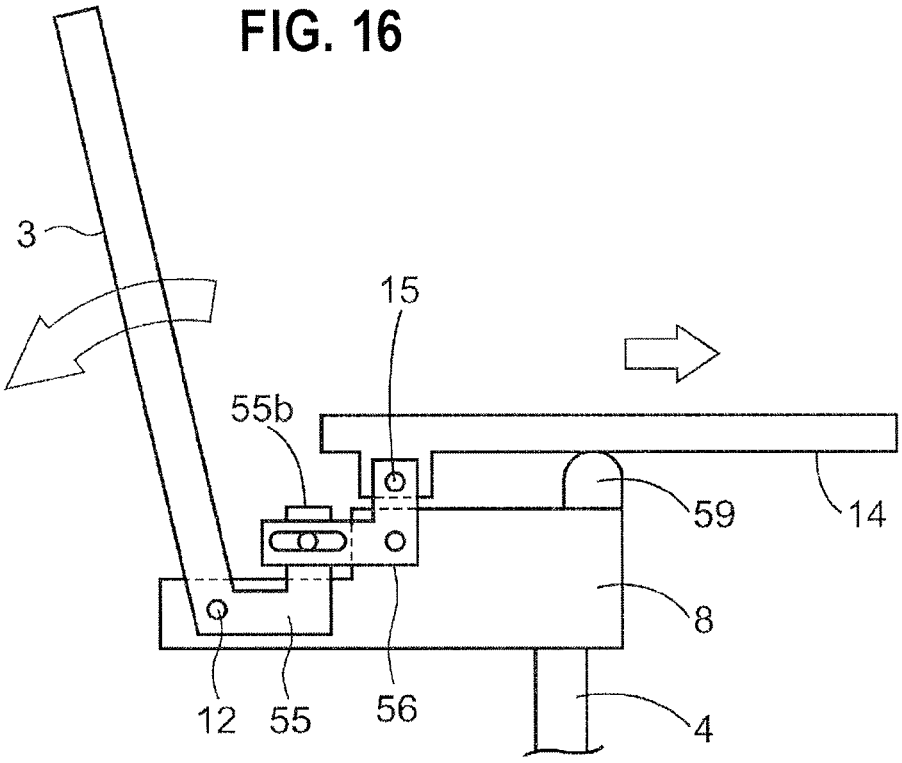
FIG. 16 is a schematic side view of an eighth illustrative embodiment.

Also in this illustrative embodiment, as the backrest 3 is tilted rearwards, the lower end thereof is moved forwards. Therefore, the seat 2 is moved forwards during the rocking. This illustrative embodiment and FIGS. 11, 12 and 16 show a specific example of the tenth invention. Although not shown, the chair has a spring means configured to return the seat 2 and the backrest 3 to the reference state. Also, the seat 2 is provided on its lower surface with a stopper 2*a* configured to collide with the support part 59, thereby restraining the return positions of the seat 2 and backrest 3. In the meantime, it may also be possible to support the seat 2 over the entire length of the fixed base 8 in the front-rear direction.

In a third illustrative embodiment shown in FIG. 12, a back frame, which is an example of the support member, is coupled to the rear part of the fixed base 8 by the first spindles 12 so that it can be tilted rearwards, and the backrest 3 is attached to the back frame 55. In this configuration, a front end portion of the back frame 55 is provided with an upward-facing link part 56, an upper end of the link part 56 and a downward-facing protrusion 57 of the seat 2 are coupled by the second spindle 15, and the lower surface of the seat 2 and the upper surface of the fixed base 8 are respectively provided with a supported part 58 and a support part 59 configured to contact each other. The contact surfaces of the supported part 58 and the support part 59 are configured as inclined surfaces (cam surfaces) of which heights increase towards the rear.

The fixed base 8 has the spring means embedded therein and the backrest 3 is tilted rearwards against the spring means. However, since the contact surfaces of the supported part 58 and the support part 59 are configured as the inclined surfaces, the seat 2 retreats with ascending. In this case, the force of raising the seat 2 is proportional to a physique (weight) of the user. Therefore, it is possible to provide the users having different physiques with the same rocking resistance without adjusting the elastic force of the spring means. That is, the magnitude of the resistance against the rocking responds to the weight of the user.

Figures 13A, 13B, 13C:
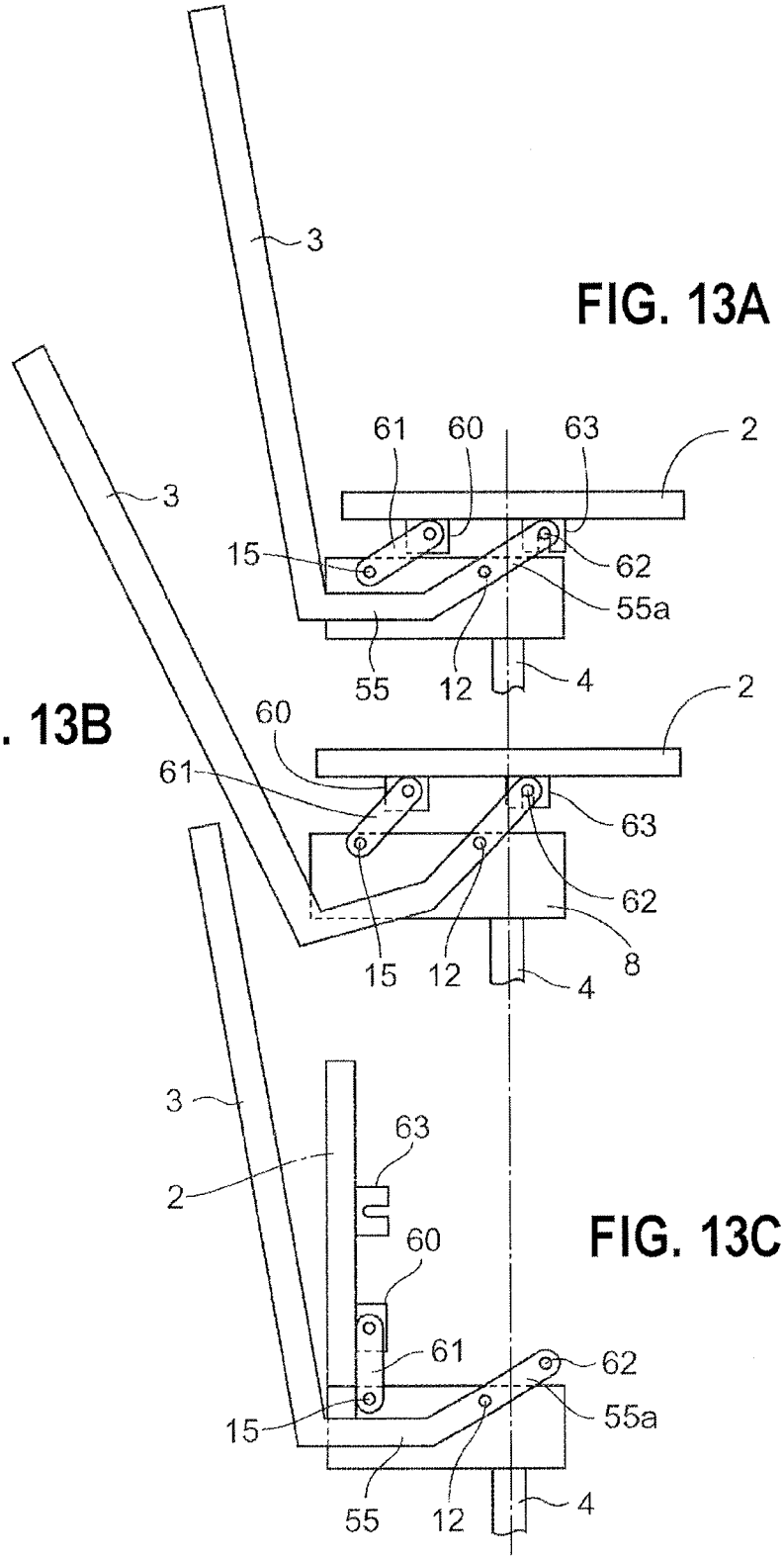

Also in a fourth illustrative embodiment shown in FIG. 13, the resistance against the rocking is enabled to respond to the weight of the user. In this illustrative embodiment, the back frame 55 is integrally coupled to the lower end of the backrest 3 and a front end portion of the back frame 55 is coupled to the fixed base 8 by the first spindle 12. In the meantime, a downward-facing protrusion 60 provided at the rear part of the seat 2 is coupled to the fixed base 8 through a link 61. The back frame 55 is provided with an extension part 55*a* parallel with the front end link 61. A bearing part 63 provided on the lower surface of the seat 2 and having a downward-facing opening, as seen from the side, is fitted from above to a front pin 62 bridged between front ends of the left and right extension parts 55*a*.

The coupling height position of the back frame 55 to the fixed base 8 and the coupling height position of the link 61 to the fixed base 8 are set to be substantially the same. For this reason, the extension part 55*a* of the back frame 55 and the link 61 configure a parallel link mechanism. Therefore, when the backrest 3 is tilted rearwards, the seat 2 retreats with ascending. Since the force of raising the seat 2 is substantially proportional to a physique (weight) of the user, the solidity of the spring means as regards the rocking is kept constant even when the weight of the user is different. In the meantime, the spring means is embedded in the fixed base 8. In this illustrative embodiment, the link 61 and the extension part 55*a* configure the interlocking means.

Figure 14A:
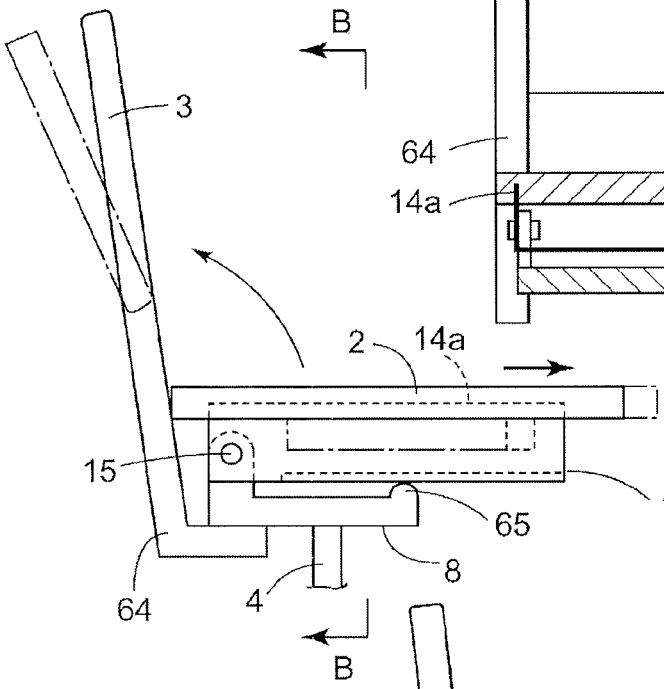
FIG. 14A is a schematic side view illustrating a fifth illustrative embodiment.
Figure 14B:
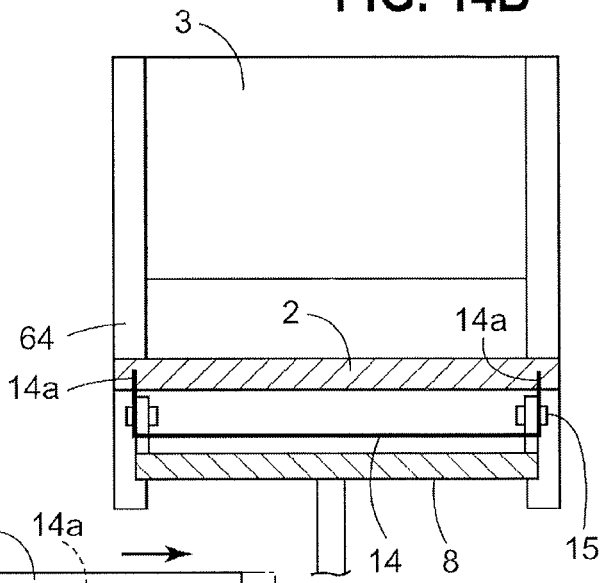
FIG. 14B is a sectional view taken along a line B-B of FIG. 14A.

In a fifth illustrative embodiment shown in FIGS. 14A and 14B, the backrest 3 is attached to an upper end portion (an upper end of a back column) of a fixed back frame 64 extending rearwards from the fixed base 8 and extending upwards so that it can be tilted rearwards, and a spring means for rocking is embedded in the fixed back frame 64. On the other hand, the seat 2 is mounted to the left and right upright parts 14*a* of the movable base 14 so that it can be slid back and forth. When the seat 2 is moved forwards, a resistance is provided by the spring means embedded in the movable base 14. A rear end portion of the movable base 14 is coupled to a rear end portion of the fixed base 8 by the second spindle 15, and a part in front of the rotating point is supported by a support part 65 of the fixed base 8.

In this illustrative embodiment, the backrest 3 can be independently tilted rearwards. However, when the person leans on the backrest 3, the hips tend to move forwards, so that the seat 2 is pushed by the hips of the person and is thus moved forwards. Therefore, the same state as the first illustrative embodiment is made as regards the movement. However, since the interlocking means is not required, the structure can be simplified. This illustrative embodiment is a specific example of the eleventh invention. In the meantime, the movable base 14 may also be configured to have left and right longitudinal parts, to have a forward-facing opening, as seen from above, and to movably support the seat by the left and right longitudinal parts.

Figure 14C:
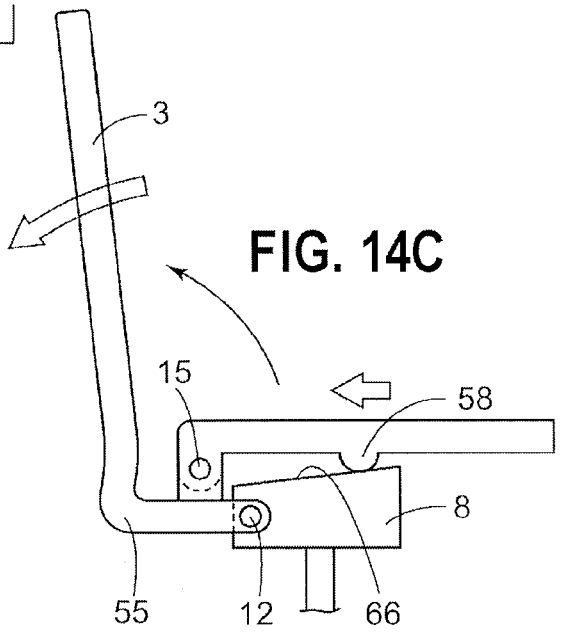
FIG. 14C is a schematic side view illustrating a sixth illustrative embodiment.

In a sixth illustrative embodiment shown in FIG. 14C, the back frame 55 coupled to the fixed base 8 to be tilted rearwards is attached with the seat 2 by the second spindles 15 so that the seat can be raised and rotated. Also, a supported part 58 protruding downwards from the lower surface of the seat 2 is contacted to the upper surface of the fixed base 8. Therefore, although the seat 2 retreats during the rocking, since a support surface 66 of the fixed base 8 is configured as an inclined surface of which a height becomes lower towards the rear, it is possible to reduce or make the rearward tilting angle zero, which is associated with the retreat of the seat 2. In this illustrative embodiment, the back frame 55 and the second spindle 15 configure the interlocking means.

Figure 15A:
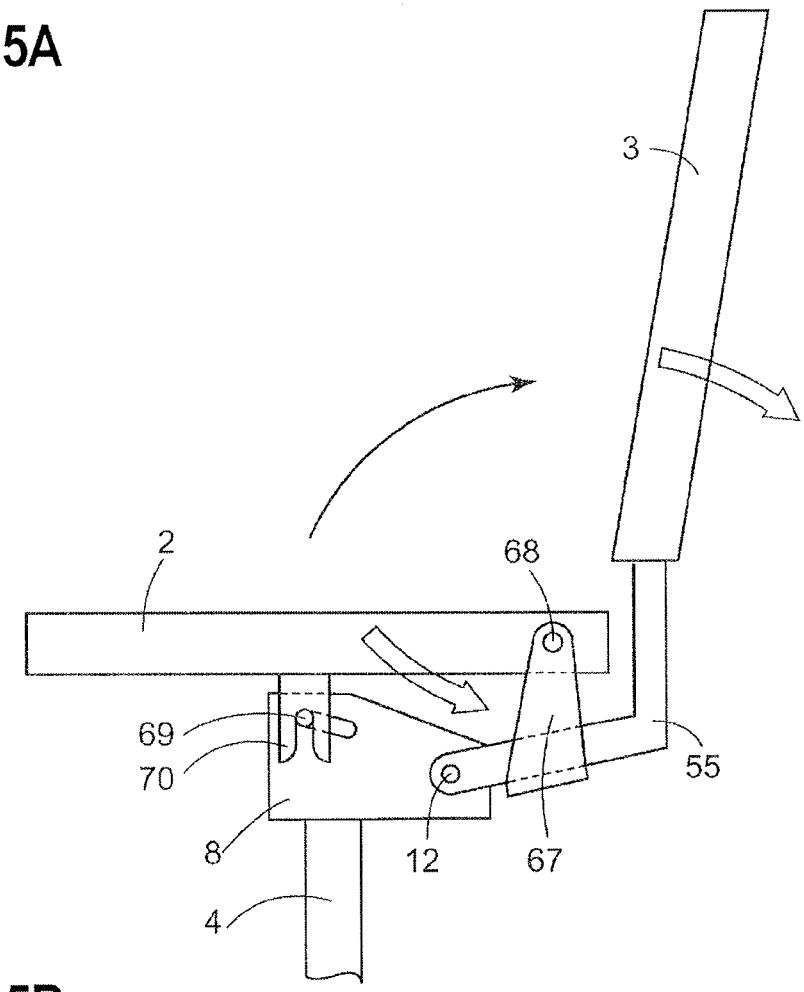
Figure 15B:
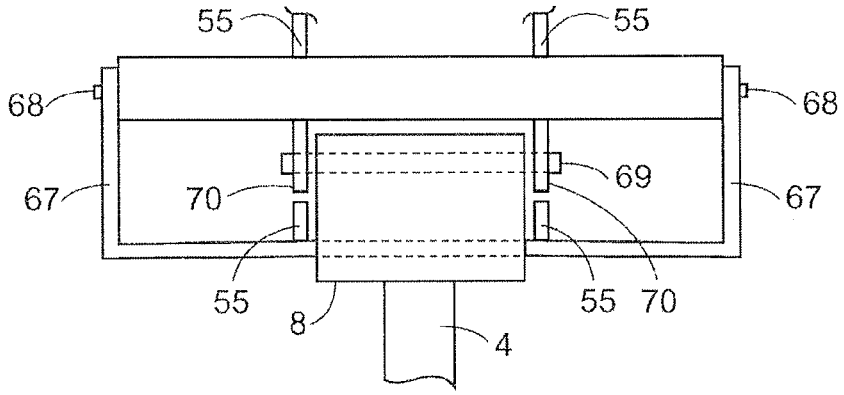

In a seventh illustrative embodiment shown in FIG. 15, the back frame 55 coupled to the fixed base 8 to be tilted rearwards is attached with the backrest 3, an intermediate bracket 67 of which an upper end portion extends to an outer side of a side surface of the rear part of the seat 2 is fixed to the back frame 55, and the intermediate bracket 67 and the seat 2 are coupled by a third spindle 68 oblong in the left-right direction so that they can move relative to each other. Also, the fixed base 8 is attached with a slide shaft 69 oblong in the left-right direction by which the back frame 55 is pulled, and a retreat movement of the slide shaft 69 is supported by the spring means embedded in the fixed base 8.

The slide shaft 69 protrudes outwardly in the left-right direction of the fixed base 8 and bearing brackets 70 provided on the lower surface of the seat 2 are fitted to the protruding end portions from above. Therefore, in this illustrative embodiment, when the backrest 3 is tilted rearwards, the seat 2 is tilted rearwards with retreating. Since the bearing bracket 70 opens downwardly, it is possible to raise upwardly the seat 2. In this illustrative embodiment, the back frame 55, the intermediate bracket 67 and the bearing bracket 70 configure the interlocking means.

In an eighth illustrative embodiment shown in FIG. 16, for a configuration where the backrest 3 is attached to the rotatable back frame 55, the front end of the back frame 55 is provided with an upright part 55*b* extending upwardly beyond the first spindle 12, the rear part of the seat 2 is coupled to the fixed base 8 by a bell crank-type link 56, and a part of the link 56 at the rear of the rotating point thereof and the upright part 55*b* of the back frame 55 are coupled by a pin. In this illustrative embodiment, when the backrest 3 is tilted rearwards, the seat 2 is moved forwards. The link 56 configures a main member of the interlocking means.

Figure 17:
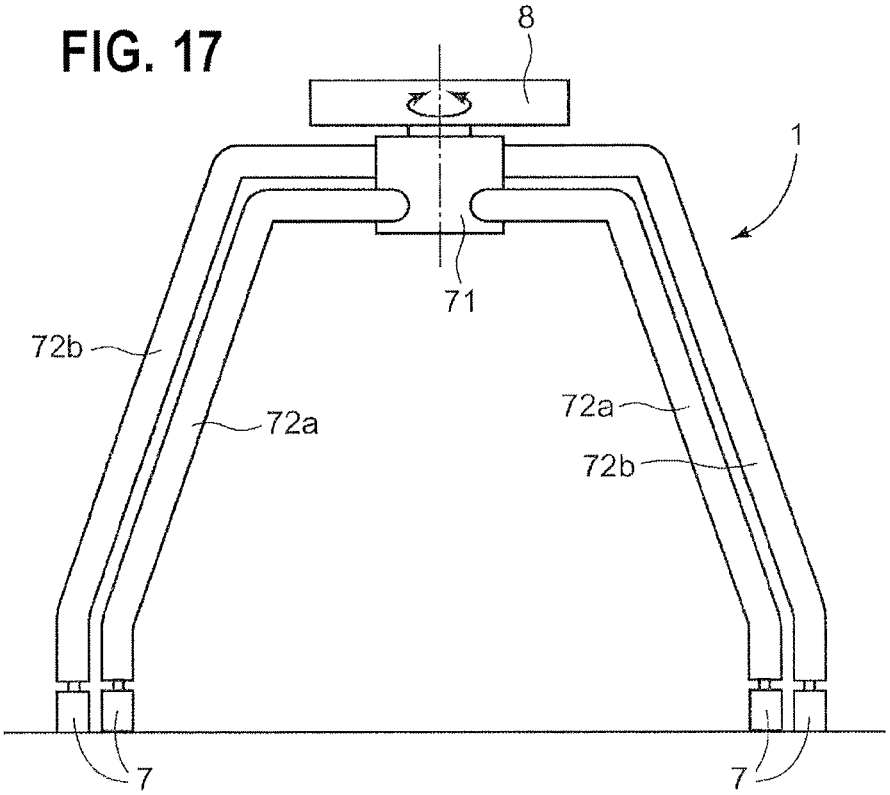
FIG. 17 is a front view of a support device according to a ninth illustrative embodiment.

FIG. 17 illustrates the support device 1 according to a ninth illustrative embodiment, which does not have the function of uplifting the seat 2. The support device 1 has a head 71 which configures an upper end thereof and four front and rear branched legs 72*a*, 72*b* are fixed thereto, and the fixed base 8 is rotatably attached above the head 71. Therefore, according to the chair having the support device 1, the seat 2 and the backrest 3 can be horizontally rotated but do not have the height adjusting function.

Figures 18A, 18B:
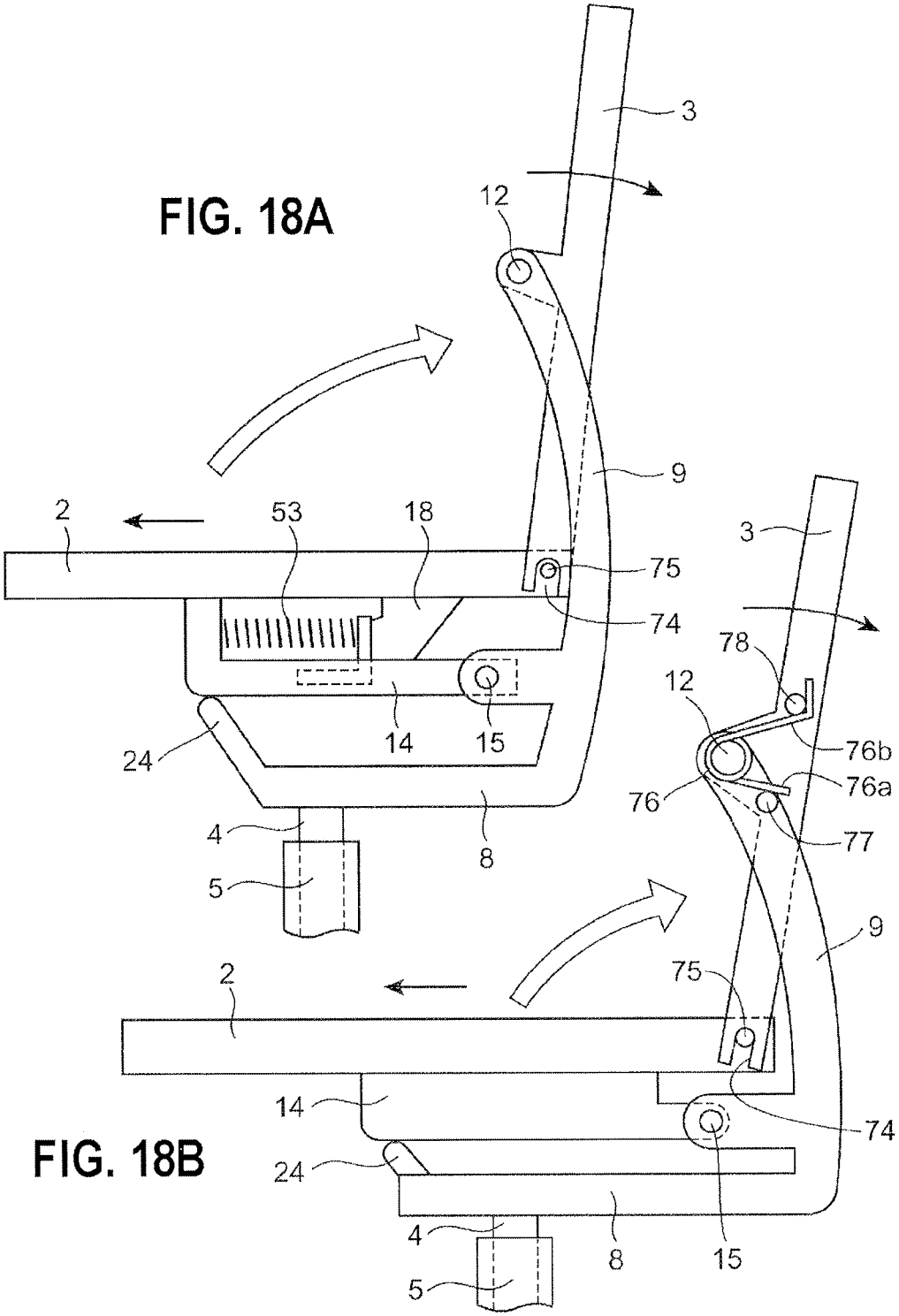
FIG. 18A is a schematic view of a tenth illustrative embodiment.
FIG. 18B is a schematic view of an eleventh illustrative embodiment.

A tenth illustrative embodiment shown in FIG. 18A is basically the same as the first illustrative embodiment, and a rotatably base 14 coupled to the support frame 9 so that it can be raised is attached to slide back and forth. The tenth illustrative embodiment is different from the first illustrative embodiment, in that the rotatable base 14 is coupled at a position lower than the seat surface of the support frame 9, and engaging recesses 74 having a downward opening are provided at the left and right side parts of the backrest 3 and engaging pins 75 fitted to the engaging recesses 74 from below are provided at the left and right side parts of the rear end of the seat 2, as the means for moving forwards the seat 2 with the backrest 3. When the seat 2 is raised, the engaging pins 75 are separated from the engaging recesses 74, and when the seat 2 is unfolded, the engaging pins 75 are fitted to the engaging recesses 74 and the seat 2 is moved forwards by the rearward tilting of the backrest 3.

An eleventh illustrative embodiment shown in FIG. 18B is substantially the same as the tenth illustrative embodiment and is different from the tenth illustrative embodiment, in that a kick spring (a torsion spring) 76 is used as the spring for rocking and is wound on the first spindle 12. One end 76*a* of the kick spring 76 is fixed to the support frame 9 by a pin 77, and the other end 76*b* of the kick spring 76 is fixed to the backrest 3 by a pin 78. Although it is not necessary to particularly mention, the kick spring 76 is actually covered by a cover or embedded in the support frame 9, so that it is not exposed to the outside.

When detaching the interlocking relation between the seat 2 and the backrest 3 by the rotation of the seat 2, it is possible to select an arbitrary fitting relation between a male engaging part and a female engaging part, such as the pin 75 provided for the backrest 3 and the engaging hole 74 provided for the seat 2. In this case, it is preferably to urge the backrest 3 by a spring so that the backrest can be easily returned to the reference posture (the neutral posture) at which the backrest is not tilted rearwards.

(6) Outline of Twelfth Illustrative Embodiment

Subsequently, a twelfth illustrative embodiment shown in FIGS. 19 to 30 is described. First, an outline of the chair is described with reference to FIGS. 19 to 22. The terminologies 'front and rear' and 'left and right' are used on the basis of a state seen from the person normally sitting on the chair, like the above illustrative embodiments.

Figures 19A, 19B, 19C:
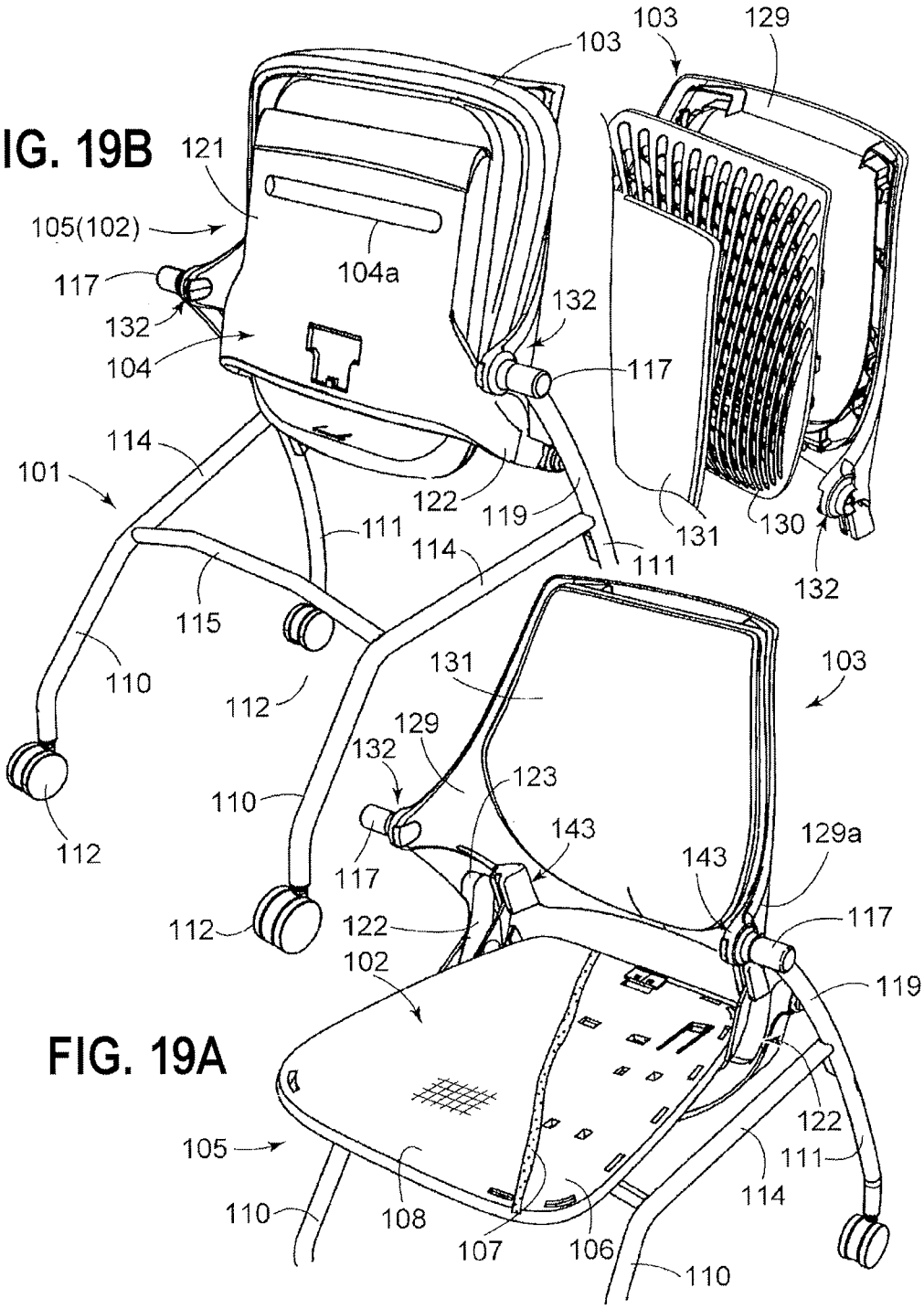
Figures 20A, 20B:
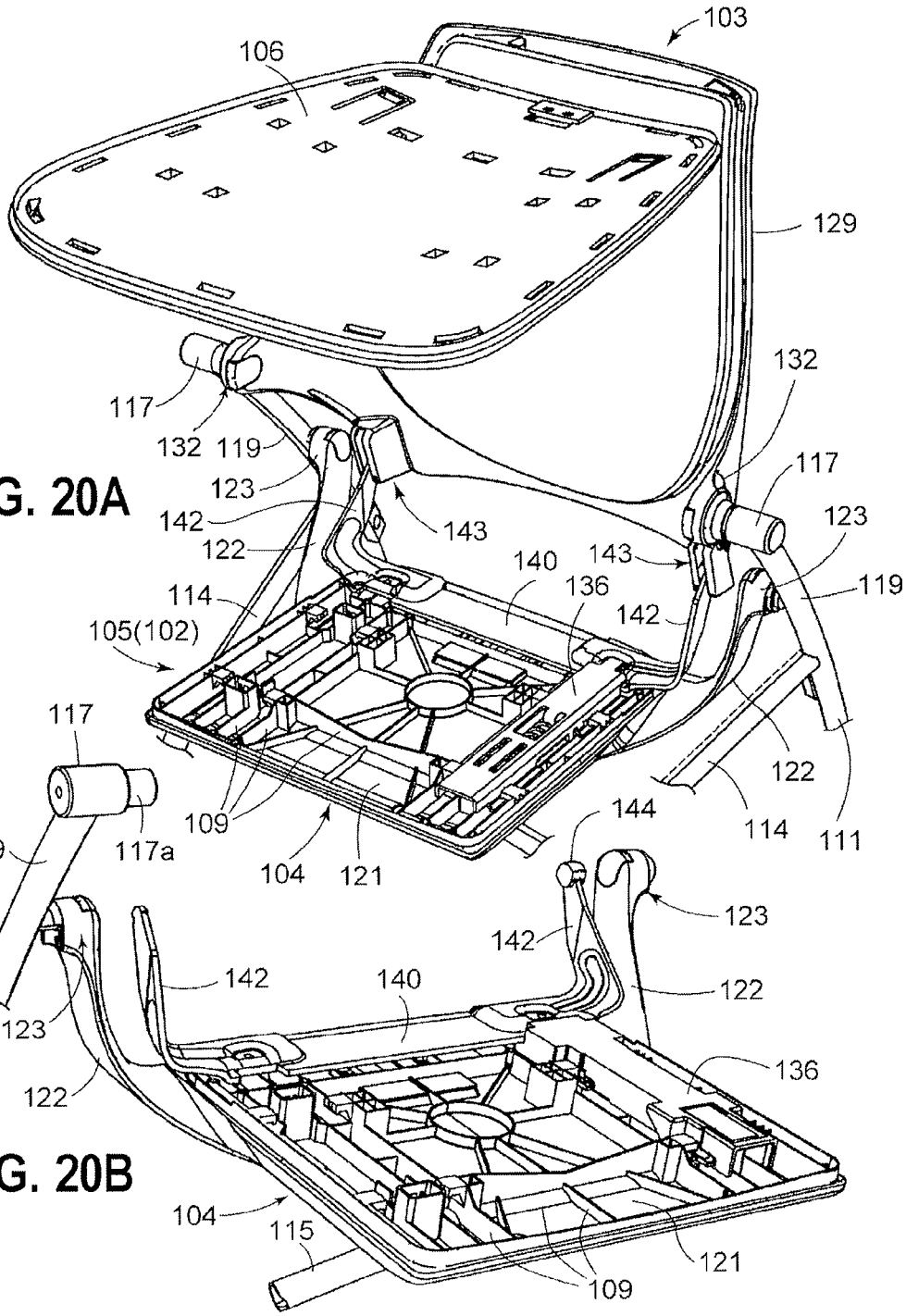
FIG. 20A is a perspective view at a separated state of the seat.
FIG. 20B is a perspective view of a seat bearing part.
Figure 21:
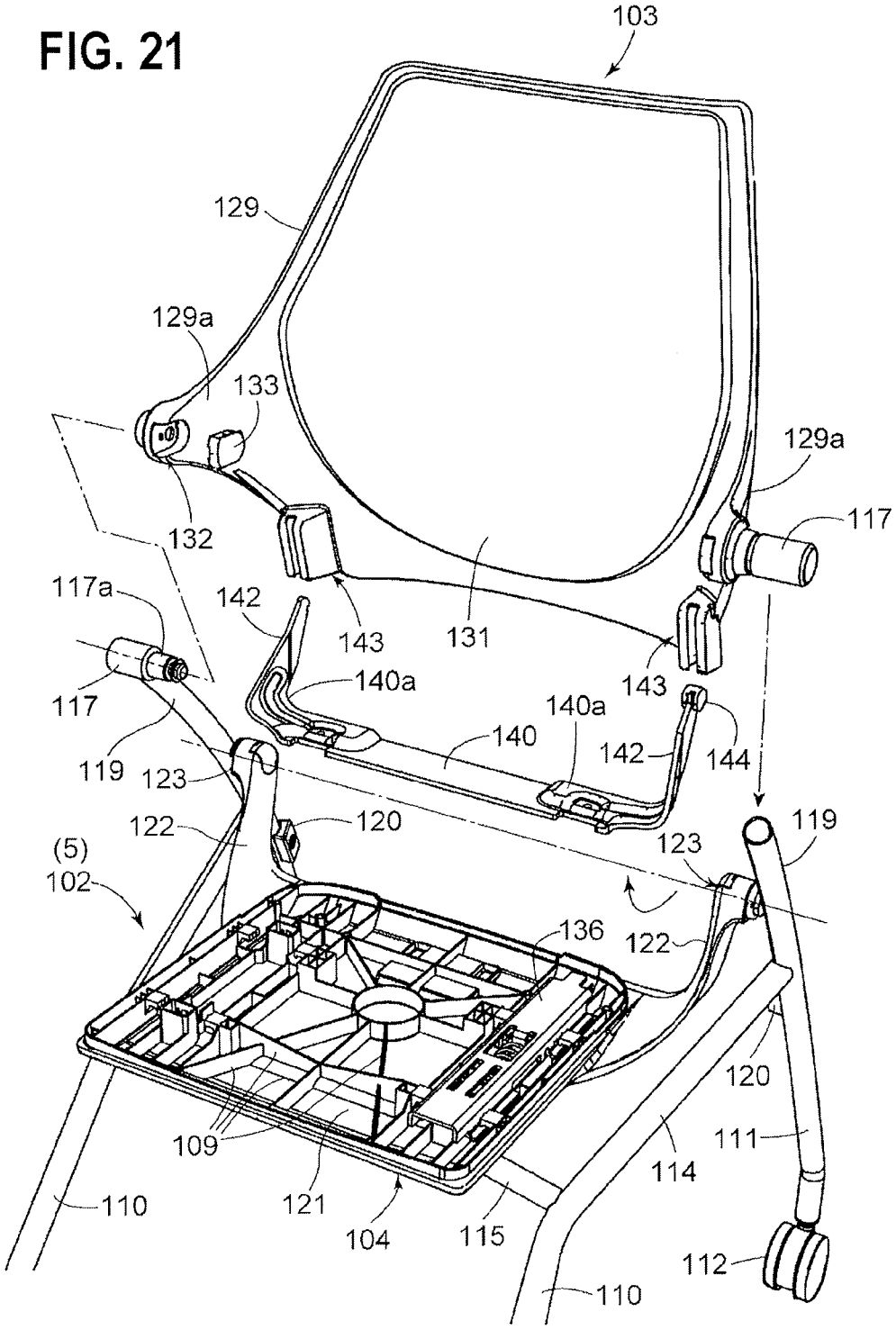
FIG. 21 is an exploded perspective view at a state where the seat is omitted.
Figure 22:
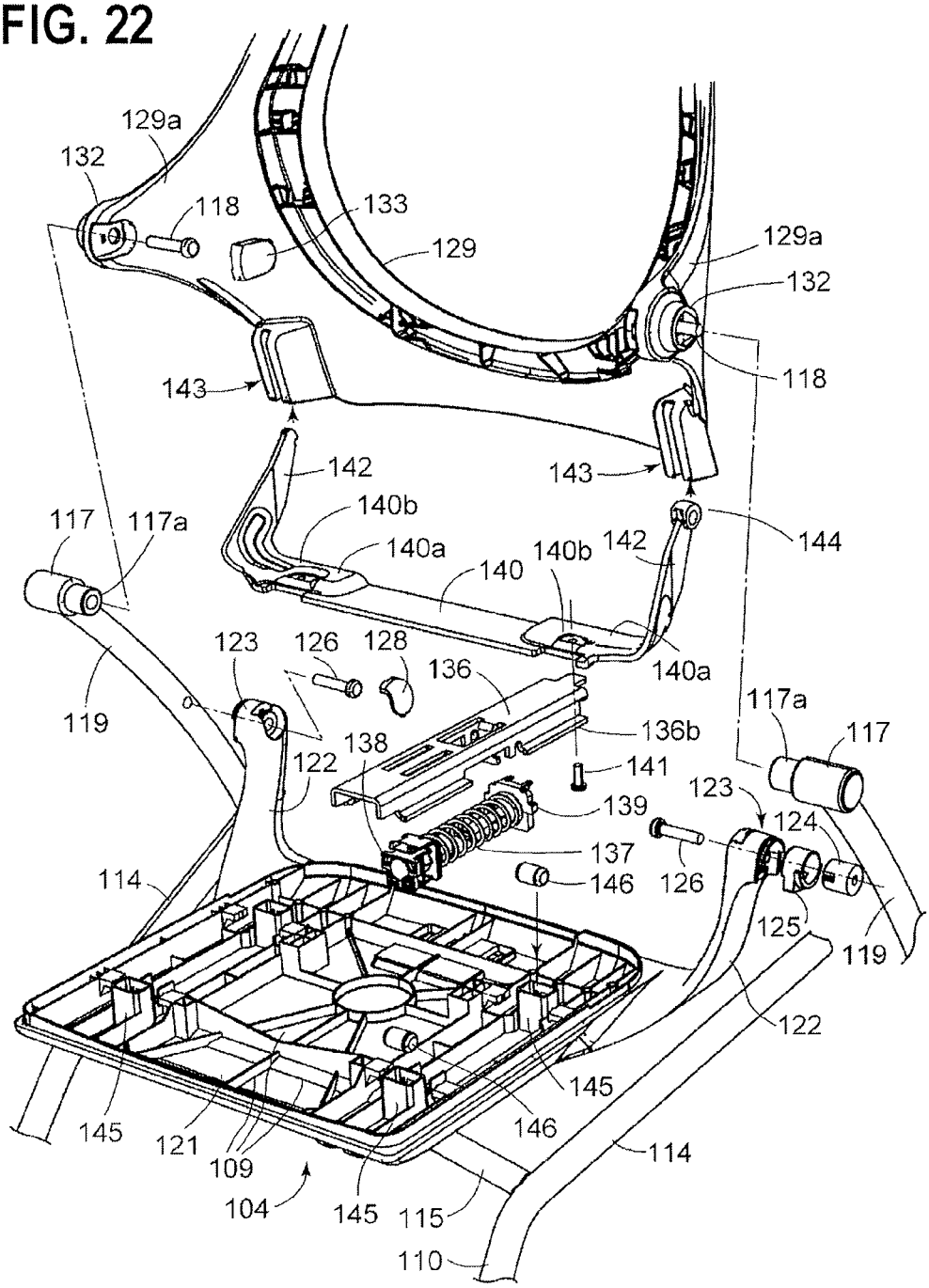
FIG. 22 is an exploded perspective view illustrating a rocking mechanism.

As shown in FIG. 19, the chair has, main elements, a support device 101, a seat 102 and a backrest 103. The seat 102 is attached to a raising and rotating type movable base 104. Therefore, the seat 102 and the movable base 104, as the main element, configure a seat part 105. As shown in FIG. 19A, the seat 102 has a seat plate (a seat inner shell) 106 made of resin and a seat cushion material 107 stretched on an upper surface thereof, and the seat cushion material 107 is covered with a surface material 108 such as cloth. In the meantime, the movable base 104 can also be referred to as a rotating type base or raising type base. As shown in FIGS. 20 to 22, a plurality of reinforcement ribs 109 is provided on an upper surface of the movable base 104.

The support device 101 is composed of metal pipes such as steel pipes, aluminum pipes and the like (therefore, this illustrative embodiment is applied to a so-called pipe chair), and has four legs of left and right front legs 110 and left and right rear legs 111. Casters 12 are attached to the respective front and rear legs. An upper end of the front leg 110 is formed with a bent upper side part 114 extending rearwards with being slightly tilted forwards with respect to a horizontal direction, and a rear end of the upper side part 114 is fixed to a part adjacent to an upper end of the rear leg 111 by a welding.

Front ends of the left and right upper side parts 114 are coupled by a lateral rod 115 oblong in the left-right direction. The lateral rod 115 has also a function of supporting the forwardly unfolded seat part 105, and is gently bent in an upwardly convex shape so that an intermediate part thereof in the left-right direction is higher, as seen from the front. The rear leg 111 has a forwardly tilted shape so that it deviates forwards as it faces upwards, as seen from the side, and is bent with a gentle curvature. The lateral rod 115 is a support part defined in the claims. As shown in FIG. 19B, a lower surface of the movable base 104 is formed with a recess portion 104*a* to which the intermediate part of the lateral rod 115 in the left-right direction is fitted.

An upper end of the rear leg 111 is a free end, an upper spindle 117 of which a axial center is horizontal in the left-right direction is fixed to the upper end by the welding, and the backrest 103 is coupled to the upper spindle 117 by an upper screw 118 so that the backrest can be tilted rearwards. Therefore, in this illustrative embodiment, the upper end portion of the rear leg 111 functions as a support frame 119, which is an example of an intermediate support member to which the backrest 103 and the seat 102 are attached. In this illustrative embodiment, since the support frame 119 is provided integrally for the support device 101, it can also be considered that the backrest 103 and the seat 102 are directly attached to the support device 101. As previously discussed, the rear leg 111 is tilted forwards, as seen from the side. For this reason, the upper spindle 117 is positioned in front of the rear end of the seat 102.

A left-to-right interval between the left and right rear legs 111 is set to be greater than a left-to-right interval between the left and right front legs 110. For this reason, it is possible to fit (nest) the legs of the front and rear chairs at the state where the seat part 105 is raised. For example, as can be clearly seen from FIG. 21, an inner surface of the rear leg 111 is provided with a stopper 120 with which the front leg 110 of the rear chair collides (fits) when nesting the chairs. The stopper 120 is made of rubber or resin and has a buffer function and a positioning function.

In the meantime, the shape of the support device 101 can be arbitrarily set. Although it is not necessary to particularly mention, the nesting can be made even when the left-to-right interval between the left and right front legs 110 is set to be greater than the left-to-right interval between the left and right rear legs 111. Each of the legs 110, 111 may be configured by a hollow rod material or elliptical pipe. An aluminum die cast product or resin molded product can also be adopted.

For example, as shown in FIG. 21, the movable base 104 has a rectangular thin box-shaped main body part 121, as seen from above, and horn-shaped arms 122 each of which protrudes upwardly from the rear part of the main body pat 121 with being expanded outwardly. The movable base 104 is a resin molded product (an aluminum die cast product can also be adopted), and the horn-shaped arms 122 are formed integrally with the main body part 121. In the meantime, since the main body part 121 has a box shape, an outer periphery thereof is configured by a peripheral wall.

The horn-shaped arm 122 has a plate shape wide in the front-rear direction. A front-to-rear interval becomes narrower towards the above. An upper end of the horn-shaped arm is provided integrally with a boss part (a bearing part) 123 protruding outwardly in the left-right direction. The boss part 123 is rotatably coupled to a vertically intermediate part of the support frame 119 by a lower spindle 124, a lower bush 125 and a lower screw 126. Therefore, the movable base 104 can be raised and rotated about an axial center 127 of the boss part 123. Thereby, the seat part 105 can be at the raised (folded) state, as shown in FIG. 19B. At the raised state of the seat part 105, a center of the seat part 105 is positioned at the rear of the axial center 127 of the boss part 123 and lower spindle 124. In the meantime, the lower spindle 124 is fixed to the support frame 119 by the welding. Also, a head of the lower screw 126 is covered by a lower cap 128.

As shown in FIG. 19C, the backrest 103 has a backrest main body (main frame) 129 largely opening in the front-rear direction, and a support member 130 attached to the backrest main body 129 to cover the opening. A back cushion material 131 is stretched on a front surface of the support member 130. However, the support member 130 may be exposed without the back cushion material 131. The backrest main body 129 and the support member 130 are resin-molded products.

A lower part of the backrest main body 129 is formed with outward-facing protrusions 129*a* protruding outwardly in the left-right direction, and outer ends of the outward-facing protrusions 129*a* are formed with bearing parts 132 configured to be fitted with the upper spindles 117. The upper screws 118 are screwed to the upper spindles 117 from the inner side, so that the backrest main body 129 is held to the upper spindles 117 not to be detachable. A head of the upper screw 118 is covered by an upper cap 133. The outward-facing protrusion 129*a* protrudes forwards, as seen from above. For this reason, the waist of the sitting person is surrounded from the rear by the backrest 103.

When the backrest 103 is seen from the longitudinal side, the backrest is bent so that a height position part of the backrest main body 129 at which the outward-facing protrusion 129*a* is provided is positioned at the forefront. A height of the outward-facing protrusion 129*a* is set to be a height of the waist (particularly, an adjacency of the third lumbar vertebrae is preferable) when an average adult sits on the chair. For this reason, the backrest 103 has a lumbar support function.

The opening of the backrest main body 129 and the support member 130 have a shape of which a lower part is substantially round and which becomes narrower upwards as a whole, as seen from the front. The support member 130 is formed with a plurality of opening holes aligned side by side vertically and horizontally, except for a peripheral part thereof. For this reason, the support member has a lattice-shaped outward appearance in which vertical lines and horizontal lines intersect with each other. The peripheral part of the support member 130 is fitted and mounted to the backrest main body 129.

Although it is not necessary to particularly mention, the backrest main body 129 may be configured not to open in the front-rear direction, and the back cushion material 131 may be attached thereto directly or via an inner member. Also, a flexible mesh material, instead of the support member 130 made of resin, may be attached to the backrest main body 129. When the support member 130 made of resin is provided, a variety of aspects such as a shape in which oblong slits are formed in multistage can be adopted. The backrest 103 may also be configured by only the backrest main body 129.

When the backrest 103 is tilted rearwards, the seat 102 is moved forwards. Therefore, the seat 102 is attached to the movable base 104 so that it can be slid back and forth. Specifically, as shown in FIGS. 20 to 22, a pair of left and right sliders 136 is mounted to the movable base 104 to be movable back and forth, and the seat plate 106 is mounted to the left and right sliders 136 not to be relatively movable back and forth. Therefore, the seat 102 is relatively moved together with the sliders 136. As shown in FIG. 22, the forward movement of the slider 136 is elastically supported by a compression coil spring 137, which is an example of an elastic member. The spring 137 is supported by front and rear spring bearings 138, 139. The front spring bearing 138 is held to the movable base 104 not to be movable back and forth, and the rear spring bearing 139 is pushed and moved forwards by the slider 136.

Furthermore, a support stay 140 oblong in the left-right direction is fixed to rear end portions of the left and right sliders 136 by screws 141. Both left and right end portions of the support stay 140 are bent and formed with upward-facing passive arms 142, and a lower end portion of the backrest main body 129 is provided with pocket-shaped pushing parts (holder parts) 143 configured to fit with the passive arms 142 of the support stay 140 from above. An upper end of the passive arm 142 is mounted with a crown member 144 made of resin. The crown member 144 is to disperse a reactive force to the pushing part 143 and to make the movement smooth.

According to the chair of this illustrative embodiment, when the sitting person leans on the backrest and the backrest 103 is thus rocked, the sliders 136 are moved forwards through the support stay 140. Thereby, the seat 102 is moved forwards in conjunction (synchronization) with the rocking of the backrest 103.

Therefore, the chair of this illustrative embodiment is a nestable chair, and the seat 102 is moved forwards in conjunction with the rocking of the backrest 103. In the meantime, since the sliders 136 are urged in the retreat direction by the springs 137, it is sufficient that the pushing parts 143 have only to push the passive arms 142. Therefore, instead of providing the pocket-shaped pushing parts, portions of the lower part of the backrest main body 129 may be thickened to function as the pushing parts 143, for example. In this illustrative embodiment, the pushing part 143 and the passive arm 142 of the support stay 140 configure the interlocking means.

(7) Slide Mechanism

Subsequently, the respective parts are described in detail. First, a slide mechanism is described with reference to FIGS. 23 to 25 (the spring 137 is omitted in FIG. 24). As previously described, the pair of left and right sliders 136 to which the seat 102 is fixed is arranged on the movable base 104.

Figures 24A, 24B:
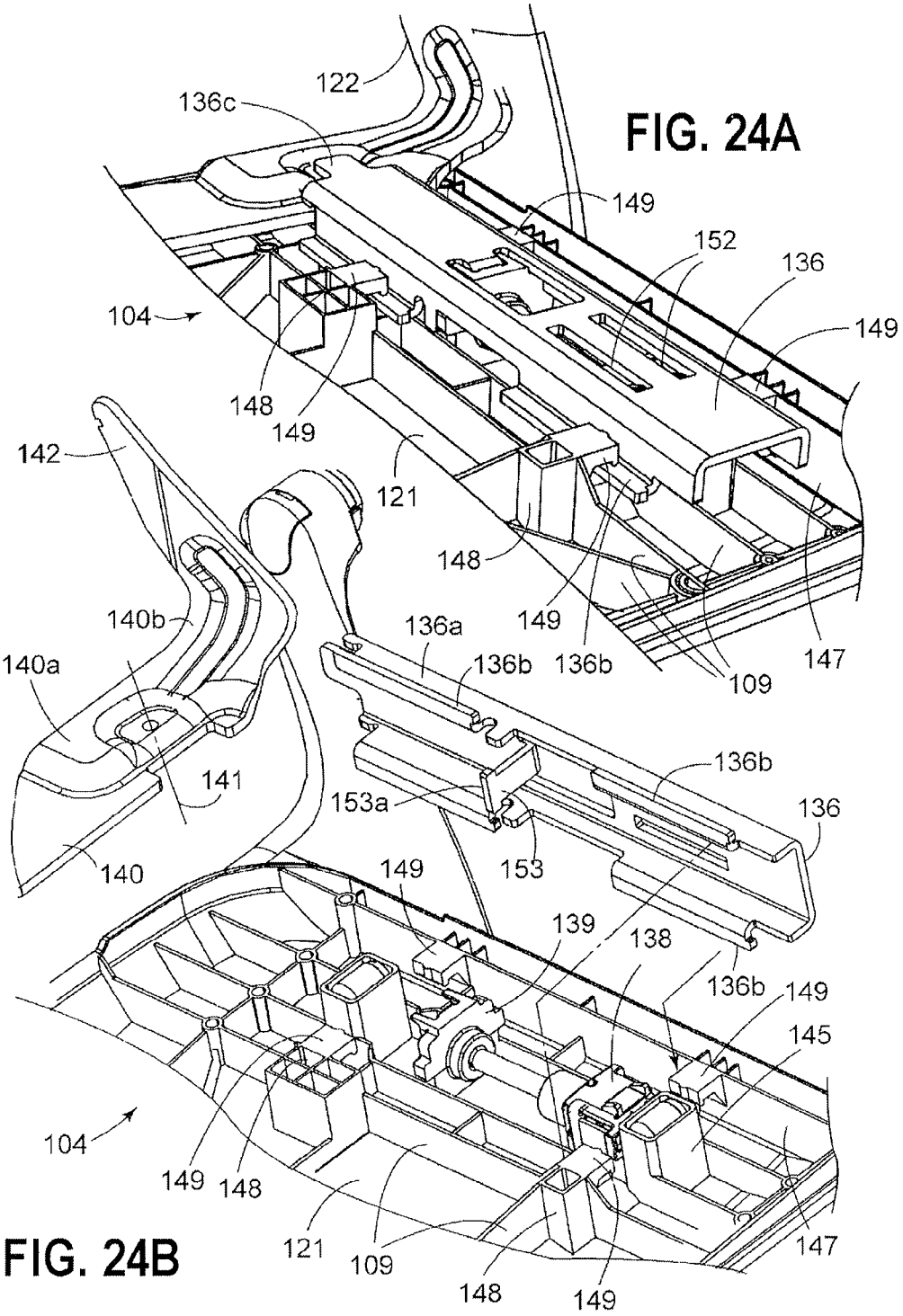
FIGS. 24A and 24B are partial exploded perspective views illustrating a seat support mechanism.

For example, as shown in FIGS. 24 and 25, the slider 136 has a recess shape that is long in the front-rear direction and opens downwardly, and lower ends of left and right side plates 136*a* thereof are bent and formed with outward-facing front and rear flanges 136*b*. On the other hand, the left and right side parts of the movable base 104 are provided with a pair of front and rear support projections 145 covered by the sliders 136, and rollers 146 of which an axial center faces in the left-right direction and are oblong in the left-right direction are rollably fitted into upper ends of the support projections 145. The roller 146 is made of resin having a small coefficient of friction such as POM resin and can slide the slider 136 nimbly and silently back and forth.

A deviation of the slider 136 in the left-right direction is restrained by an outer guide wall 147 and front and rear inner guide projections 148 provided for the movable base 104. The outer guide wall 147 and the front and rear inner guide projections 148 are formed with guide stoppers 149 positioned on the front and rear flanges 136*b* of the slider 136. For this reason, the slider 136 is held so that it cannot be moved upwards and can be slid back and forth. A large gap between the front and rear flanges 136*b* of the slider 136 is empty and a large gap between the front and rear guide stoppers 149 is also empty.

Thus, the slider 136 is attached in order of sequences of fitting the front flanges 136*b* between the front and rear guide stoppers 149 from above at a state where the slider 136 deviates rearwards with respect to a predetermined position, deviating forwards the slider 136 and then positioning the flanges 136*b* below the guide stoppers 149. A slight gap between the flanges 136*b* of the slider 136 and a bottom surface of the movable base 104 is empty and the movable base 104 is provided with reinforcement ribs 109 close to the flanges 136*b* of the slider 136.

The spring 137 and the front and rear spring bearings 138, 139 configure one unit. The front spring bearing 138 is held by left and right holder pieces 150 provided on a rear surface of the front support projection 145 so that it cannot deviate in the front-rear and left-right directions. That is, as shown in FIG. 25, the front spring bearing 138 is contacted at its rear end to the front support projection 145 with being sandwiched by the left and right holder pieces 150. The left and right holder pieces 150 are formed with notches 151 so that recesses are formed between the holder pieces and the support projection 145, and the front spring bearing 138 is provided with lateral projections 138*a* configured to fit with the notches 151 from above. Thereby, the rear spring bearing 139 is held so that it cannot deviate in the left-right and front-rear directions.

Also, as clearly shown in FIG. 25, the front spring bearing 138 is formed with a forward-facing piece 138*c* of which a front end is a free end. A front end of the forward-facing piece 138*c* is provided with stopper claws 138*d*, and the stopper claws 138*d* are fitted into long recesses 152 formed at the slider 136. The stopper claw 138*d* has an upright front end face. For this reason, the retreat position of the slider 136 is restrained. Also, a rear surface of the stopper claw 138*d* is configured as an inclined surface 138*e* of which a height becomes lower towards the rear. For this reason, when deviating forwards the slider 136 from the rear and setting the same, the forward-facing piece 138*c* is first downwardly bending-deformed, and is then return-deformed. Therefore, it is possible to simply attach the slider 136.

On the other hand, as shown in FIGS. 24 and 25, the rear spring bearing 139 is contacted from the rear with a suspended piece 153 formed by cutting and raising the slider 136. The suspended piece 153 is provided at a lower end thereof with left and right outward-facing convex pieces 153*a*, so that it has an inverted T shape, as seen from the front. The rear spring bearing 139 is provided with left and right restraint pieces 139*a* configured to sandwich the suspended piece 153 from the left and the right, except for the lower end. For this reason, the slider 136 and the rear spring bearing 139 are held so that they cannot rattle in the left-right direction.

The rear spring bearing 139 is formed integrally with a rod extending forwards. A tip of the rod 139*b* is fitted into an engaging hole formed at the front spring bearing 138, so that the front and rear spring bearings 138, 139 are held not to separate and to be relatively movable. At a state where the front and rear spring bearings 138, 138 are most spaced from each other, the spring 137 is preliminarily compressed (pre-tensioned). Therefore, as described above, the front and rear spring bearings 138, 139 and the spring configured one unit. For this reason, the handling thereof such as storage is convenient and they can be simply assembled.

(8) Relation Among Slider, Stay and Seat Plate

Subsequently, a relation among the slider 136, the support stay 140 and the seat plate 106 is described with reference to the previous drawings and FIGS. 25 and 26. As shown in FIGS. 23B and 23C, a rear end of the slider 136 is provided with a rearward-facing piece, which is fixed to the support stay 140 by a screw 141 and a nut (cap nut) 158.

A part of the support stay 140 for fixing the slider 136 is configured as an upward-facing bulging part 140*a*, and a protruding piece 136*c* of the slider 136 is fixed to a stepped portion 140*b* recessed in the upward-facing bulging part 140*a*. For this reason, the support stay 140 has high stiffness. In the meantime, the screw 141 may be directly screwed into the support stay 140 without using the nut 158 (in this case, preferably, the support stay 140 is formed with a burring part and the screw 141 is screwed into the burring part). In the meantime, the bulging part 140*a* of the support stay 140 also extends to the passive arm 142. For this reason, the strength of the passive arm 142 is considerably increased.

As shown in FIG. 26, a lower surface of the seat plate 106 is provided with front and rear pairs of downward-facing restraint members 159, 160 configured to embrace the sliders 136 from left and right, and the front downward-facing restraint members 159 are provided with restraint parts 159*a* configured to collide with the front end surfaces of the sliders 136. Further, the seat plate 106 is provided with stopper claws 160 configured to contact the rear ends of the sliders 136.

The stopper claw 160 is formed at a rear end (a free end) of a rearward-facing tongue piece 161. A rear surface of the stopper claw 160 is configured as an inclined surface 160*a* of which a height becomes higher towards the rear. For this reason, when the seat plate 106 is enabled to deviate rearwards with overlapping the sliders 136, the stopper claws 160 are first escaped upwards, return-deformed and contacted to the rear end surfaces positioned at the left and right outer sides of the protruding piece 136*c* of the sliders 136. Thereby, the seat plate 106 is held so that it cannot deviate in the front-rear and left-right directions.

Further, the lower surface of the seat plate 106 is provided with rear engaging claws 162 configured to fit with a front end edge of the support stay 140 from the front and having a hook-like shape, as seen from the side. The rear engaging claws 162 are provided at three places of an intermediate part and left and right sides thereof. By the rear engaging claws 162, the rear part of the seat plate 106 is held so that it cannot be moved upwardly from the support stay 140.

Therefore, the stopper claws 160 are held with being engaged with the sliders 136.

Although it is not necessary to particularly mention, a variety of means can be adopted as regards the attachment structure of the seat plate 106. For example, the seat plate may be fixed to the sliders 136 or support stay 140 by a screw. Also, the left and right sliders 136 may be coupled at the front side parts thereof by stays, and the seat plate may be attached to the front stay.

Figures 26A, 26B, 26C:
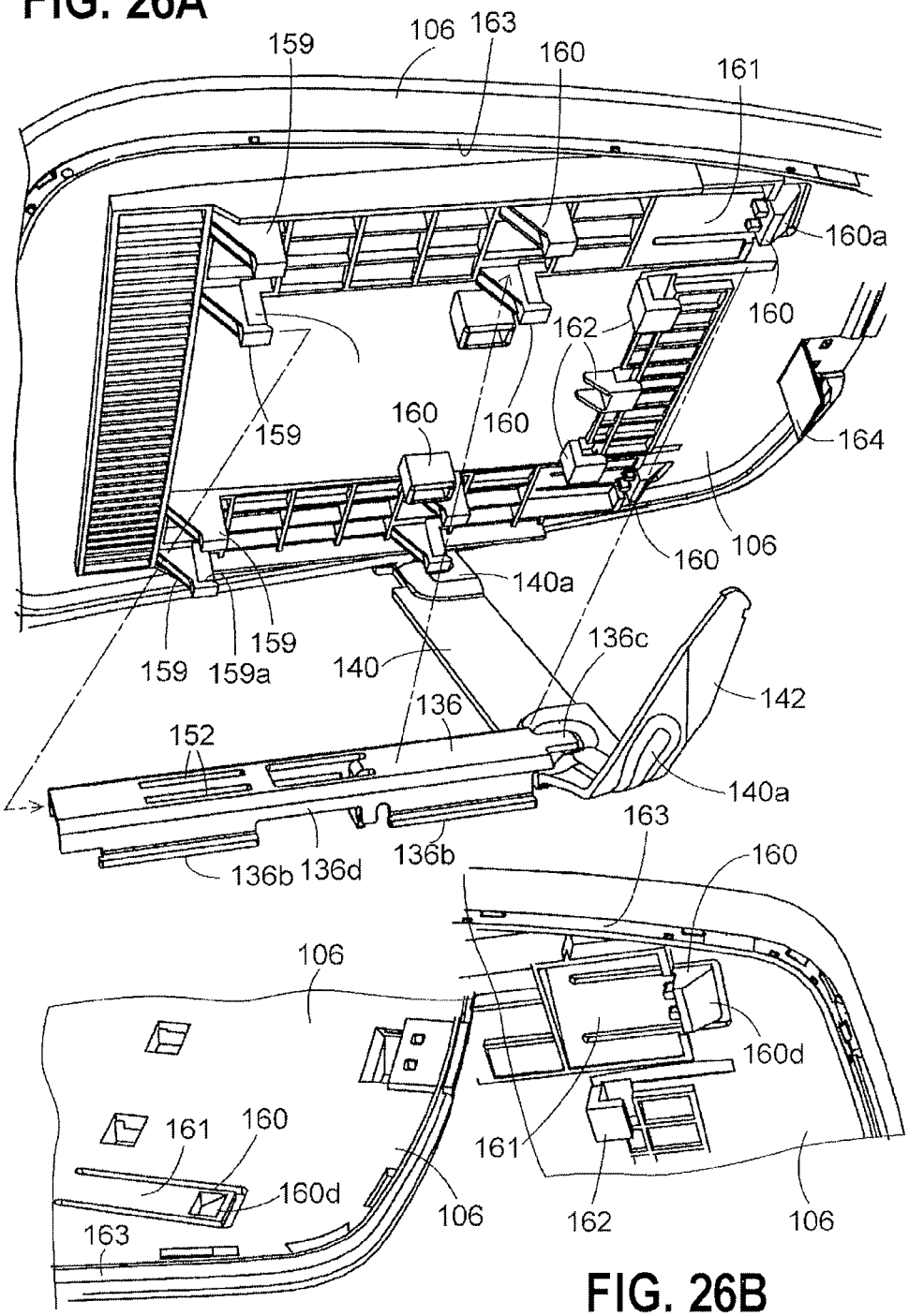
FIG. 26A is an exploded perspective view illustrating a relation between the seat and the slider.
FIG. 26B is a partial perspective view of a rear part of the seat, as seen from below.
FIG. 26C is a partial perspective view of the rear part of the seat, as seen from above.
Figure 27:
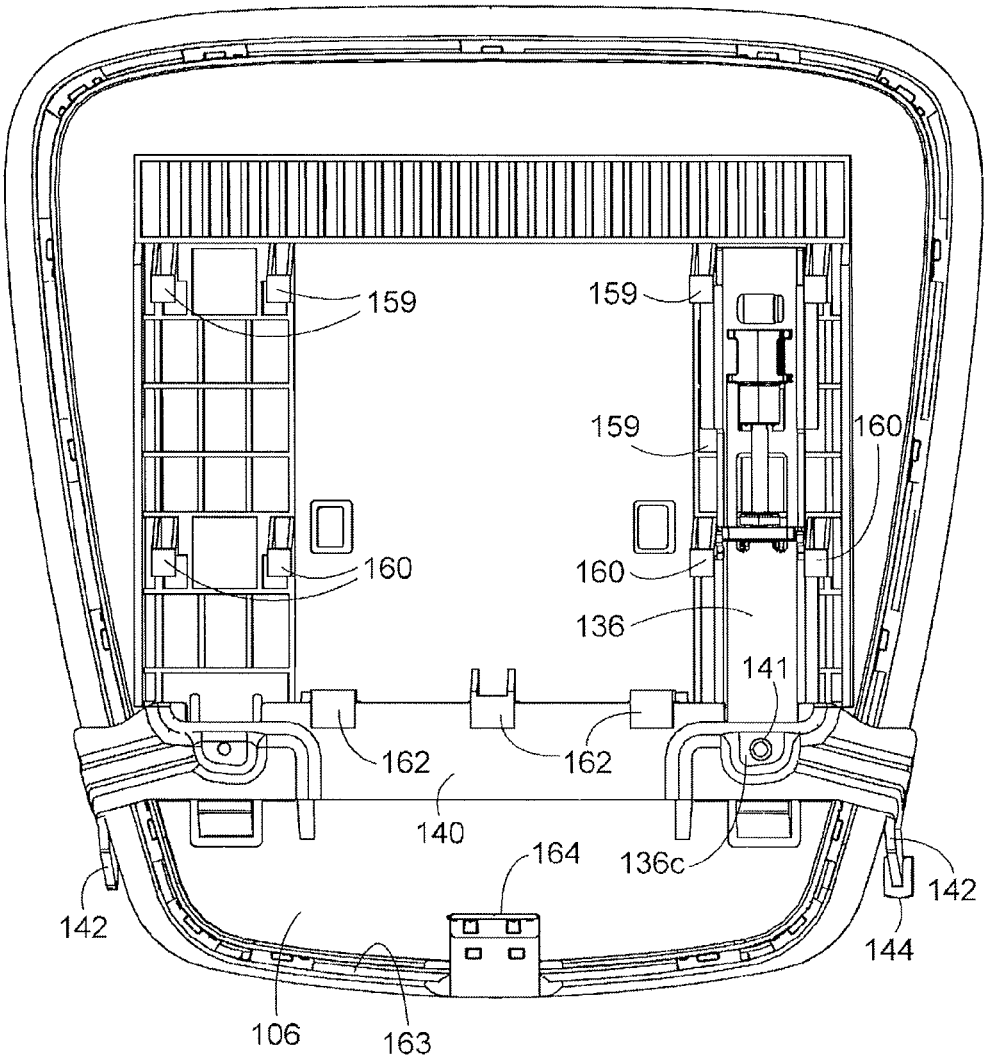
FIG. 27 is a bottom view illustrating a relation among the slider, the support stay and the seat.

In the meantime, as described above with reference to FIG. 19C, although the seat cushion material 107 is covered by the surface material 108, the surface material 108 is formed with a tube part in which a string passes. By tightening the string, the seat cushion material is attached to the seat plate 106. For example, as shown in FIG. 26B, a lower surface of a peripheral edge of the seat 102 is formed with an annular recess 163 in which a string is fitted. The string is tied at an intermediate part of the rear end portion of the seat plate in the left-right direction. However, when a knot of the string is exposed at the raised state of the seat 102, the outward appearance may be deteriorated.

Therefore, as shown in FIG. 26, for example, the rear end of the seat plate 106 is provided with a downward-facing cover piece 164 and the cover piece 164 is toppled to prevent the knot of the string from being exposed. The cover piece 164 is set to be flush with the lower surface of the seat plate 106 at the toppled state and is held by a claw means (not shown) so that it cannot be simply lifted up.

(9) Pushing Mechanism of Seat

Figure 28A:
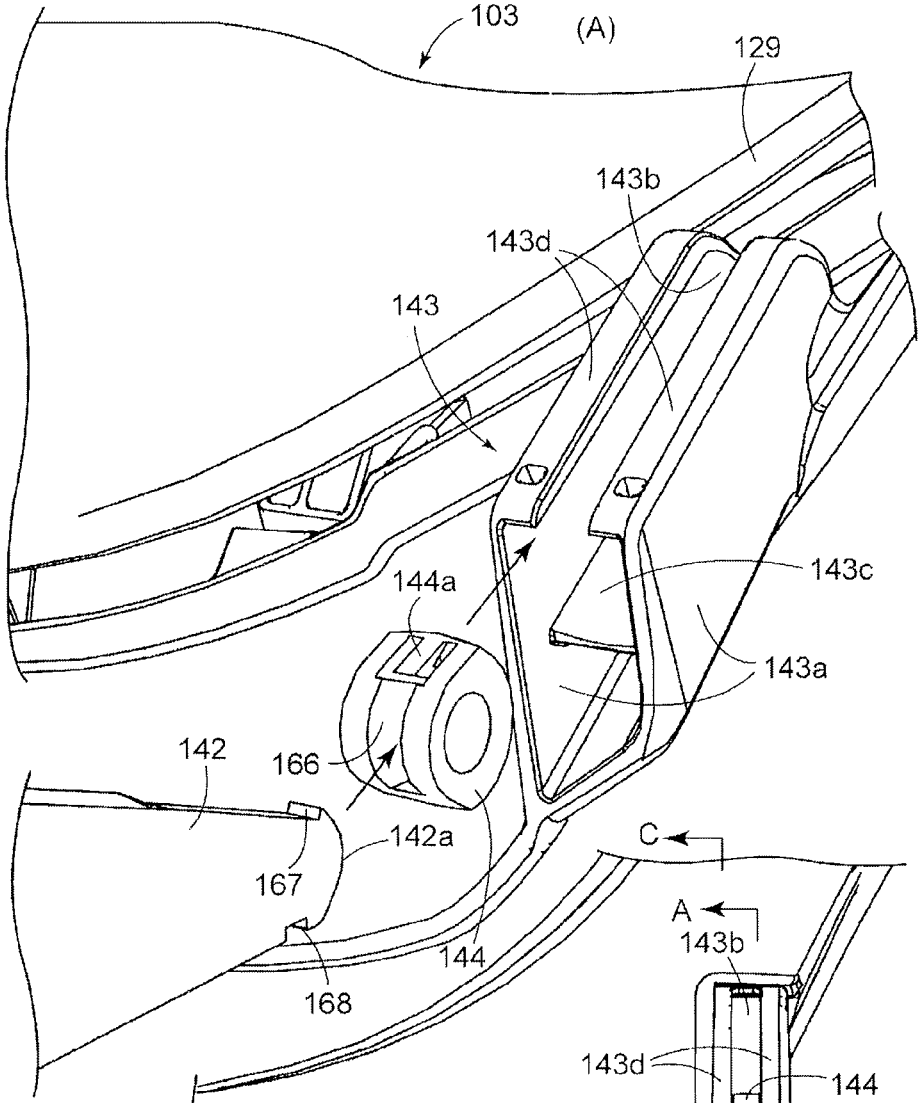
FIG. 28A is an exploded perspective view illustrating a part of an interlocking part.
Figure 28B:
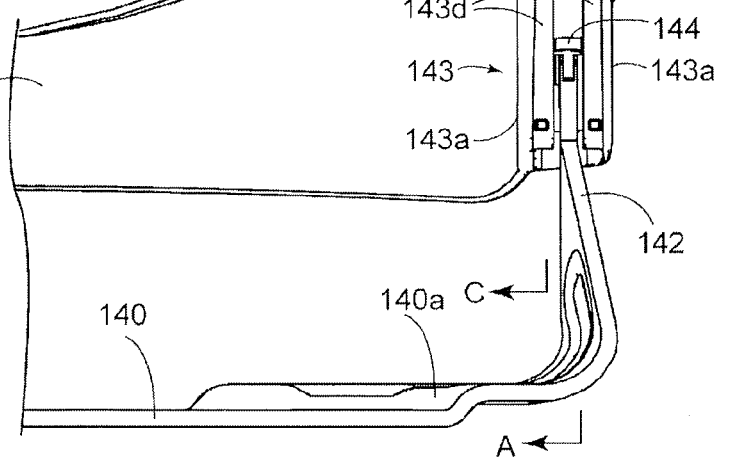
FIG. 28B is a partial front view of the interlocking part.
Figures 29A, 29B, 29C:
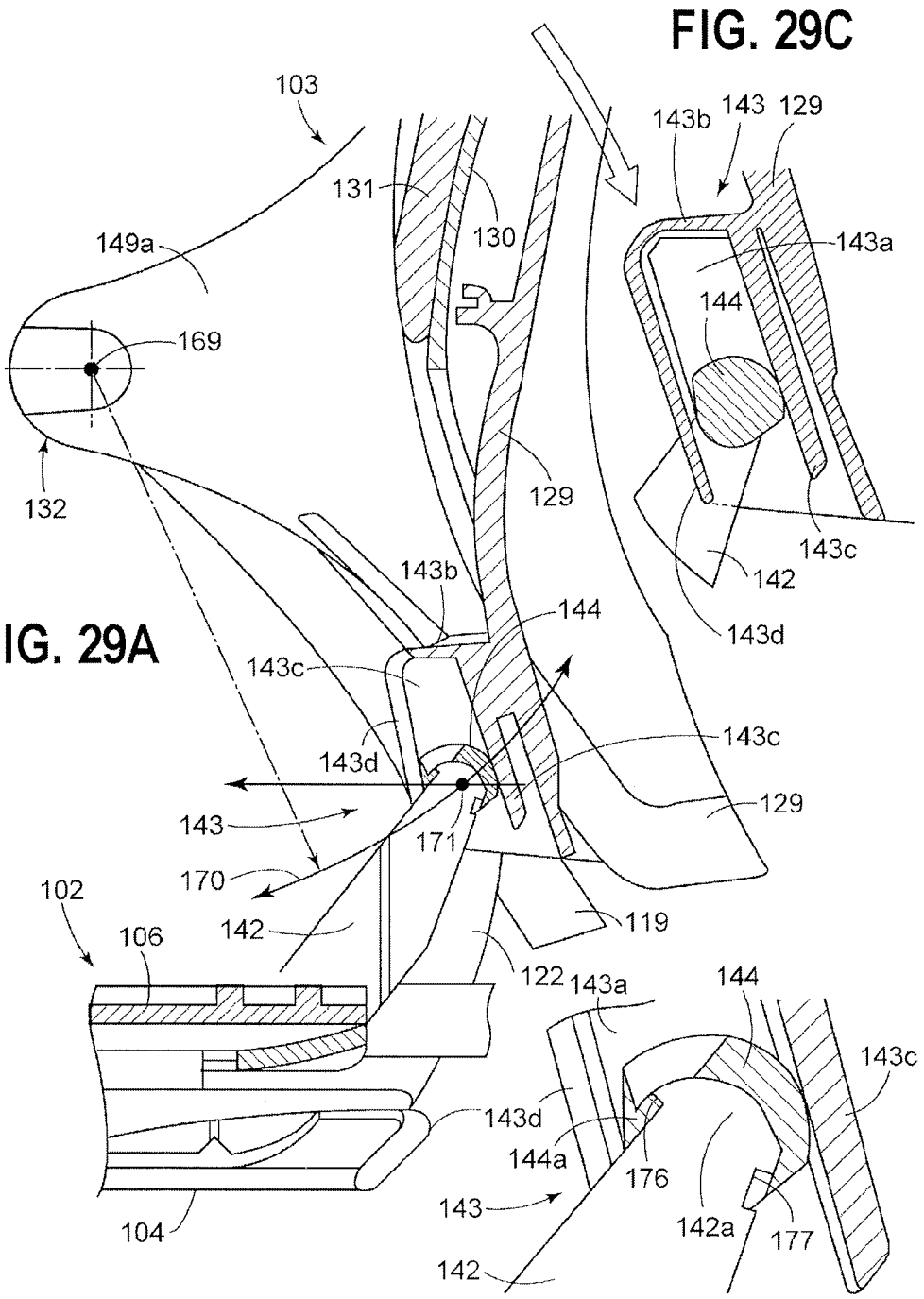
FIG. 29A is a sectional view taken along a line A-A of FIG. 26B.
FIG. 29B is a partial enlarged view of FIG. 29A.
FIG. 29C is a sectional view taken along a line B-B of FIG. 26B.

Subsequently, a pushing mechanism of the seat associated with the rocking is described mainly with reference to FIGS. 28 and 29. As shown in FIGS. 28 and 29, the upper end of the passive arm 142 of the support stay 140 is mounted with the crown member 144 made of resin, as previously described. The crown member 144 has a substantially circular shape, as seen from the side, and is formed with a downward-facing opening recess 166 to which the upper end of the passive arm 142 is fitted.

Although the upper end of the passive arm 142 also has a substantially circular shape, as seen from the side, the passive arm is formed at its front side with an engaging end portion 167 and at its rear side with a notch 168. For this reason, the upper end of the passive arm 142 is formed with a head part 142*a* having a neck. The crown member 144 is formed with a claw part 144*a* configured to fit with an engaging step of the passive arm 142. For this reason, the crown member 144 is held to the passive arm 142 without the rattling so that it cannot be separated.

As previously discussed, the pushing part 143 of the backrest main body 129 is formed to have a pocket shape and is provided with left and right side plates 143*a*, a top plate 143*b* coupled to upper ends of the left and right side plates and a vertically long intermediate plate 143*c* coupled in a pair in the left and right side plates 143*a*. The left and right side plates 143*a* are formed at front ends thereof with inward-facing ribs 143*d*. An interval between the inward-facing ribs 143*d* is set to have a size so that the passive arm 142 can pass therethrough but the crown member 144 cannot get out of therefrom. The head 142*a* of the passive arm 142 and the crown member 144 are positioned between the inward-facing ribs 143*d* and the intermediate plate 143*c*. The passive arm 142 is pushed by the intermediate plate 143*c* via the crown member 144, so that the seat 102 is moved forwards in conjunction with the rocking of the backrest 103.

A front surface of the intermediate plate 143*c* is configured as a flat surface extending straightly in the left-right direction, as seen from above. For this reason, the crown member 144 is pushed without being distorted. Since the intermediate plate 143*c* is provided so as to stably push the crown member 144 without the distortion, a rear space of the intermediate plate 143*c* may be blocked. That is, instead of the intermediate plate 143*c*, the backrest main body 129 may be formed with a stepped portion. As shown in FIG. 29, an upper half part of the intermediate plate 143*c* is not formed at its rear with a space and is substantially configured as a stepped portion.

As shown in FIG. 29, the backrest 103 is rotated about an axial center 169 of the upper spindle 117 in a direction of an arrow 170, so that the pushing part 143 is correspondingly moved forwards with descending. On the other hand, the support stay 140 is simply moved forwards. Therefore, the crown member 144 is relatively moved upwards in the pushing part 143 (the position at which the crown member 144 is pushed by the intermediate plate 143*c* is raised), so that the forward movement of the seat 102 by the rocking is permitted. When the body pressure applied to the backrest 103 is released, the support stay 140 is retreated by the spring 137, so that the pushing part 143 is pushed by the crown member 144 and the backrest 103 is thus return-rotated.

At a state where the person does not lean on the backrest 103, an upward external force may be applied to the upper end of the backrest 103. For example, at a state where the chair is pushed into a desk, the person may erroneously push the upper end of the backrest 103 from the rear. Regarding this case, it is necessary to provide a stopper means for holding the backrest 103 so that it cannot be tilted forwards at a neutral state where the backrest is not rocking.

In this illustrative embodiment, the inward-facing ribs 143*d* are provided at the front ends of the left and right side plates 143*a* of the pushing part 143. Thereby, even though the external force for tilting forwards the backrest is applied to the backrest 103 at the neutral state, the inward-facing ribs collide with the crown member 144 from the front, so that the forward tilting of the backrest 103 is prevented. Therefore, it is possible to prevent the forward tilting of the backrest 103 without providing a particular tilting prevention means. This is one of merits of this illustrative embodiment.

Figures 30A, 30B:
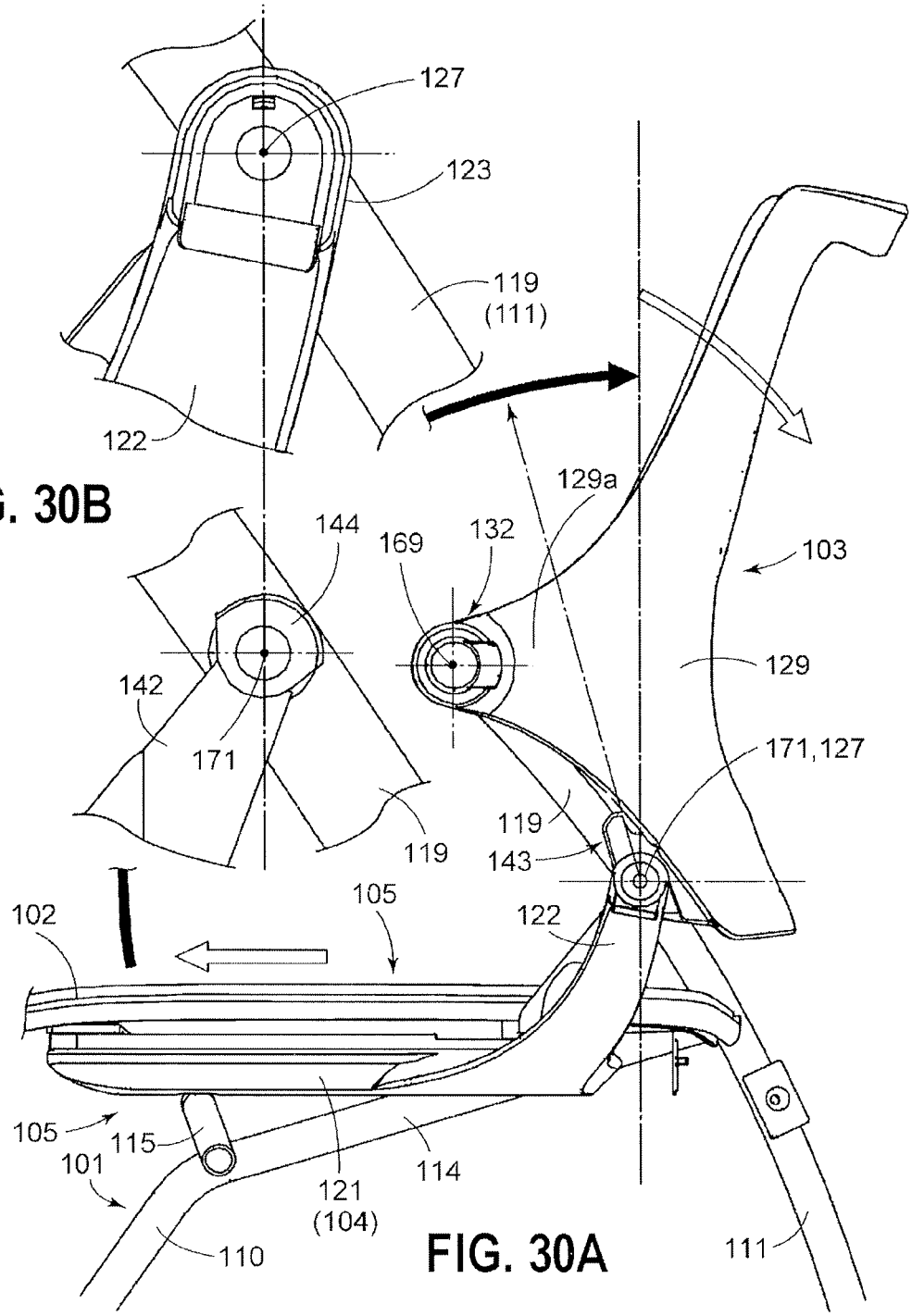
FIG. 30A is a side view for illustrating movement.
FIG. 30B is an exploded sided view illustrating a relation between a raising and rotating point and a pushing position of the support stay.

Also, as shown in FIG. 30, since the rotation axial center 127 of the movable base 104 coincides with an axial center 171 of the crown member 144, it is possible to accommodate the movable base 104 in the pocket-shaped pushing part 143 and to rotate the movable base 104 without the distortion. Also, it is possible to prevent the backrest 103 from being arbitrarily tilted rearwards due to the own weight thereof at a state where the seat 102 is raised.

In the meantime, the axial center 171 of the crown member 144 may be configured to deviate downwards, forwards or forward-downwards from the rotation axial center 127 of the movable base 104 by a very slight size (for example, about 1 to 3 mm). In this case, the movable base 104 is rotated with being distorted (i.e., the movable base is rotated with exceeding a support point). However, the distortion is absorbed by the elastic deformation of the backrest main body 129. Also, at the raised state of the backrest 103, the elastic restoring force of the backrest main body 129 is applied so that the seat part 105 (the movable base 104, the seat 102) can be conveniently tilted rearwards. Therefore, the raised state of the seat part 105 is effectively kept. As previously discussed, at the raised state of the seat part 105, the center of the seat part 105 is positioned at the rear of the rotation axial center 127 of the movable base 104.

(10) Outline of Thirteenth Illustrative Embodiment

In a thirteenth illustrative embodiment shown in FIGS. 31 to 38, the seat part and backrest of the twelfth illustrative embodiment are applied to the lifting support device of the first illustrative embodiment, for example. That is, in this illustrative embodiment, the support device 1 has the leg column 4 consisting of the gas cylinder, the fixed base 8 fixed to the upper end of the leg column is provided with the left and right support frames 9, and the left and right support frames 9 are attached with the backrest 103 and seat part 105 having the same configurations as the twelfth illustrative embodiment. The support frame 9 is an aluminum die cast product. However, a resin molded product can also be adopted.

Therefore, the seat part 105 and the backrest 103 are denoted with the same reference numerals as the twelfth illustrative embodiment and the descriptions thereof are omitted. Also, the members having the same functions as the first illustrative embodiment are denoted with the same reference numerals. In the below, only differences from the first and twelfth illustrative embodiments are described. In the meantime, FIG. 32B illustrates a modified embodiment. In this modified embodiment, the support device 1 has the same structure as the first illustrative embodiment. In the modified embodiment of FIG. 32B, the fixed base 8 has a slight different shape from FIG. 32A.

Figures 31A, 31B:
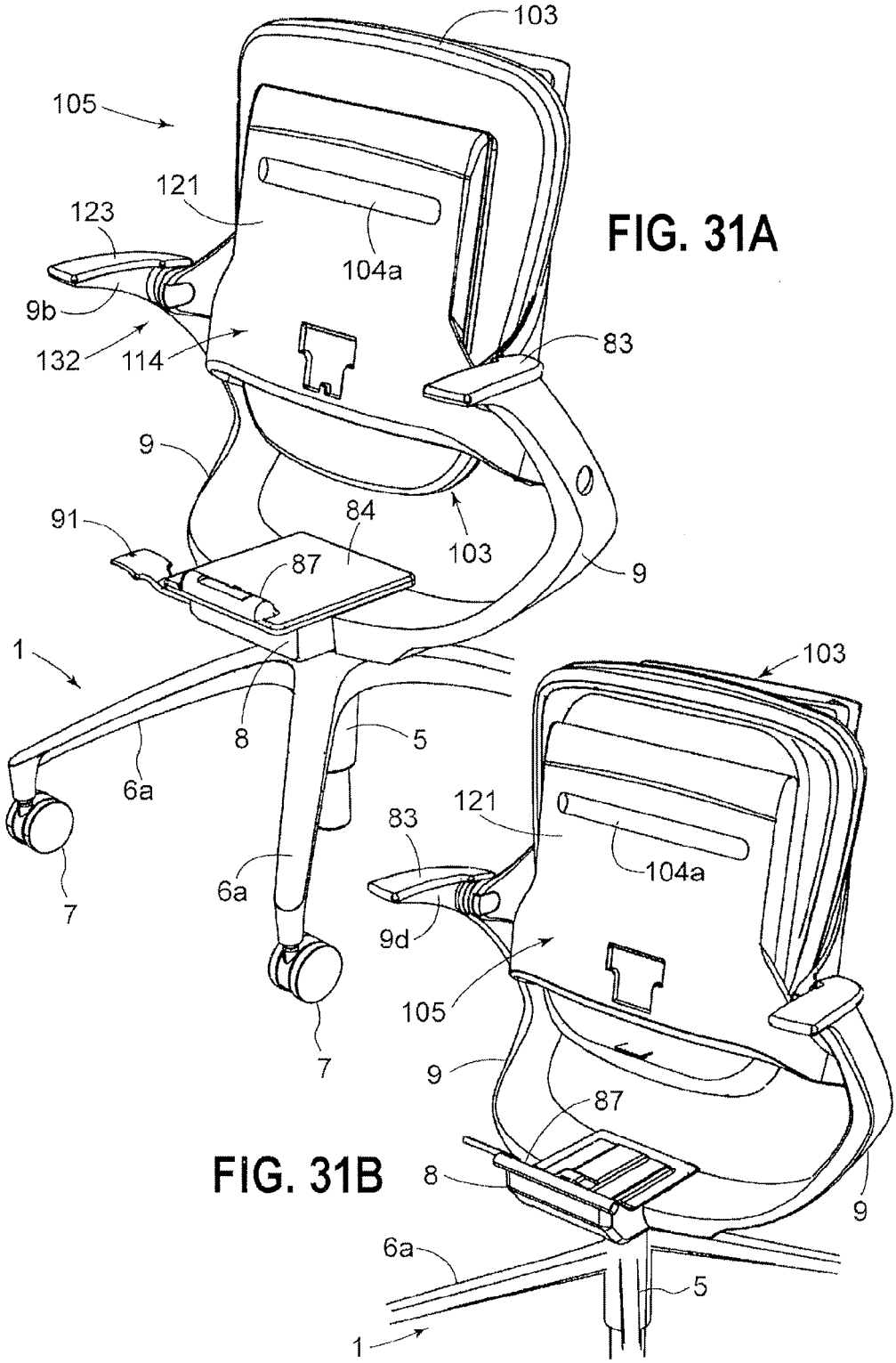
FIG. 31A is a perspective view of a thirteenth illustrative embodiment applied to a swivel chair at a raised state.
FIG. 31B is a perspective view of a modified embodiment of the thirteenth illustrative embodiment.
Figure 32:
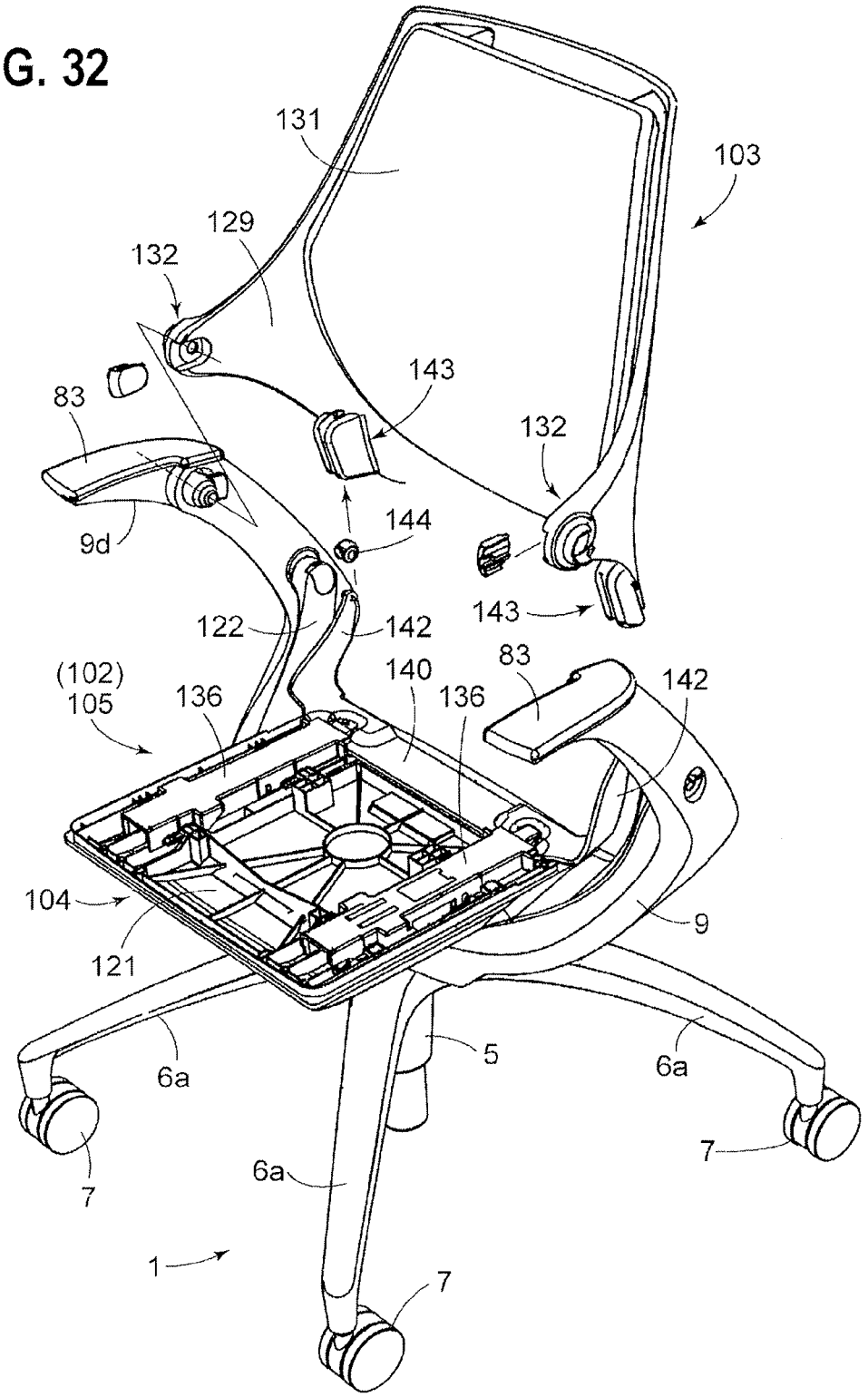
FIG. 32 is an exploded perspective view of the thirteenth illustrative embodiment.
Figure 38:
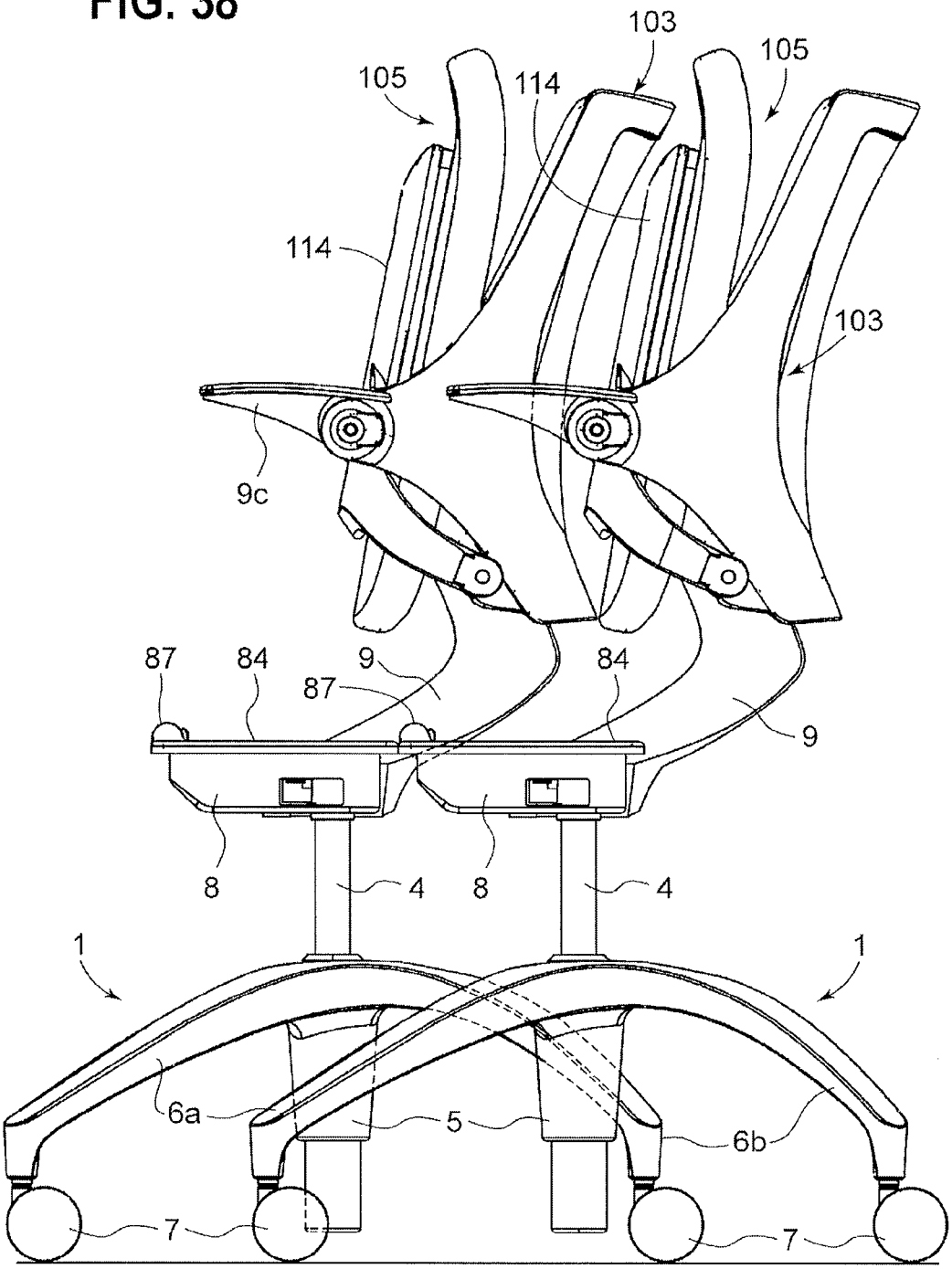
FIG. 38 is a side view at a nesting state with one support frame being omitted.

Also in this illustrative embodiment, the fixed base 8 and the left and right support frames 9 are provided, like the first illustrative embodiment. However, in this illustrative embodiment, a left-to-right length of the fixed base 8 is short and has an outward appearance close to an oblong shape, as seen from above, unlike the first illustrative embodiment. The left and right support frames 9 are fixed to the fixed base 8. In FIGS. 31 and 32, the left and right support frames 9 are shown to be outwardly convex, as seen from the front, because they are convex rearwards, as seen from the side, as shown in FIG. 38. Actually, as shown in FIG. 37A, the support frame has a substantial L shape having a lower horizontal part and an upright part, as seen from the front.

The fixed base 8 has an upwardly opening box shape. As shown in FIG. 34A, for example, a center bracket 23 is fixed in the fixed base 8 by the welding so that a vertical space is empty between the center bracket and a rear half bottom plate of the fixed base 8, a bush 80 is fixed to the fixed base 8 and the center bracket 23, and the upper end of the leg column 4 is inserted and mounted to the bush 80 from below.

As shown in FIG. 33, the fixed base 8 has a substantially rectangular section. The lower horizontal parts configuring lower ends of the left and right support frames 9 are provided with rectangular protrusions 9*c* having a small front-to-rear width and a small vertical width, and the protrusions 9*c* are inserted into lateral holes 81 provided for the fixed base 8. A screw (not shown) penetrating the fixed base 8 from below is screwed into the protrusion 9*c*. Therefore, the protrusion 9*c* is fixed to the fixed base 8 so that it cannot be separated. The protrusion may also be fixed by the welding.

The protrusion 9*c* is positioned by the fixed base 8 and the center bracket 23 so that it cannot be vertically moved, and a position thereof in the front-rear direction is restrained by front and rear inward-facing side pieces 82 (refer to FIG. 35A) provided for the fixed base 8. An upper end of the support frame 9 is configured as an armrest part 9*d* protruding forwards. A resin or elastomer pad 83 is mounted to the armrest part 9*d*.

In the meantime, the fixed base 8 and the left and right support frames 9 may be integrally formed by the aluminum die casting or resin-molded product. In this case, however, a very large mold is required and the flexibility of the design change is poor. In contrast, when the fixed base 8 and the left and right support frames 9 are configured as separate members, like this illustrative embodiment, it is possible to manufacture the support frames 9 by a mold having a general size and to simply cope with the design change of the fixed base 8 and the support frames 9.

Figures 33A, 33B:
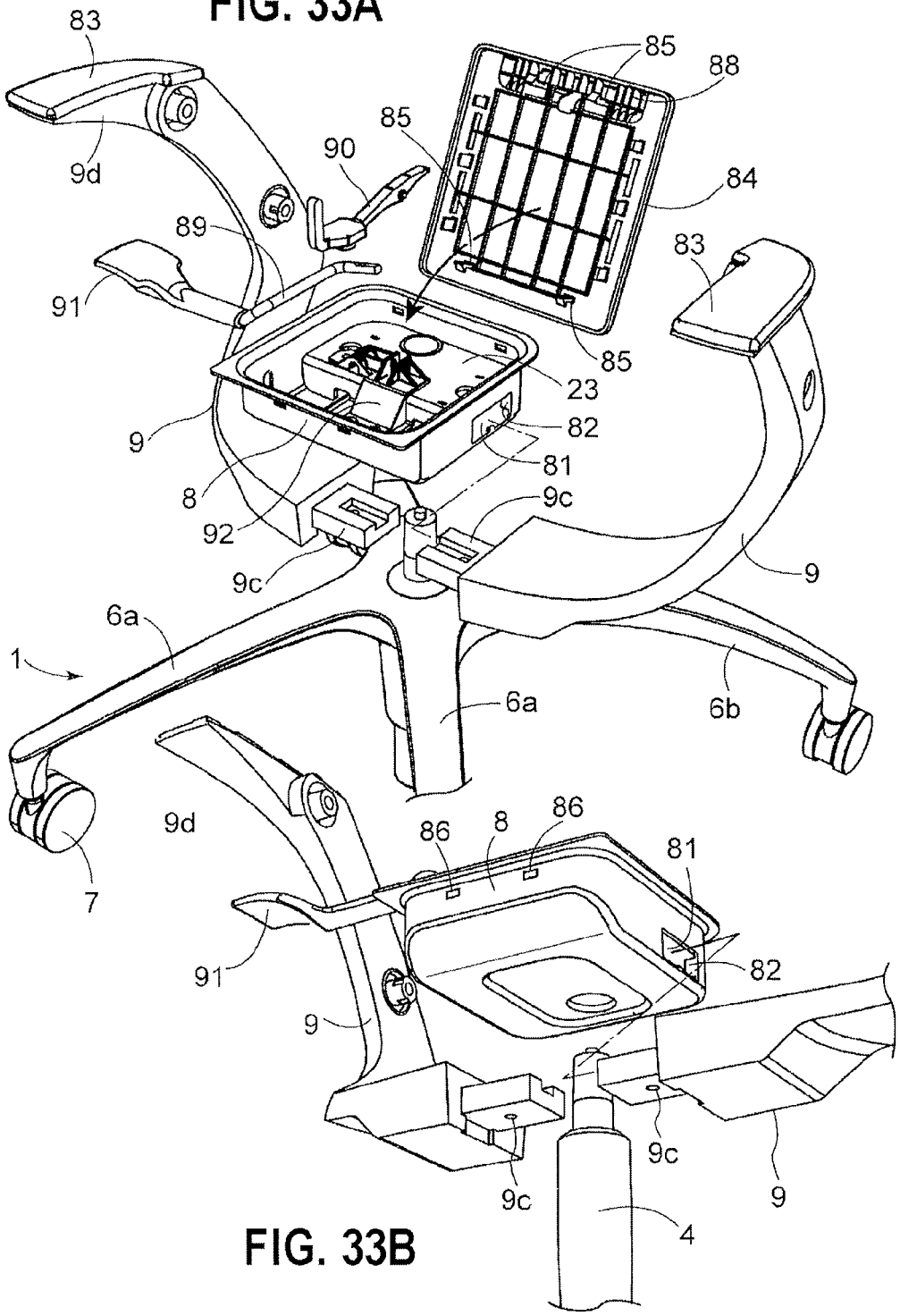
FIG. 33A is an exploded perspective view, as seen from above.
FIG. 33B is an exploded perspective view, as seen from below.

For example, as shown in FIGS. 33 and 34, the fixed base 8 is entirely covered by a lid 84. The lid 84 is made of resin and has front and rear claws 85 (refer to FIG. 33A) that are fitted into engaging holes 86 provided for front and rear plates of the fixed base 8. The lid 84 may also be manufactured by the die casting and fixed to the fixed base 8 by a screw.

A front side part of the lid 84 is provided with an oblong projection 87 serving as a seat support part configured to support the movable base 104. An upper end of the projection 87 is formed with a concave portion 87*a* except for both left and right end portions thereof. Therefore, the movable base 104 is supported at the two left and right parts. An inner surface of the projection 87 is provided with a plurality of ribs 88. The ribs 88 are supported by a flange 8*b* of the fixed base 8. For this reason, even the high load is correctly supported.

(10) Lifting Mechanism of Thirteenth Illustrative Embodiment

As shown in FIGS. 33 to 35, an operation rod 89 for manually adjusting a height and an automatic raising lever 90 for automatically raising the fixed base 8 to a maximum height by the raising of the movable base 104 are attached in the fixed base 8. The operation rod 89 configures a manual operation means and the automatic raising lever 90 configures an automatic raising means.

The operation rod 89 is a metallic round bar. For example as can be clearly seen from FIG. 36B, the operation rod has a crank-shaped outward appearance in which a front end of a front-to-rear length part 89*a* is provided with an outward-facing oblong part 89*b* and a rear end of the front-to-rear length part 89*a* is provided with an inward-facing oblong part 89*c*. The outward-facing oblong part 89*b* protrudes outwards beyond the fixed base 8 and is attached with a knob 91 for touching a finger. The front-to-rear length part 89*a* is pushed by a bearing holder 92 made of resin. Therefore, the operation rod 89 is rotated about an axial center of the front-to-rear length part 89*a*.

A front end portion of the inward-facing oblong part 89*c* of the operation rod 89 is flattened and is positioned on a push valve 93 of the leg column 4. Therefore, when the operation rod 89 is pulled upwards, the push valve 83 is pushed downwards. Thereby, the lock of the leg column 4 is released, so that the fixed base 8 is raised. Since the outward-facing oblong part 89*b* of the operation rod 89 is fitted in a vertically long hole 94 provided for the side plate of the fixed base 8, the operation rod 89 is held so that it cannot deviate in the front-rear direction.

The automatic raising lever 90 has a shape long in the front-rear direction, and a rear end portion thereof is positioned just above the push valve 93 and on the tip of the inward-facing oblong part 89*c* of the operation rod 89. Therefore, when the rear end of the automatic raising lever 90 is lowered, the push valve 93 is pushed down through the operation rod 89. In the meantime, a rotatable intermediate member for pushing down the push valve 93 may be provided for the fixed base 8 and a structure of individually pushing the intermediate member by the operation rod 89 and the automatic raising lever 90 may also be adopted.

The bearing holder 92 has a first bearing part 92*a* configured to rotatably hold the operation rod 89, a second bearing part 92*b* having a rearward opening into which the automatic raising lever 90 is fitted and a lower spring bearing part 92*c*, and is fixed to the center bracket 23 by a screw 95. The first bearing part 92*a* and second bearing part 92*b* of the bearing holder 92 are configured to overlap with an upper surface of the center bracket 23. The spring bearing part 92*c* is configured to descend downwardly and to overlap with a forward-facing lower piece 23*a* provided at a front end of the center bracket 23 from below. The forward-facing lower piece 23*a* of the center bracket 23 is configured to overlap with the bottom surface of the fixed base 8.

Figure 36A:
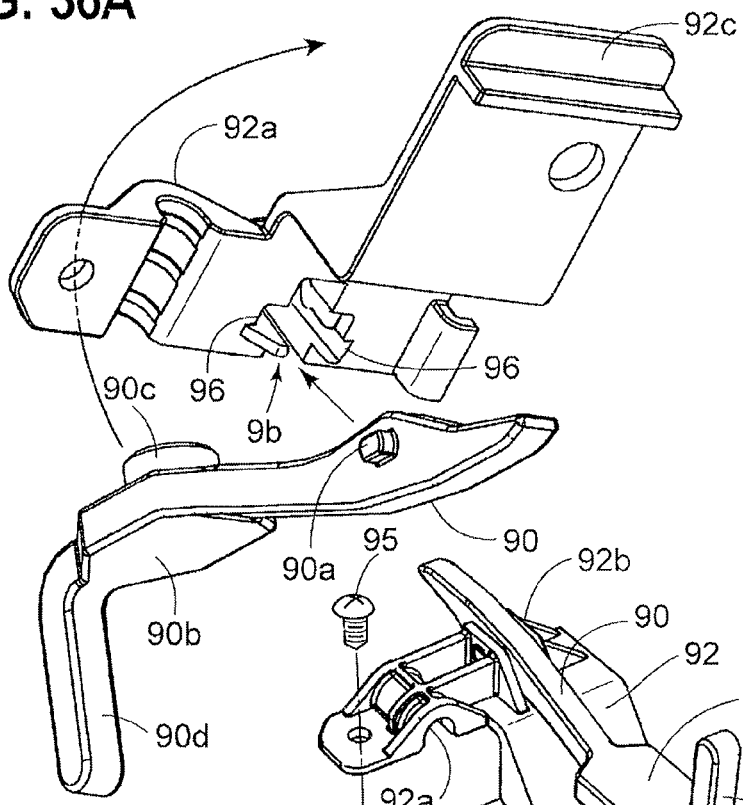
FIG. 36A is an exploded perspective view of a lock release lever and a bearing holder.
Figure 36B:
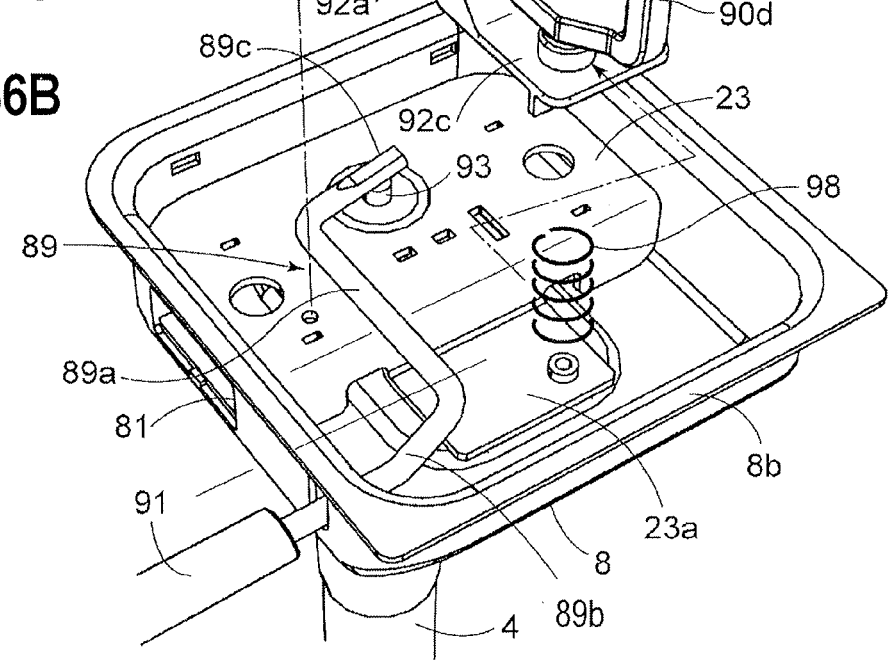
FIG. 36B is an exploded perspective view of a gas cylinder operation mechanism.

Left and right inner surfaces of the second bearing part 92*b* of the bearing holder 92 are formed with bearing recess holes 96, which do not penetrate upwards, and the automatic raising lever 90 is formed with bearing projections 90*a* configured to laterally protrude and to fit into the bearing recesses 96 of the second bearing part 92*b*. Therefore, as shown in FIG. 36B, when the automatic raising lever 90 is turned over to reverse the front and rear directions, the bearing projections 90*a* are fitted into the bearing recesses 96 and then the automatic raising lever 90 is raised forwards, the automatic raising lever 90 can be set to the bearing holder 92. Also, the automatic raising lever 90 is configured to be rotatable about an axial center of the bearing projections 90*a*.

The automatic raising lever 90 has an upper spring bearing part 90*b* facing the lower spring bearing part 92*c* of the bearing holder 92. A compression coil spring 98, which is an example of a spring means, is interposed between the upper and lower spring bearing parts 90*b*, 92*c*. Therefore, the automatic raising lever 90 is urged by the spring 98 in a direction of pushing down the push valve 93. The upper and lower spring bearing parts 90*b*, 92*c* are provided with boss parts 90*c*, 92*d* for preventing the deviation of the spring 98.

A front end of the automatic raising lever 90 is provided with an upward-facing part 90*d*. When the movable base 104 is unfolded, the upward-facing part 90*d* of the automatic raising lever 90 is pushed by the movable base 104, so that the operation of pushing the push valve 93 by the automatic raising lever 90 is released. Since the rear end of the automatic raising lever 90 is positioned on the tip of the inward-facing part 89*c* of the operation rod 89, the operability of the operation rod 89 is not interrupted.

The lid 84 configured to cover the fixed base 8 is formed with a hole 99 for exposing upwardly the upward-facing part 90*d* of the automatic raising lever 90. The hole 99 is formed at the rear of the projection 87 as if it were hidden. At the raised state of the movable base 104, the upward-facing part 90*d* and the projection 87 are positioned at the substantially same height. For this reason, an object is not caught at the upward-facing part 90*d* and the outward appearance is not deteriorated.

When the movable base 104 is raised, the push valve 93 is pushed down by the spring 98 through the automatic raising lever 90, so that the fixed base 8 is raised. Therefore, a lever operation is not required and the fixed base 8 can be automatically raised by touching any part of the movable base 104 to raise the same. As previously described, in conjunction with the automatic raising, the inner and outer cylinders of the support device 1 are relatively rotated and a relative posture among the support device 1, the seat part 105 and the backrest is kept at the nestable reference posture.

A rotating stroke of the automatic raising lever 90 is slight. Therefore, in this illustrative embodiment, the fixed base 8 is raised at an early stage of raising and rotating the movable base 104. Also, when unfolding the movable base 104, the lock of the support device 1 is released at the end of the unfolding operation.

Since the spring 98 pushes the movable base 104 in the raising direction, the elastic force of the spring 98 is preferably made as small as possible, from a standpoint of the stability of the movable base 104. In this regard, the leverage by the automatic raising lever 90 is preferably made as large as possible (the automatic raising lever 90 can also be disposed at a long posture in a diagonal direction of the fixed base 8). Also, for the lifting operation means and the automatic raising means, the lever type is not necessarily required. For example, a cable conduit in which a wire is slidably inserted into a tube can also be adopted.

(11) Support Device of Thirteenth Illustrative Embodiment

In this illustrative embodiment, the support device 1 is also improved (the support device 1 of this illustrative embodiment can be applied to a chair other than a nestable chair, too). The improvements are described. The support device 1 has the branched legs 6*a*, 6*b* provided two by two at the front and rear parts, like the first illustrative embodiment. However, in this illustrative embodiment, roots of the respective branched legs 6*a*, 6*b* are configured to be flush with each other, and the legs are branched at the same height from the upper end portion of the cylinder 5.

Figures 39A, 39B:
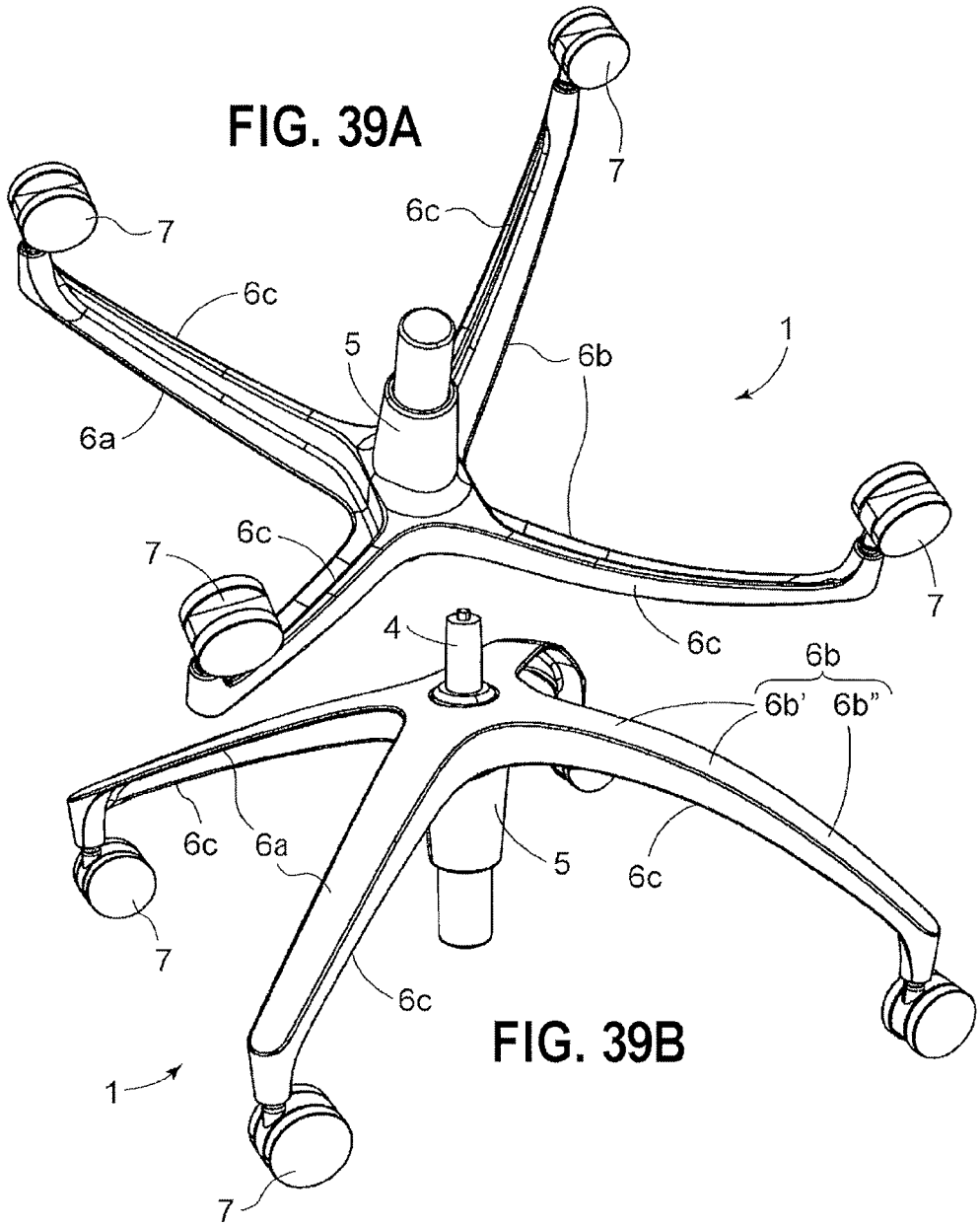
FIG. 39A is a perspective view of the support device at an overturned state.
FIG. 39B is a perspective view of the support device, as seen from above.

In order to enable the nesting back and forth, as shown in FIG. 37B, a left-to-right interval between the front ends of the front branched legs 6*a* is made to be smaller than a left-to-right interval of the front ends of the rear branched legs 6*b*, and as shown in FIG. 38, the front branched legs 6*a* are substantially straightly inclined, as seen from the side, and the rear branched legs 6*b* is bent to be upwardly convex, as seen from the side. Therefore, as shown in FIG. 39, the rear branched leg 6*b* has an isometry part 6*b*' positioned close to the root and keeping a high height and an inclined part 6*b*" of which a height is gradually lowered from the isometry part 6*b*' towards the tip. By this shape, the support devices 1 arranged at the front and the rear are fitted at the same posture, as seen from above.

Since the root heights of the respective branched legs 6*a*, 6*b* are the same, the outward appearance is considerably improved, as compared to a configuration where the root heights are different. Also, although the rear branched leg 6*b* is longer than the front branched leg 6*a*, since the rear branched leg has an upwardly convex arch structure, it is possible to keep the high strength. In the meantime, the front and rear relation of the branched legs 6*a*, 6*b* may be reversed. However, in order to prevent an interference with a user's foot, the front branched legs 6*a*, 6*b* are preferably made to be shorter and to be inclined, like this illustrative embodiment.

As shown in FIG. 39, the branched legs 6*a*, 6*b* of the support device 1 of the thirteenth illustrative embodiment have an inverted L-shaped section in which vertical plates 6*c* are provided at left and right outer sides of the upper surface parts thereof. On the other hand, in a modified embodiment shown in FIG. 40A, the vertical plate 6*c* is positioned at an intermediate part in a width direction, so that the branched leg has a T-shaped section. The rear branched leg 6*b* is provided with a resin buffer material (protection material) 213 for preventing a damage, which may be caused due to the collision during the nesting. The buffer material 213 extends along a lower surface of the vertical plate 6*c*, and a base end portion thereof is formed with a stopper part 213*a* protruding downwardly with which the front branched leg

6*a* of the fitted chair collides. The vertical plate 6*c* (buffer material 213) is fixed to the vertical plate 6*c* by a screw (not shown). Therefore, the buffer material 213 is formed with a screw hole 214.

Figures 40A, 40B, 40C, 40D:
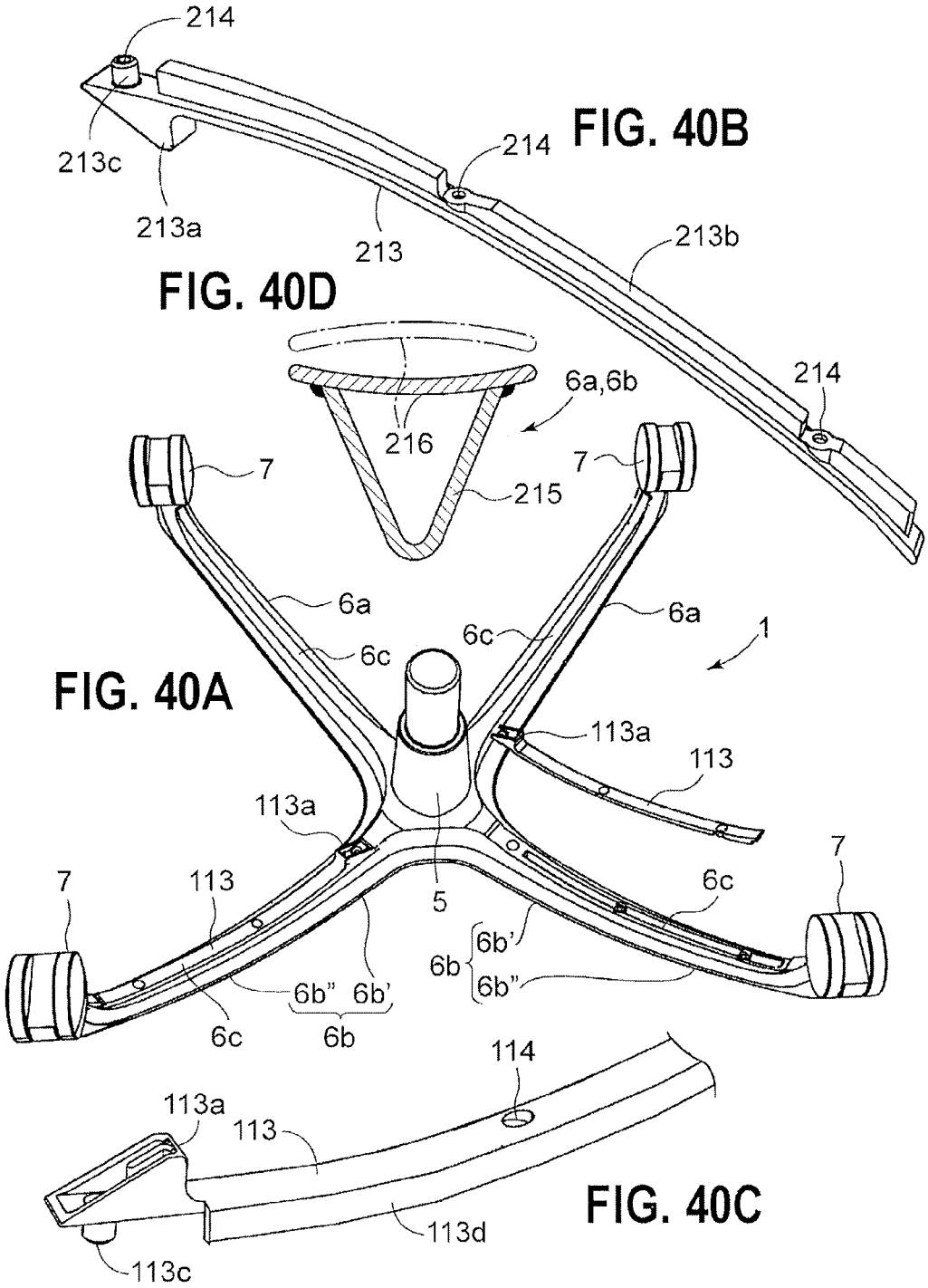
FIG. 40A is a partial exploded perspective view of a modified embodiment of the thirteenth illustrative embodiment at an overturned state.
FIG. 40B is a perspective view of a protection member used in FIG. 40A.
FIG. 40C is a partial perspective view of the protection member that can be used for the thirteenth illustrative embodiment.
FIG. 40D is a sectional view of a modified embodiment of branched legs.

As shown in FIG. 40B, an upward-facing projection 213*b* provided for the buffer material 213 is fitted into a recess line provided for the vertical plate 6*c* and a boss 213*c* provided for the base end portion is fitted to the vertical plate 6*c*. For this reason, the buffer material 213 is held so that it cannot deviate.

The buffer material 213 shown in FIG. 40B can be used for the branched leg 6*b* having an inverted L-shaped section, as it is. Alternatively, as shown in FIG. 40C, a buffer material having an upward-facing plate 113*d* overlapping with the inner surface of the vertical plate 6*c* may also be used for the branched leg 6*b* having an L-shaped section.

FIG. 40A shows an example in which the branched legs 6*a*, 6*b* are manufactured by a sheet-metal working. That is, in this example, the branched legs 6*a*, 6*b* are composed of a recess-shaped material 215 having a substantially V-shaped section and an upper surface member 216 overlapping with an upper surface of the recess-shaped material both of which are integrally bonded by the welding. The upper surface member 216 is gently bent to have an upward-facing concave shape shown with the solid line. However, as shown with the dashed-dotted line, an upward protruding shape that is gently bent or a flat surface shape may also be adopted. Although the upper surface member 216 protrudes outwardly beyond the recess-shaped material 215, the protruding may be omitted.

In a case of a molded product, the mold should be changed so as to change the design. For this reason, the cost may be increased as regards the design change. However, when a product manufactured by the sheet-metal working is adopted, as shown in FIG. 40A, it is possible to flexibly cope with the design change and to simply provide the protrusion because a material plate is punched, bent and then welded. The structure shown in FIG. 40A can be widely applied to a leg of the furniture.

(12) Fourteenth Illustrative Embodiment

Figure 41B:
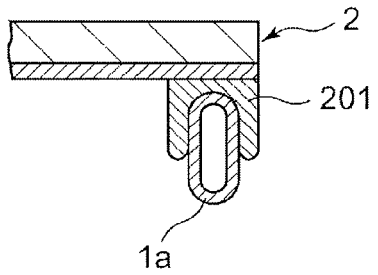
FIGS. 41A and 41B illustrate a fourteenth illustrative embodiment.
Figure 41A:
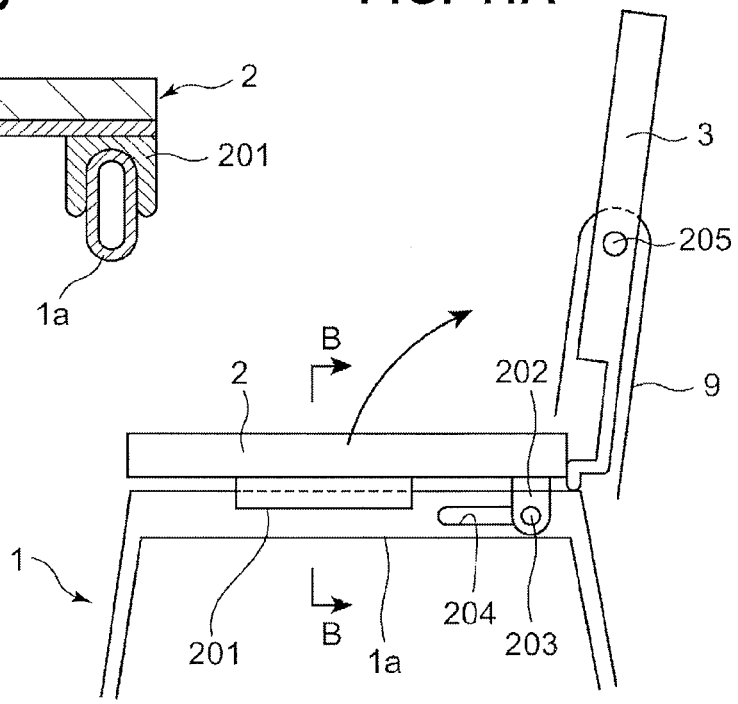

A fourteenth illustrative embodiment shown in FIG. 41 is applied to a chair having the support device 1 other than the lifting support device, such as a pipe chair. In this illustrative embodiment, both left and right side parts of the seat 2 are provided with sliders 201 having a downward-facing recess, and the sliders 201 are slidably fitted to side horizontal parts 1*a* of the support device 1. Also, the rear part of the seat 2 is provided with downward-facing brackets 202, and the brackets 202 are coupled to the side horizontal parts 1*a* of the support device 1 by pins (shafts) 203. Therefore, although the seat 2 is rotated about axial centers of the pins 203, guide holes to which the pins 203 are fitted are configured as holes 204 long in the front-rear direction, so that the forward movement of the seat 2 is permitted.

A vertically intermediate part of the backrest 3 is coupled to the support frames 9 vertically arranged at the support device 1 by shafts 205 oblong in the left-right direction, and the backrest 3 is tilted rearwards against a spring means (not shown). The backrest 3 is provided with a pusher configured to push forwards the seat 2 by the rearward tilting.

In this illustrative embodiment, the seat 2 is also urged in the retreat direction by the spring means. The chair has a guide means (not shown) for moving forwards the pins 203 when the seat 2 is raised. For this reason, even when the pins 203 are positioned below the seat surface, it is possible to raise the seat 2 so as to face the backrest 3. As can be easily deduced from this example, the rotating point of the seat is not necessarily fixed, and it is also possible to raise the seat and the movable base while entirely swinging the same.

In this illustrative embodiment, the side horizontal part 1*a* of the support device 1 is also used as a slide support means of the seat 2. For this reason, it is possible to simplify the structure. In this illustrative embodiment, the slider 201 is directly fitted to the side horizontal part 1*a*. However, a rail material such as resin may be fixed to the side horizontal part 1*a* and the slider 201 may be put on the rail material. Also, the metallic or resin movable base may be attached to the side horizontal part 1*a* so that it can be moved back and forth and raised and rotated, which may be then attached to the seat 2.

(13) Others

The present invention can be variously implemented, in addition to the above illustrative embodiments. For example, the shapes of the seat and backrest can be arbitrarily set, as required. As the spring means for providing the resistance against the rearward tilting of the backrest and the movement of the seat, a variety of spring members (elastic members) such as a torsion bar, a plate spring, a rubber and the like may be adopted. A lock means such as a gas cylinder for controlling the rearward tilting posture of the backrest can also be provided. The backrest or seat may have a structure where a mesh-type flexible seat material is stretched on a frame material configuring the outer periphery of the backrest or seat.

The backrest and the seat (movable base) may be attached to separate intermediate support members. That is, an intermediate support member for the backrest and an intermediate support member for the seat may be separately provided. For the chair having the fixed support device, like the twelfth illustrative embodiment, the upper side part 114 configuring the support device 101 may be provided with an upwardly protruding support member (support part) and the movable base and the backrest may be attached thereto.

The present invention can be implemented and manufactured as a chair. Therefore, the present invention has the industrial applicability.

What is claimed is:

1. A chair comprising:

a support device adapted to fit support devices of another chair in a front-rear direction of the chair;

a backrest attached to the support device or an intermediate support member provided for the support device at a first rotating point so that the backrest is adapted to be tilted rearwards by rotation about the first rotating point; and a seat adapted to be raised from an unfolded posture at which a person is capable of sitting thereon to a raised posture in which the seat overlaps with a front side surface of the backrest as seen from a front side of the chair, a plurality of chairs being capable of being fitted with each other back and forth by raising the seats thereof, wherein the seat is attached to the support device, the backrest, or the intermediate support member at a second rotating point so that the seat is adapted to be raised and rotated about the second rotating point and so that the seat is adapted to take at least one movement of forward movement, retreat movement, and tilting at the unfolded posture, and wherein the first rotating point is at a position different from that of the second rotating point.

2. The chair according to claim 1, wherein the support device is a fixed support device of which a height is unadjusted, wherein the fixed support device is provided with support frames positioned at left and right outer sides of the seat and protruding upwardly beyond the seat, as the intermediate support member, and wherein the backrest and the seat are attached to the support frames directly or via other members.

3. The chair according to claim 1, comprising:

a movable base member attached to the support device, the intermediate support member, or the backrest so that the seat is raisable and rotatable; and a spring means, wherein the seat is mounted to the movable base member so that the seat is movable back and forth, and wherein the seat is supported and urged to a back side of the chair by urging force from the spring means, and wherein when a sitting person leans on the backrest, the seat is moved forwards against the urging force from the spring means by a pushing action of the person.

4. The chair according to claim 1, wherein a posture change of the seat between the unfolded posture and the raised posture is permitted as the seat is rotated about the second rotating point positioned at a rear end portion of the seat or in the vicinity of the rear end portion, wherein the support device or a fixed base functioning as the intermediate support member provided for the support device is provided with a seat support part configured to support a part of the seat of the unfolded posture at a front side of the second rotating point, and wherein when the seat is raised and rotated to the raised posture from the unfolded posture, the seat support part is exposed.

5. The chair according to claim 4, wherein the second rotating point of the seat is located at a position higher than an upper surface of the seat.

6. The chair according to claim 4, wherein the support device has a structure where a plurality of branched legs radially extends from a leg column consisting of a gas cylinder, wherein the fixed base is attached to an upper end of the leg column and a tip of each branched leg is provided with a caster, and wherein a group of the branched legs is asymmetrically configured in the front-rear direction, as seen from above and the side, so that a plurality of groups is permitted to fit with each other back and forth.

7. The chair according to claim 6, wherein the fixed base is provided with support frames protruding upwardly beyond the seat at both left and right sides of the seat, as the intermediate support member, and wherein the backrest and the seat are attached to the support frames directly or via other members.

8. The chair according to claim 6, wherein the fixed base is provided with a manual lifting operation device enabling a sitting person to release a locked state of the gas cylinder and an automatic raising means for releasing the locked state of the gas cylinder by a spring force, and wherein the automatic raising means and the seat are configured to interlock with each other so that the locked state of the gas cylinder is released at the unfolded state of the seat and the gas cylinder is locked at the raised state of the seat.

9. The chair according to claim 1, comprising:

an interlocking means; and a spring means, wherein the backrest and the seat are configured to directly interlock with each other or to interlock with each other via the interlocking means so that when the backrest is tilted rearwards, the seat takes at least one movement of the forward movement, the retreat movement, and the tilting, and wherein the spring means is configured to return the backrest and the seat to original states when a body pressure of a sitting person applied to the backrest is released.

10. The chair according to claim 9, comprising:

a movable base member attached to the support device, the intermediate support member, or the backrest so that the seat is raisable and rotatable, wherein the seat is mounted to the movable base member so that the seat is movable back and forth, and wherein when the backrest is tilted rearwards, the seat is moved forwards.

11. The chair according to claim 9, wherein the seat is coupled to the support device, the intermediate support member, or the backrest so that the seat is raisable and rotatable and so that the seat is retreated or moved forwards in conjunction with rearward tilting of the backrest, and wherein a part of the seat at a front side of the raising and rotating point is slidably supported by the support device or fixed base provided for the support device.

12. A chair comprising:

a support device adapted to fit support devices of another chair in a front-rear direction of the chair;

a backrest attached to the support device or an intermediate support member provided for the support device at a first rotating point; and a seat adapted to be raised from an unfolded posture at which a person is capable of sitting thereon to a raised posture in which the seat overlaps with a front side surface of the backrest as seen from a front side of the chair, a plurality of chairs being capable of being fitted with each other back and forth by raising the seats, wherein the seat is attached to the support device, the backrest, or the intermediate support member at a second rotating point so that the seat is adapted to be raised and rotated about the second rotating point and so that the seat is adapted to be moved forwards at the unfolded posture by a pushing action of a person, and wherein the first rotating point is at a position different from that of the second rotating point.

* * * * *